US008186790B2

(12) United States Patent
Basaran et al.

(10) Patent No.: US 8,186,790 B2
(45) Date of Patent: May 29, 2012

(54) METHOD FOR PRODUCING ULTRA-SMALL DROPS

(75) Inventors: Osman Basaran, West Lafayette, IN (US); Qi Xu, Lisle, IL (US)

(73) Assignee: Purdue Research Foundation, West Lafayette, IN (US)

( * ) Notice: Subject to any disclaimer, the term of this patent is extended or adjusted under 35 U.S.C. 154(b) by 379 days.

(21) Appl. No.: 12/405,183

(22) Filed: Mar. 16, 2009

(65) Prior Publication Data

US 2009/0309908 A1 Dec. 17, 2009

Related U.S. Application Data

(60) Provisional application No. 61/036,590, filed on Mar. 14, 2008.

(51) Int. Cl.
*B41J 29/38* (2006.01)

(52) U.S. Cl. ..... 347/10; 347/11

(58) Field of Classification Search ..... 347/9, 10, 347/11

See application file for complete search history.

(56) References Cited

U.S. PATENT DOCUMENTS

| | | | |
|---|---|---|---|
| 3,683,212 | A | 8/1972 | Zoltan |
| 3,946,398 | A | 3/1976 | Kyser et al. |
| 4,251,824 | A | 2/1981 | Hara et al. |
| 4,418,354 | A | 11/1983 | Perduijn |
| 4,490,728 | A | 12/1984 | Vaught et al. |
| 4,513,299 | A | 4/1985 | Lee et al. |
| 4,584,590 | A | 4/1986 | Fischbeck |
| 4,639,735 | A | 1/1987 | Yamamoto et al. |
| 4,879,568 | A | 11/1989 | Bartky et al. |
| 5,170,177 | A | 12/1992 | Stanley et al. |
| 5,381,162 | A | 1/1995 | Roy et al. |
| 5,495,270 | A | 2/1996 | Burr et al. |
| 5,557,304 | A | 9/1996 | Stortz |
| 5,736,993 | A | 4/1998 | Regimbal et al. |
| 5,748,214 | A | 5/1998 | Usui et al. |
| 5,757,391 | A | 5/1998 | Hoisington |
| 5,777,636 | A | 7/1998 | Naganuma |
| 5,880,750 | A | 3/1999 | Takahashi |
| 5,901,425 | A | 5/1999 | Bibl et al. |
| 5,912,679 | A | 6/1999 | Takayama et al. |

(Continued)

FOREIGN PATENT DOCUMENTS

| | | | |
|---|---|---|---|
| EP | 541129 | A1 | 7/1996 |

(Continued)

OTHER PUBLICATIONS

Wijshoff, Herman. Manipulating Drop Formation in Piezo Acoustic Inkjet, Proc. IS&T's NIP22, 79 (2006) [retrieved on Jun. 14, 2011]. Retrieved from the Internet: <URL: http://www.flow3d.com/pdfs/tp/micro_tp/FloSci-Bib21-06.pdf.*

(Continued)

*Primary Examiner* — Julian Huffman

(74) *Attorney, Agent, or Firm* — John V. Daniluck; Bingham Greenebaum Doll LLP

(57) ABSTRACT

Apparatus and methods for producing a drop from a Drop on demand (DOD) dispenser, the drop having a radius that is much smaller than the radius of the nozzle that expels the drop. Generally, the Ohnesorge number is less than about 0.1. Various embodiments of the invention are found within a four dimensional space defined in terms of the Ohnesorge number, the Weber number, the actuation frequency, and the initial conditions.

30 Claims, 41 Drawing Sheets

U.S. PATENT DOCUMENTS

| | | | |
|---|---|---|---|
| 6,020,905 | A | 2/2000 | Cornell et al. |
| 6,029,896 | A | 2/2000 | Self et al. |
| 6,070,779 | A | 6/2000 | Baggerman et al. |
| 6,079,811 | A | 6/2000 | Cornell et al. |
| 6,109,732 | A | 8/2000 | Wen |
| 6,149,258 | A | 11/2000 | Kimura |
| 6,161,912 | A | 12/2000 | Kitahara |
| 6,257,689 | B1 | 7/2001 | Yonekubo |
| 6,328,398 | B1 | 12/2001 | Chang |
| 6,328,421 | B1 | 12/2001 | Kojima et al. |
| 6,350,003 | B1 | 2/2002 | Ishikawa |
| 6,428,135 | B1 | 8/2002 | Lubinsky et al. |
| 6,450,602 | B1 | 9/2002 | Lubinsky et al. |
| 6,450,615 | B2 | 9/2002 | Kojima et al. |
| 6,464,315 | B1 | 10/2002 | Otokita |
| 6,513,894 | B1 | 2/2003 | Chen et al. |
| 6,998,074 | B1 | 2/2006 | Radulescu |
| 7,156,480 | B2 | 1/2007 | Norigoe |
| 7,175,245 | B2 | 2/2007 | Sekiya et al. |
| 7,195,327 | B2 | 3/2007 | Kitami |
| 7,201,459 | B1 | 4/2007 | Sano |
| 7,223,309 | B2 | 5/2007 | Takahashi et al. |
| 7,234,788 | B2 | 6/2007 | Gardner |
| 7,234,789 | B2 | 6/2007 | Sekiguchi |
| 7,237,872 | B1 | 7/2007 | Spehrley, Jr. et al. |
| 7,249,816 | B2 | 7/2007 | Kusunoki et al. |
| 7,258,408 | B2 | 8/2007 | Usuda |
| 7,270,712 | B2 | 9/2007 | Edwards et al. |
| 7,278,698 | B2 | 10/2007 | Tamura |
| 7,281,778 | B2 | 10/2007 | Hasenbein et al. |
| 7,284,835 | B2 | 10/2007 | Watanabe |
| 7,314,262 | B2 | 1/2008 | Togashi |
| 7,334,856 | B2 | 2/2008 | Hamazaki |
| 7,357,471 | B2 | 4/2008 | Clark |
| 7,364,247 | B2 | 4/2008 | Iwao et al. |
| 7,367,658 | B2 | 5/2008 | Kusunoki et al. |
| 7,370,921 | B2 | 5/2008 | Kobayashi |
| 7,370,924 | B2 | 5/2008 | Sekiguchi |
| 7,384,111 | B2 | 6/2008 | Hosono |
| 7,384,112 | B2 | 6/2008 | Hasegawa |
| 7,387,354 | B2 | 6/2008 | Usuda |
| 7,396,096 | B2 | 7/2008 | Kobayashi et al. |
| 7,410,232 | B2 | 8/2008 | Takahashi |
| 7,410,233 | B2 | 8/2008 | Kitami |
| 7,445,305 | B2 | 11/2008 | Kondoh |
| 7,448,708 | B2 | 11/2008 | Nakayama |
| 7,449,070 | B2 | 11/2008 | Edwards et al. |
| 7,452,042 | B2 | 11/2008 | Norigoe |
| 7,463,826 | B2 | 12/2008 | Takeshita et al. |
| 7,490,920 | B2 | 2/2009 | Usuda |
| 7,494,199 | B2 | 2/2009 | Aoki |
| 7,600,840 | B2 | 10/2009 | Kim et al. |
| 7,611,229 | B2 | 11/2009 | Hibi et al. |
| 7,896,456 | B2 | 3/2011 | Iwashita et al. |
| 7,909,427 | B2 | 3/2011 | Kim et al. |
| 2007/0008358 | A1 | 1/2007 | Kobayashi |
| 2007/0046704 | A1 | 3/2007 | Okuda |
| 2007/0052743 | A1 | 3/2007 | Kawauchi |
| 2007/0052756 | A1 | 3/2007 | Okuda |
| 2007/0085868 | A1 | 4/2007 | Nakayama |
| 2007/0097162 | A1 | 5/2007 | Iwashita et al. |
| 2007/0146399 | A1 | 6/2007 | Yamamoto et al. |
| 2007/0182774 | A1 | 8/2007 | Iriguchi |
| 2007/0195117 | A1 | 8/2007 | Iriguchi |
| 2007/0273719 | A1 | 11/2007 | Yamashita |
| 2007/0285454 | A1 | 12/2007 | Shang |
| 2008/0024535 | A1 | 1/2008 | Ito |
| 2008/0036807 | A1 | 2/2008 | Ihara |
| 2008/0049056 | A1 | 2/2008 | Teramae |
| 2008/0088656 | A1 | 4/2008 | Norigoe |
| 2008/0106557 | A1 | 5/2008 | Sayama |
| 2008/0150983 | A1 | 6/2008 | Sasaki |
| 2008/0198192 | A1 | 8/2008 | Iriguchi |

FOREIGN PATENT DOCUMENTS

| | | | |
|---|---|---|---|
| EP | 699136 | A1 | 10/1997 |
| EP | 1195250 | A1 | 4/2002 |
| EP | 827838 | A2 | 3/2005 |
| EP | 1618060 | A2 | 1/2006 |
| EP | 1717035 | A1 | 11/2006 |
| EP | 1752213 | A1 | 2/2007 |
| EP | 1717035 | B1 | 12/2010 |
| JP | 5245000 | A | 9/1993 |
| WO | 2005069759 | A2 | 8/2005 |
| WO | 2005069759 | A3 | 3/2006 |

OTHER PUBLICATIONS

Basaran, O. and Suryo, R., "Fluid Dynamics, The Invisible Jet," Nature Physics, vol. 3, Oct. 2007, pp. 679-680.

Basaran, O., "Small-Scale Free Surface Flows with Breakup: Drop Formation and Emerging Applications," AIChE Journal, vol. 48, No. 9, Sep. 2002, pp. 1842-1848.

Chen, A., Notz, P. and Basaran, O, "Computational and Experimental Analysis of Pinch-off Scaling," The American Physical Society, vol. 88, No. 17, Apr. 29, 2002, pp. 174501-1-174501-4.

Chen, A. and Basaran O., "A new method for significantly reducing drop radius without reducing nozzle radius in drop-on-demand drop production," American Institute of Physics, vol. 14, No. 1, Jan. 2002.

* cited by examiner (b)

(a)

METHOD FOR PRODUCING ULTRA-SMALL DROPS

This application claims the benefit of priority to U.S. Provisional Patent Application Ser. No. 61/036,590, filed Mar. 14, 2008, entitled METHOD FOR PRODUCING ULTRA-SMALL DROPS, incorporated herein by reference.

FIELD OF THE INVENTION

Various embodiments of the present invention pertain to methods and apparatus for producing small radius drops, and in particular for producing drops from a drop-on-demand dispenser.

BACKGROUND OF THE INVENTION

The use of drop-on-demand (DOD) inkjet technologies is becoming increasingly widespread in many industrial applications ranging from gene chip production to separations to paper printing. Since the development of the first DOD inkjet devices, great advances in inkjet technologies have made ink-jets economical and versatile. As popularity of ink-jets grows so does the need to understand the factors which contribute to drop quality (e.g. drop speed, accuracy, and uniformity). Additionally, gene chip arraying devices have the special requirement that they should be capable to dispensing many different types of liquids using a given nozzle, where a typical ink-jet printer may dispense only a single ink formulation per nozzle.

The study of liquid jets and drops has a long history. In 1879, Lord Rayleigh showed that long cylindrical columns of fluid are unstable as a result of naturally occurring undulations on their surfaces. The driving force behind such instability is surface tension, which drives fluid from locally thin regions to locally thick regions, a runaway process that inevitably causes the jet to break up into drops. Almost a century later, this phenomenon was exploited by Sweet, with the invention of continuous ink-jet (CIJ) printing and the first microelectromechanical device, the ink-jet print head. In CIJ printing, and the currently more popular and cheaper method of ink-jet printing known as drop-on-demand (DOD), the principle goal has been to produce ever-smaller drops. However, doing so has required the manufacture of ever-smaller nozzles. As small nozzles are fraught with problems of clogging, breakage and increased flow resistance, current technology limits us to nozzle and drop sizes of 5-10 μm in printing, and 25-100 μm in the production of DNA or protein microarrays and polymer beads (for use in ion-exchange systems and as spacers in LCD flat screen displays) for which modified ink-jet printers are commonly used.

Some DOD dispensing systems currently in use utilize electrical control signals with particular characteristics in order to achieve the desired drop qualities. For example, some existing systems use a control signal that consists of a waveform with a single polarity, such as half of a square wave. Yet other existing systems use an electrical control signal consisting of two portions, one portion being of a first polarity and the other portion being of a second and opposite polarity, such as a single, full square wave. In some cases, the timed durations of the two portions are identical. Many of these systems provide an electrical control signal that grossly produces one or more large drops, the large drops being created by a fluid meniscus which takes on a generally convex shape on the exterior of ejecting orifice. The large drop is formed when the edges of the meniscus in contact with the orifice separate from the orifice. These systems produce drops of a diameter equal to or greater than the diameter of the orifice. Yet other systems produce drops by resonating the meniscus. Such systems do not generally move the meniscus either toward the exterior of the dispenser, or toward the internal passage of the dispenser, but simply create oscillatory conditions on the meniscus. The drop quality of such oscillatory dispensing methods are likely to be subject to manufacturing imperfections near the orifice, or deposits of material near the orifice, such as dried ink.

Rieer and Wriedt have experimentally studied drop generation process using freely adjustable drive signals. A drop of 8 μm from a nozzle of 40 μm is successfully generated by applying a very carefully designed staircase signal. They have found that the conditions required for small drop formation is very strict, with only a few out of many applied drive pulses leading to small droplets. Chen and Basaran have investigated the small water/glycerin drop formation from a PZT nozzle by applying a succession of three square pulses (negative, positive and negative). A drop of 16 μm is made from a nozzle of 35 μm. Their experiments have shown that the key to generating a small drop is the extrusion of a small tongue from primary drop formed by the positive pulse and the detachment of the tongue during the second negative pulse. They have discussed the effects of control parameters, such as process time $t_p$ and the Ohnesorge number Oh, on the ejection of small drops. Small droplets are only observed for intermediate values of $t_p$ and Oh. The range of Oh for the tongue to arise is between 0:1 to 0:2 under their experimental conditions. Goghari and Chandra build a pneumatic DOD apparatus which consists a nozzle filled with water/glycerin mixture, a gas cylinder with a solenoid valve and a venting valve connected directly with the nozzle. Opening the valves subsequentially creates alternating negative and positive pressure pulses and produce droplets from the nozzle. A 55~90 wt % glycerin drop of 150 μm is made from a nozzle of 204 μm in 0:8 ms, instead of tens of μs in Chen and Basaran's experiments.

SUMMARY OF THE INVENTION

One aspect of the present invention pertains to a method for expelling a drop of a fluid from an orifice. In some cases this includes providing a dispenser including a reservoir for a fluid, the reservoir having an internal volume that is electrically and the dispenser defining an orifice of a predetermined internal radius R. In some cases this includes providing a fluid to the dispenser, the fluid and orifice being characterized with an Ohnesorge number less than about 0.1. In some cases this includes providing an electronic controller to actuate the reservoir with a control signal at a predetermined frequency that is established as a function of the Weber and Ohnesorge numbers.

Another aspect of the present invention pertains to an apparatus for expelling a drop of fluid from an orifice. In some cases this includes a dispenser having a reservoir that is piezoelectrically actuatable and an expulsion orifice in fluid communication with the reservoir. In some cases this includes an electronic controller operably connected to said dispenser and providing an electronic actuation signal to change the volume. In some cases this includes a supply of fluid to the reservoir, the Ohnesorge number of the fluid and the orifice being greater than about 0.01 and less than about 0.1. The beginning of the signal withdraws fluid toward the reservoir and the drop is expelled after the end of the signal.

Another aspect of the present invention pertains to a method for expelling a drop of a fluid from an orifice. In some cases this includes providing a dispenser including a reservoir for a fluid, the reservoir having an internal volume that is electrically actuable between a smaller volume and a larger volume and an orifice provided the fluid from the reservoir. In some cases this includes creating a surface wave of the fluid at the orifice, the surface wave having a trough directed inward toward the reservoir. In some cases this includes decreasing the volume of the reservoir and pushing fluid from the reservoir toward the trough by said decreasing.

Another aspect of the present invention pertains to a method for expelling a drop of a fluid from an orifice. In some cases this includes providing an electrically actuable dispenser including a reservoir for a fluid and defining an orifice that is provided the fluid from the reservoir. In some cases this includes establishing an initial drop shape of substantially quiescent fluid at the orifice, the drop being in a predetermined range of sizes, the center of the initial drop being on the same side of the orifice as the reservoir. In some cases this includes beginning said actuating by withdrawing the substantially quiescent fluid from the orifice toward the reservoir.

It will be appreciated that the various apparatus and methods described in this summary section, as well as elsewhere in this application, can be expressed as a large number of different combinations and subcombinations. All such useful, novel, and inventive combinations and subcombinations are contemplated herein, it being recognized that the explicit expression of each of these myriad combinations is excessive and unnecessary.

BRIEF DESCRIPTION OF THE DRAWINGS

FIG. 1(*b*) is a cross-sectional schematic representation of the piezoelectric dispenser, for the system of FIG. 1.

FIG. 1(*c*) is a graphic representation of a known control signal.

FIG. 1(*d*) is a graphic representation of the pressure response of a fluid within a Piezo driver in response to application of the signal of FIG. 1(*c*).

FIG. 1(*e*): Left: A nozzle of radius R for producing drops. Right: Flow rate Q upstream of the nozzle exit as a function of time, t.

FIG. 1(*f*): Evolution in time of the shape of a drop as it is formed from a nozzle using the new method. At t=0.001, the liquid barely protrudes out of the nozzle and the meniscus is virtually flat. As the flow rate is oscillated as shown in FIG. 1, the surface of the liquid or the meniscus oscillates and a drop is about to form at t=1.137. The oscillations have died down by the time t=3.000.

FIG. 1(*g*): Comparison of drop volumes formed using traditional ink jet technology (left), the method of Chen and Basaran (middle), and the new method (right).

FIG. 1(*h*): Definition sketch of fine drop formation from a nozzle: a, time=0; b, time=$\tilde{t}$.

FIG. 1(*i*) is a graphical representation according to one embodiment of the present invention.

FIG. 10 is the same as FIG. 1*f*.

In FIGS. 22 to 24, $\sqrt{We}/\Omega=10$. At each instant in time, streamlines are shown to the right of the centerline r=0 and pressure fields, contour values of which are indicated in each subplot as well as in the legend, are shown to its left.

FIG. 23. Same as FIG. 22, but when We=6.4 and Ω=0.8.

FIG. 24. Same as FIG. 22, but when We=10 and Ω=1.0.

DESCRIPTION OF THE PREFERRED EMBODIMENT

Figure 1A:
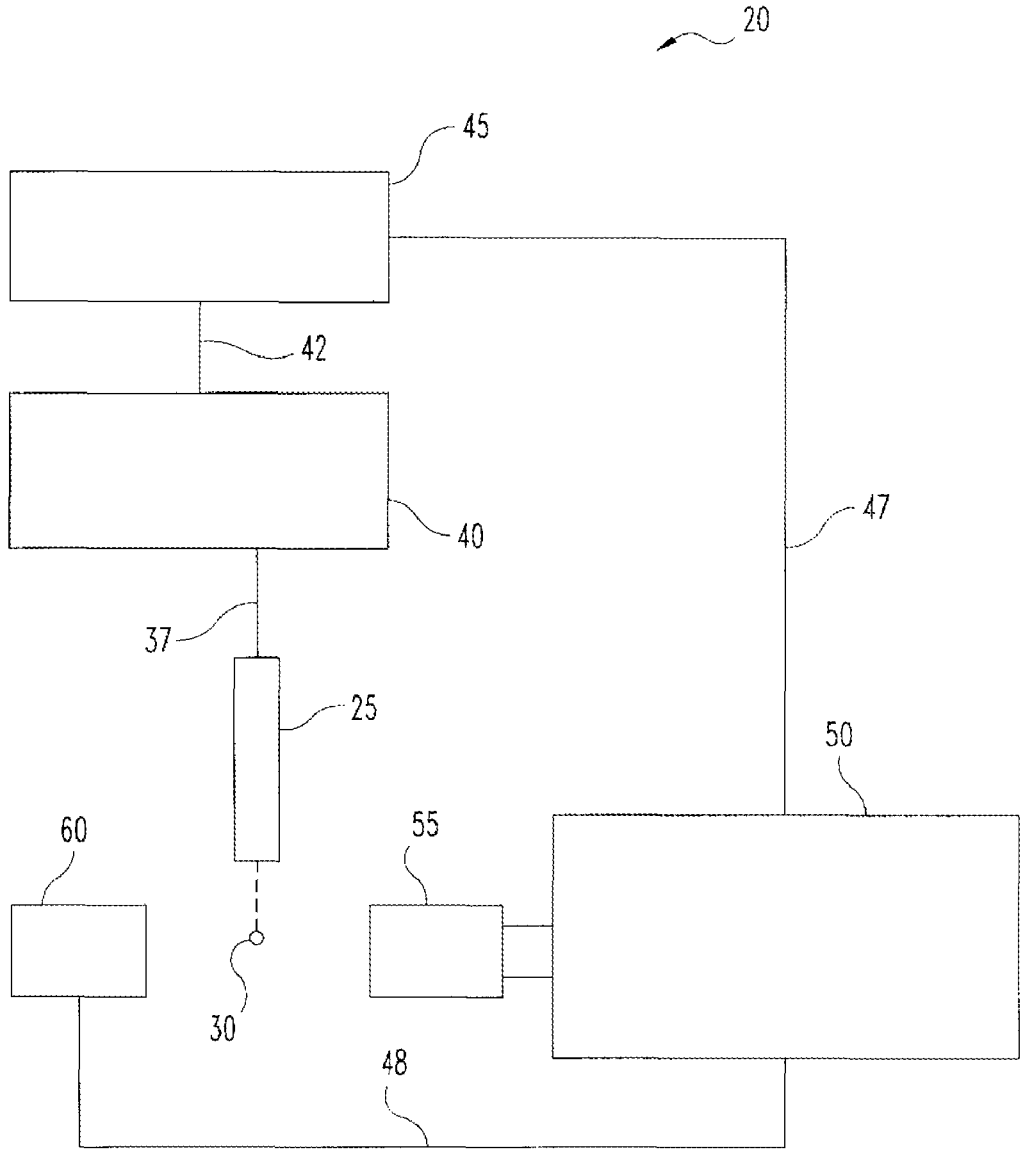
FIG. 1(*a*) is a schematic representation of a system for dispensing drops according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates. At least one embodiment of the present invention will be described and shown, and this application may show and/or describe other embodiments of the present invention. It is understood that any reference to "the invention" is a reference to an embodiment of a family of inventions, with no single embodiment including an apparatus, process, or composition that must be included in all embodiments, unless otherwise stated.

The use of an N-series prefix for an element number (NXX.XX) refers to an element that is the same as the non-prefixed element (XX.XX), except as shown and described thereafter. As an example, an element 1020.1 would be the same as element 20.1, except for those different features of element 1020.1 shown and described. Further, common elements and common features of related elements are drawn in the same manner in different figures, and/or use the same symbology in different figures. As such, it is not necessary to describe the features of 1020.1 and 20.1 that are the same, since these common features are apparent to a person of ordinary skill in the related field of technology. Although various specific quantities (spatial dimensions, temperatures, pressures, times, force, resistance, current, voltage, concentrations, wavelengths, frequencies, etc.) may be stated herein, such specific quantities are presented as examples only. Further, discussion pertaining to a specific composition of matter, that description is by example only, does not limit the applicability of other species of that composition, nor does it limit the applicability of other compositions unrelated to the cited composition.

This document incorporates by reference U.S. Pat. No. 6,513,894 B1, issued Feb. 4, 2003, to inventors Chen and Basaran.

In this paper, the formation of fine drops with radius much smaller than that of nozzles from which drops are formed has been studied by carrying out a large number of numerical simulations. Liquid inside a capillary is subject to an inflow condition of two consecutive sinusoidal waveforms. The effects of corresponding dimensionless groups: Ω, We and Oh, are carefully studied in order to find out the conditions under which a fine drop forms.

As one example, a detailed process of the formation of a small drop with only about one thousandth of the volume of a theoretical drop of the radius of the capillary is shown in this paper, when Ω=20, We=16.43 and Oh=0.05. Analysis of the variation with time 20 of pressure and velocity fields inside the liquid during the process of drop formation indicates that the "resonance" of surface capillary flow and oscillatory inflow is crucial for the occurrence of small drops. When the positive inflow meets the capillary flow from the crest area of free surface toward the wave valley at the center of the capillary, liquid near the center of capillary and right below the free surface is squeezed by these two flows so that a hot" region with high pressure occurs. Once the pressure in hot region is sufficiently high, a high-speed liquid jet is ejected from the free surface and a small drop is formed subsequently. Because the hot region only exists within a short range at capillary center, the size of the jet and subsequent drop can be much smaller than the size of the nozzle.

Figure 8:
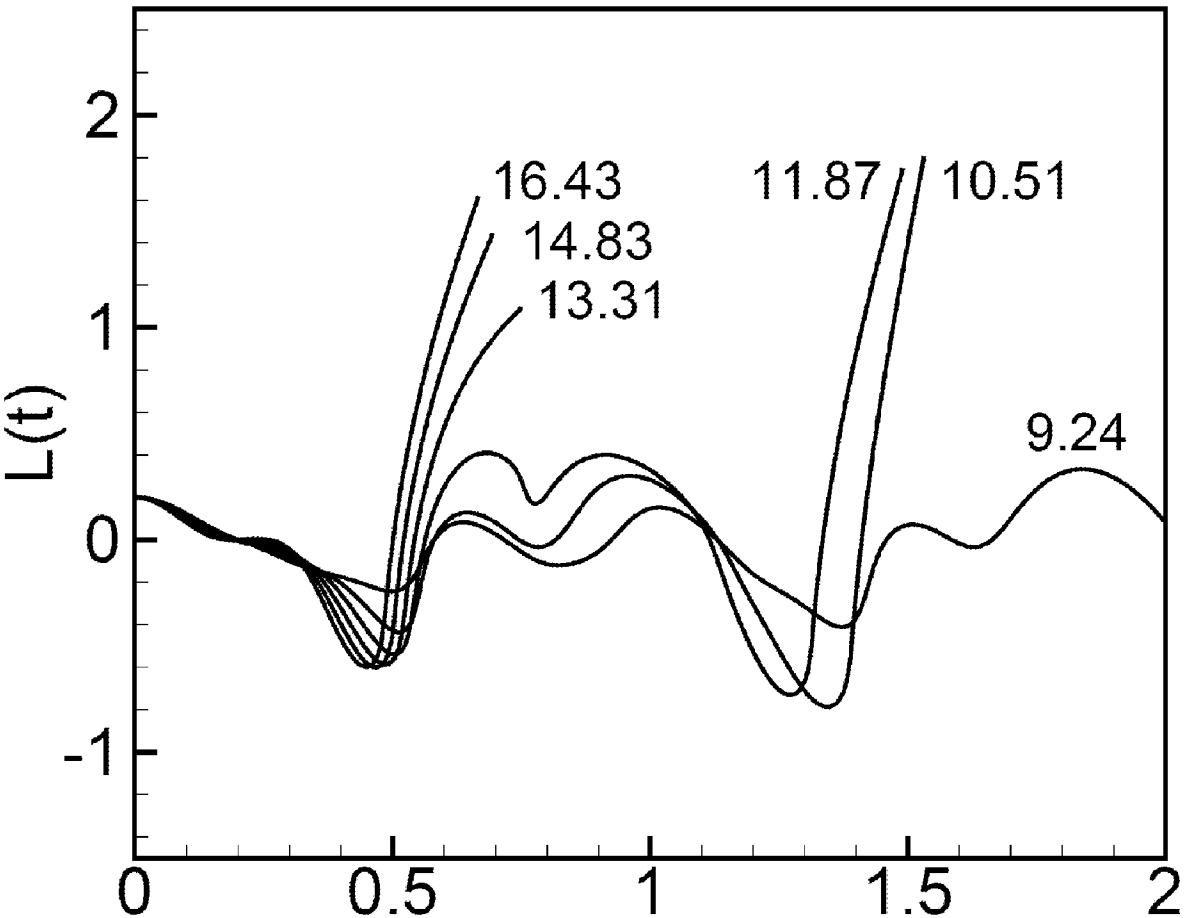
FIG. 8: Evolution in time of the drop length, L(t), for six cases with different Weber number and Omega when Oh=0.05.

The frequency of inflow and surface wave is determined by many parameters, including Ω, We, and Oh. The formation of small drops which results from the occurrence of the \resonance" of oscillatory inflow with surface waves is sensitive to these dimensionless groups. Small drop formation may not happen when Ω varies from 20 to 34, simply because the frequency of inflow changes with Ω. When the liquid is highly viscous, i.e. Oh>>1, surface waves quickly damp out after initiated by bulk liquid motion; on the other hand, when Oh<<1, the liquid behaves as if it were inviscid. The resulting motion of liquid under the inflow boundary condition is almost plug flow, and the free surface oscillates with the bulk with same frequency. Therefore, it is difficult for "resonance" to happen when inflow changes its direction. The formation of small drops happens with an intermediate Oh. Sufficient potential energy should be built up in the "hot" region during the oscillation of the liquid so that a high-speed jet can be ejected from the surface. When We is small, it is possible for the inflow to oscillate more than one cycle to accumulate enough energy in \hot" high pressure region. As shown in FIG. 8, when We≦12, small drops are formed within the second cycle of inflow; when We is reduced below 10, no drop formation is obtained.

Figure 10:
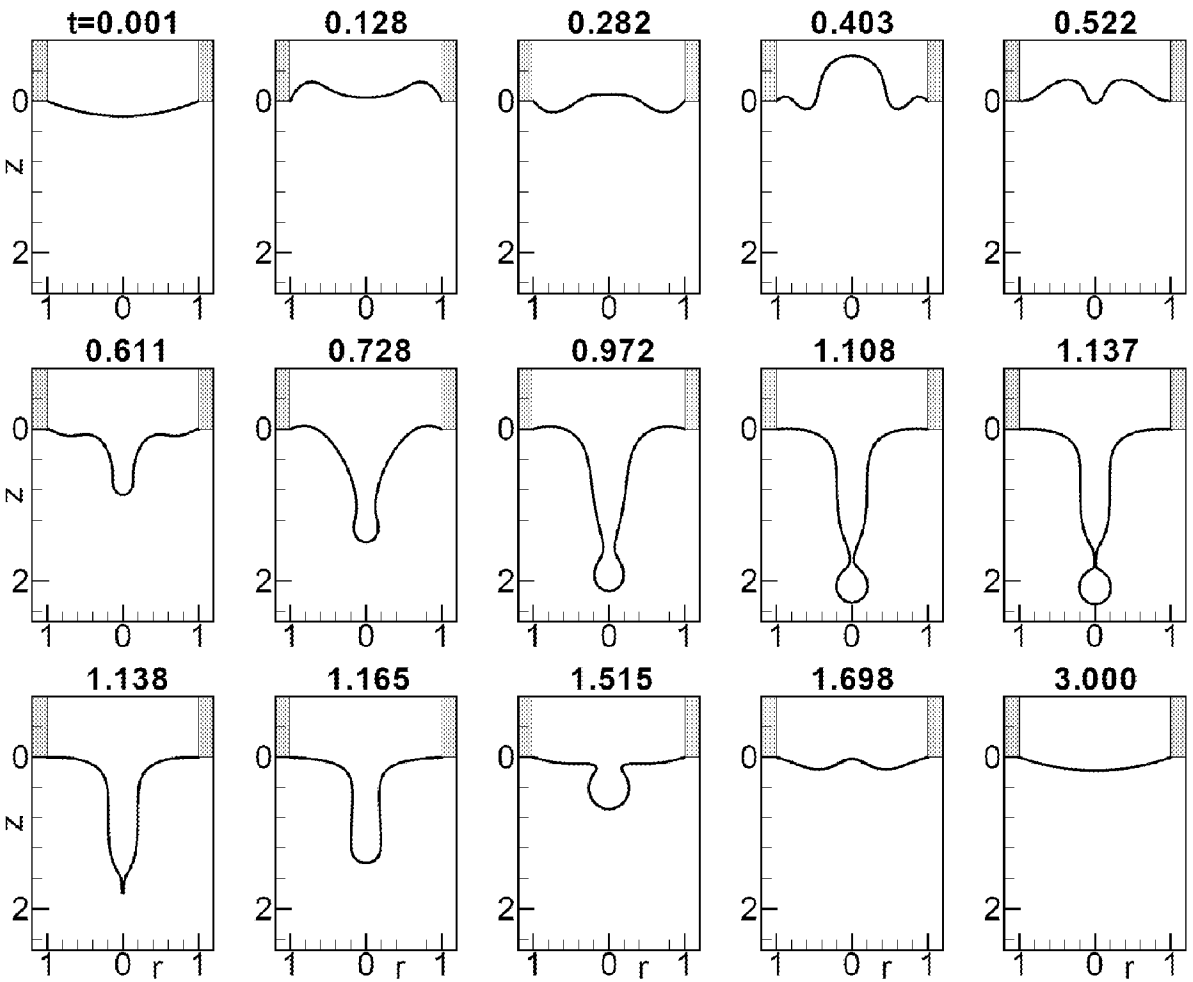
FIG. 10: Evolution in time of the shape profiles of a drop when Ω=22, We=34, and Oh=0.1.

FIG. 10 shows the dynamics after first small drop formation when Ω=22, We=34 and Oh=0.1. As shown in simulation results, the liquid jet recoils back to the bulk liquid after the first drop breaks and no secondary drop is formed. It is this case that some applications may favor since the formation of secondary drop is usually undesirable. To investigate the scaling of small drop volume, simulations are carried out to track the changes of drop volume with different viscosity. The volume of small drops is proportional to the dimensionless viscous length Oh2, which implies that the drop formation does not depend on the inflow condition.

The formation of drops with the size smaller than that of the nozzle where drops come from has many applications in ink-jet printing related areas. A computational analysis is carried out to simulate the formation of these fine drops by using drop-on-demand (DOD) ink jet printing technology. A drop with the radius one order of magnitude smaller than that of the nozzle is successfully observed in simulations when a deliberated designed drive signal including two cycles of sinusoidal waves are applied at the inlet of the nozzle for actuation. Various embodiments of the present invention contemplate various types of actuation signals, including square waves, sawtooth waves, ramp waves, and others. Further, although a signal may be shown or described, it is understood that the signal may be comprised of or considered as separate signals.

Detailed analysis on the dynamics shows that the key to the fine drop formation is the occurrence of \hot" high pressure region under the liquid/gas interface due to the squeezing impact of the bulk liquid flow and the surface oscillations. The effects of three dimensionless groups: the frequency of inlet flow Ω, the Weber number We, and the Ohnesorge number Oh, are investigated by a number of simulations. Computation results show that the formation of small drops is sensitive to We, Ω and Oh. We determines the how fast a small drop is ejected from the bulk liquid. When We is large, enough kinetic energy is quickly accumulated in the "hot" region so that small drops break within one cycle of the sinusoidal wave. When We is low, it may take two cycles for the liquid to gain enough energy for drop ejections. When We is below a critical value, no drop formation is observed within two cycles of inflow. The scaling analysis shows that for some viscous effects, the size of the small drop is proportional to the viscous length Oh.

A phase or operability diagram in (We, Ω)-space is developed that shows that three regimes of operation are possible. In the first regime, where We is low, breakup does not occur, and drops remain pendant from the nozzle and undergo time periodic oscillations. Thus, the simulations show that fluid inertia, and hence We, must be large enough if a DOD drop is to form, in accord with intuition. Referring to FIG. 1(*i*), a sufficiently large We causes both drop elongation and onset of drop necking but flow reversal is also necessary for the complete evacuation of the neck and capillary pinching. In the other two regimes, at a given Ω, We is large enough to cause drop breakup. In the first of these two regimes, where $We_{c1}<We<We_{c2}$, DOD drops do form but have negative velocities, i.e. they would move toward the nozzle upon breakup, which is undesirable. In the second breakup regime, where $We>We_{c2}$, not only are DOD drops formed but they do so with positive velocities.

Various embodiments of the present invention pertain to apparatus and methods in which a fluid can be manipulated by an actuation signal for a particular orifice to provide a drop having a radius that is significantly smaller than the radius of the orifice. Generally, there are subranges of the following parameters for a specific fluid, orifice, and actuation signal that can be found within the following overall ranges of Table 1:

TABLE 1

| | Approx. Min. | Approx. Max. |
|---|---|---|
| Oh | 0.01 | 0.1 |
| We | 9 | 36 |
| Omega | 20 | 40 |
| alpha | −1 | −0.7 |

Note that the ranges are independent on each other and interrelated. When Oh=0.01, the range for We and Omega may be different from that when Oh=0.1. The range for alpha should be at least between −0.7<alpha<−1.0.

Various types of fluids, actuation signals, and dispensers can be adapted and configured to operate with the four dimensional space of Table 1. As one example, for a given orifice radius of the dispenser, the viscosity and surface tension of the fluid can be modified so as to produce the small drop described herein. As another example, for a fluid having a given viscosity and surface tension, the actuation signal can be selected so as to produce the small drop described herein.

In some embodiments, it can be viewed that the actuation signal moves the fluid in the dispenser such that the action of the surface wave with the fluid upstream of the orifice are out of phase. This can be thought of as two things that happen at the same time: (1) the liquid close to the surface focuses to the central zone and toward the nozzle, (2) the excitation changes from negative flow to positive flow upstream the nozzle. The collision of these two flows causes the high pressure region and subsequent high velocity. There is a phase shift. Preferably, an initial negative velocity Vz is desirable for the formation of a small drop.

Various embodiments of the present invention pertain to apparatus and methods in which the excitation first produces a high pressure core at the center of the free surface after the first cycle; the high pressure core subsequently converts to a high velocity core in the second cycle of the signal. Then the high velocity core completes formation+"escape velocity" after the second cycle. The size of the core is not limited by the diameter of the nozzle since the mechanism of the drop formation does not rely on the viscous effects at the walls. In fact, the size of the drop is directly dependent on the "dimensionless viscous length" of the liquid (refer to FIG. 12), indicating that this dynamics of drop formation is a local phenomenon that is independent of the boundary conditions imposed by the wall. This is the reason why a "super small" drop can be formed from a nozzle of relatively large radius, and the fact that the radius of drop is much smaller than the radius of the nozzle is the uniqueness of this invention.

Various embodiments of the present invention pertain to apparatus and methods in which the frequency is determined through a sweep of the parametric space and depends on Ohnesorge no. and the Weber number, which is related to the strength of the exciting signal. With the same Weber number and other conditions and with different frequency, it has been discovered that the drop can not be formed when the frequency is either too big or too small. The frequency needs to be in a window in the parametric space for the formation of a drop with very small volume. This small window for frequency is determined, for one embodiment to be between 15 and 35 when Ohnesorge number is 0.05; and between 25 and 40 when Ohnesorge number is 0.1. However, these are provided as examples only, and other embodiments contemplate other ranges.

One embodiment of the present invention is a method for producing ultra-small drops, i.e. drops of very small volumes, using drop-on-demand (DOD) nozzles. The method is not restricted to a particular type of DOD technology and can be used with both piezo and thermal (bubble jet) nozzles, or print heads, among others. The former are used by Epson and many manufacturers of arrayers and the latter are used by HP, Canon, and Lexmark, and others.

This document describes the use of numerical simulation to advance the mechanistic understanding of the formation of drops whose radius is smaller than the radius of nozzle where drops are formed on the one hand and to develop insights into the effects of the governing dimensionless groups on the underlying dynamics on the other hand. Based on the understandings of DOD drop formation from a one cycle control signal, a multi-cycle waveforms is chosen in simulations as drive signals to generate the small drops from a PZT DOD nozzle.

FIG. 1(*a*) is a schematic representation of a system 20 for producing drops from a DOD dispenser and taking photographs of those drops as they emanate from the dispenser ejection orifice.

System 20 includes a piezoelectric drop-on-demand dispenser 25 which is actuatable in response to the receipt of an electrical control signal 37 from piezoelectric driver 40. The DOD dispenser is a "squeeze-mode" dispenser manufactured by Packard Biosystems. Piezoelectric driver 40 is an A.A. Labs model A-303 high voltage amplifier capable of producing voltage levels up to about .±0.200 volts at slew rates greater than 200 volts/microsecond.

Piezoelectric driver 40 produces control signal 37 in response to input signal 42 from function generator 45. Function generator 45 is an HP33120 A synthesized function generator with built-in arbitrary waveform capability, including the capability of producing 15 MHz output signals.

Function generator 45 is triggered to produce output signal 42 in response to trigger signal 47 from camera/sequencer 50. Camera/sequencer 50 is a Cordin 220-8 ultra high-speed digital camera capable of recording 8 separate frames at a frame rate of 100 million frames per second. Camera/sequencer 50 also includes an on-board sequencer which can trigger up to 16 external events with TTL signals. A visual image is provided to camera/sequencer 50 by a Questar QM100 lens, which is a long distance microscope with optical resolution of 1.1 micrometers at a distance of 15 centimeters. Camera/sequencer 50 also provided a trigger signal 48 to a photo flash 60 for illumination of the drop 30 ejected by dispenser 25.

FIG. 1(*b*) is a cross-sectional view of DOD dispenser 25. Dispenser 25 includes a glass body 27 defining an internal capillary passageway 29. Passageway 29 contains a reservoir of fluid 31 to be ejected. Drops of fluid are ejected from the ejection orifice 33. A fluid meniscus 34 forms within passageway 29. A cylindrical piezoelectric element 35 surrounds a portion of the outer diameter of body 27. Upon receipt of a control signal 37, piezoelectric element 35 can be actuated to expand and enlarge the inner diameter of passageway 29 so as to move fluid near ejection orifice 33 in a direction away from the orifice and into the passageway, or generally in the upward direction for the dispenser as shown in FIG. 2. Further, upon receipt of a control signal of the opposite polarity, piezoelectric element 35 squeezes body 27 so as to contract and reduce the inner diameter of passageway 29, with the resultant propelling of fluid 31 toward orifice 33, or in the downward direction as shown in FIG. 1(*b*). Although a "squeeze-mode" DOD dispenser has been shown and described, various embodiments of the present invention are equally applicable to "roof shooter" and "side shooter" configurations of DOD dispensers, as well as to non-piezoelectric dispensers.

The voltage waveform used to drive the transducer in some DOD applications is a square wave, as shown in FIG. 1(*c*) This square wave, here called waveform 1, has amplitude V1 and width $t_1$. In a real system neither the rise (fall) time of the wave nor the response time of the transducer is instantaneous. Therefore, the force generated due to the displacement of the transducer is applied to the liquid in the tube over a small but finite time of duration $t_p$, here called the process time. Thus, the rising and falling edges correspond to positive and negative pressure pulses with amplitudes $\tilde{p}+$ and $\tilde{p}-$ measured relative to ambient pressure and of duration $t_p$, that are applied to the liquid upstream of the nozzle exit, as shown in FIG. 1(*d*). The amplitudes $\tilde{p}\pm$ scale with the rate at which the voltage is ramped, viz. $|\tilde{p}\pm \propto V_1/t_p$. Here, $t_p$ is; ~1 μs and $t_1$ is on the order of tens of microseconds. While simple, using waveform 1 can lead to satellite production, require meniscus conditioning, and result in asymmetric drop formation—which can cause the drop to miss its target—with even moderately viscous liquids.

The liquids discussed herein are Newtonian and their motion is governed by the incompressible Navier-tokes (N-S) equations. Here, the radius of the orifice, R, and the capillary time, $t_c=\sqrt{\rho R^3/\sigma}$, where ρ and σ are the density and surface tension, are used as characteristic length and time scales to nondimensionalize the N-S and continuity equations, and the governing boundary and initial conditions. Capillary times for water/glycerol mixtures emanating from a nozzle of radius R=35 μm are approximately 25 μs. Several dimensionless groups result from this nondimensionalization. These are the Ohnesorge number, $Oh=/\sqrt{\rho R\sigma}$, where μ is the viscosity, the Bond number, $G=\rho R^2 g/\sigma$, where g is the gravitational acceleration, the dimensionless amplitude of the applied pressure pulse, $p\pm\tilde{p}t_c/\mu$, and the dimensionless counterparts of the duration of the pressure pulse, $t_p/t_c$, and the quiescent time(s) $t_1/t_c$. Since the Bond number is very small [$O(10^{-4})$], gravitational effects are neglected. The fully 3D axisymmetric N-S system is solved using a Galerkin/finite element algorithm incorporating an elliptic mesh generation technique.

The present invention permits the use of DOD dispensers in applications requiring smaller drop resolution, and also in applications requiring ejection of high viscosity. For example, in applications such as ink-jet printing, painting, surface coating (such as for TV picture tubes and cathode ray tubes), and solder dispensing. The present invention permits dispensing of drops that are about one-half or less than the diameter of the ejecting orifice. This smaller drop size can be used to provide increased resolution of the ejected fluid onto the receiving surface.

Various embodiments of the present invention also permit ejection of high viscosity fluids that are currently not considered candidates for DOD dispensing, or are only used with large orifice DOD dispensers. For example, the present invention should be useful with DNA solutions and reagents and solvents containing nucleotide monomers, oligonucleotides, and other biologically active molecules or material. Various embodiments of the present invention permit high resolution dispensing of liquids used in combinatorial synthesis applications.

FIG. 1(*e*) shows a schematic sketch that shows some aspects of certain embodiments of this invention. The conventional approach to reduce drop volume V, and hence to produce small drops, is to reduce the radius R of the nozzle. In some embodiments of this invention, the flow rate Q imposed upstream of the nozzle exit (left) is oscillated in time, as shown on the right. The oscillatory flow rate is then cut off or stopped after about two periods. As discussed below, after one drop is formed and a short period of time is allowed to pass, the process is repeated to form a sequence of drops of identical size or volume. Moreover, with this type of control over the flow upstream of the nozzle, small drops are produced without the formation of satellite drops.

FIG. 1(*f*) shows an example of the history of the dynamics that occurs during the formation of a single drop using one embodiment of the new method. The dynamics were analyzed using a finite element algorithm that has been shown to agree with experiments and scaling theories. The calculations are carried out in terms of dimensionless groups, which are readily related to the physical properties of the drop liquid and the nozzle radius. In FIG. 1(*f*), the dimensionless groups have the following values: the Ohnesorge number (the ratio of viscous to surface tension force), Oh=0.1, the Weber number (the ratio of inertial to surface tension force), We=34, and the dimensionless frequency (product of the frequency with which the flow is oscillated and the capillary time scale), Ω=20. FIG. 1(*f*) shows a small drop at the incipience of formation when the dimensionless time t=1.137. As the drop forms, it has a dimensionless velocity of 0.7. For a nozzle of radius of R=6 μm and a liquid of density ρ=1 g/cm$^3$, viscosity μ=2 cp, and surface tension σ=50 dyne/cm, which are values that are typical for water based inks, the corresponding dimensional velocity would be about 2 m/s, which is typical of practical applications, and the capillary time is about 2 μs.

FIG. 1(*g*) compares drop volumes that would be formed using traditional ink jet technology (left), the method of Chen and Basaran (as disclosed in U.S. Pat. No. 6,599,627, incorporated herein by reference) (middle), and an approach according to one embodiment of the present invention (right). Drop volume using the traditional approach $V_1$ is roughly about the same as that of an "ideal" drop that has the same radius as the nozzle. Drop volume using the method of Chen and Basaran $V_2$ is about one tenth of this volume. Drop volume using the new method $V_3$ is about one hundredth of $V_1$. Thus, the new method reduces drop volumes by two orders of magnitude compared to common practice.

The system is an isothermal, incompressible Newtonian fluid of constant density ρ and constant viscosity μ that is contained within an axisymmetric liquid drop and the nozzle from which it is being formed, as shown in FIG. 1(*h*). In order to focus on the details of the dynamics of fine drop formation, the nozzle is taken to be a simple capillary tube of radius R having vanishingly small wall thickness. The ambient gas surrounding the drop, e.g. air, is dynamically inactive and exerts a constant pressure, which is taken to be the datum level of pressure, on the drop. The free surface $\tilde{S}(\tilde{t})$, where $\tilde{t}$ is time, separating the drop from the ambient gas has spatially uniform and temporally constant surface tension σ and is pinned to the circular edge of the capillary but is otherwise free to deform during the motion, as shown in FIG. 1(*b*). The dynamics is driven by imposing a time-dependent periodic flow rate $\tilde{Q}(\tilde{t})$ at a distance $|\tilde{z}_i|$ upstream the nozzle exit. It is found convenient to use a cylindrical coordinate system $(\tilde{r},\tilde{\theta},\tilde{z})$, where $\tilde{r}$,$\tilde{\theta}$, and $\tilde{z}$ are the radial, azimuthal, and axial coordinates, which is based at the center of the exit plane of the capillary. Since the dynamics is axisymmetric, the problem is independent of θ.

In this document, the following characteristic scales are used for non-dimensionalization: for length, $l_c$=R, for time, $t_c=\sqrt{\rho R^3/\sigma}$, which is the capillary time, and for stress, $\tau=\mu/t_c$. Here and in what follows, unless it is otherwise specified, all quantities denoted with a tilde are the dimensional counterparts of those without a tilde.

Transient flow of the liquid inside a drop is governed by the dimensionless continuity and Navier-Stokes equations $$\nabla \cdot v = 0, \tag{1}$$

$$\frac{\partial v}{\partial t} + v \cdot \nabla v = Oh \nabla \cdot T. \tag{2}$$

Here v is the velocity vector, $Oh \equiv \mu/\sqrt{\rho R \sigma}$ _ is the Ohnesorge number, which measures the viscous force relative to surface tension force, and $T=-\rho I=+[\nabla V+(\nabla V)^T]$ is the total stress tensor for a Newtonian fluid, where I is the identity tensor and ρ is the pressure. The Navier-Stokes equations do not include body forces due to gravity because gravitational force is negligible compared to surface tension force in small-scale flows such as ink jet printing.

The kinematic and the traction boundary conditions apply along the free surface S(t):

$$n_s \cdot (v - v_s) = 0, \tag{3}$$

$$Oh(n_s \cdot T) = (2H) n_s, \tag{4}$$

where $n_s$ denotes the outward pointing unit normal vector to, 2H is twice the local mean curvature of, and $v_s$ stands for the velocity of points on the free surface S(t). Due to axial symmetry, at the drop tip the drop shape must obey $$t_s \cdot e_z = 0 \text{ at } r=0,\ z=L(t) \text{ on } S(t). \tag{5}$$

Figure 1B:
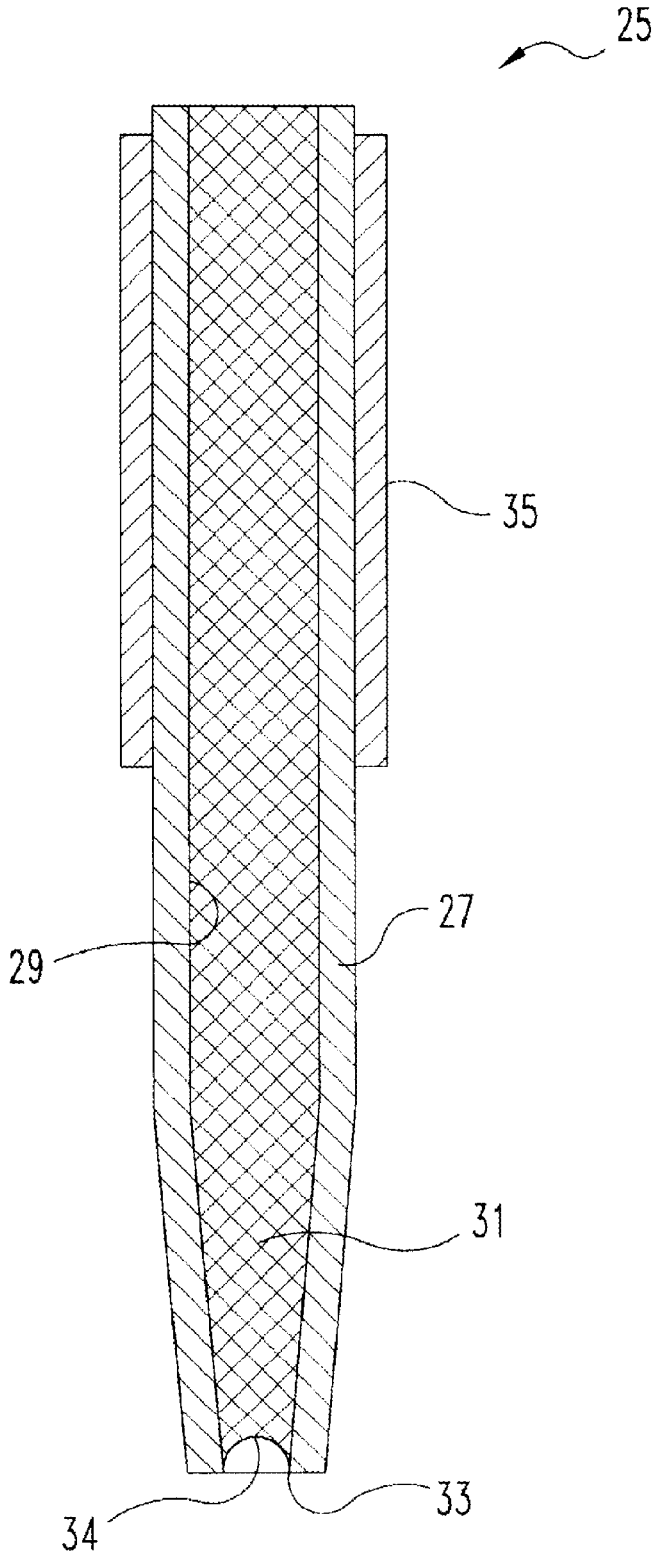
Figure 1D:
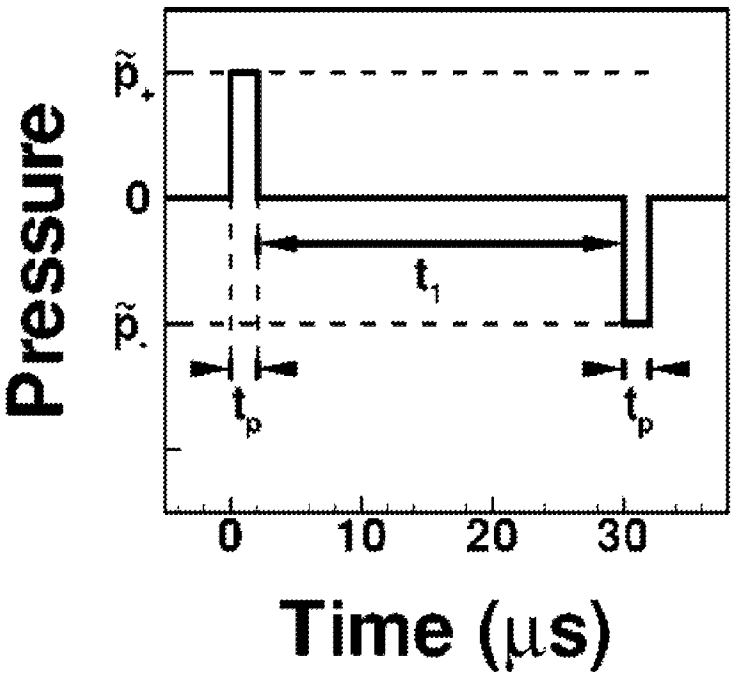
Figure 1C:
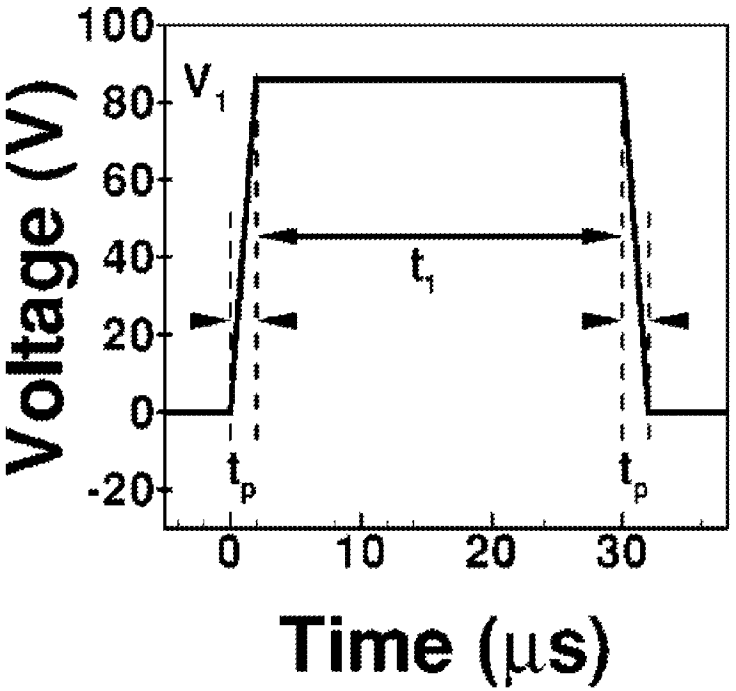
Figure 1E:
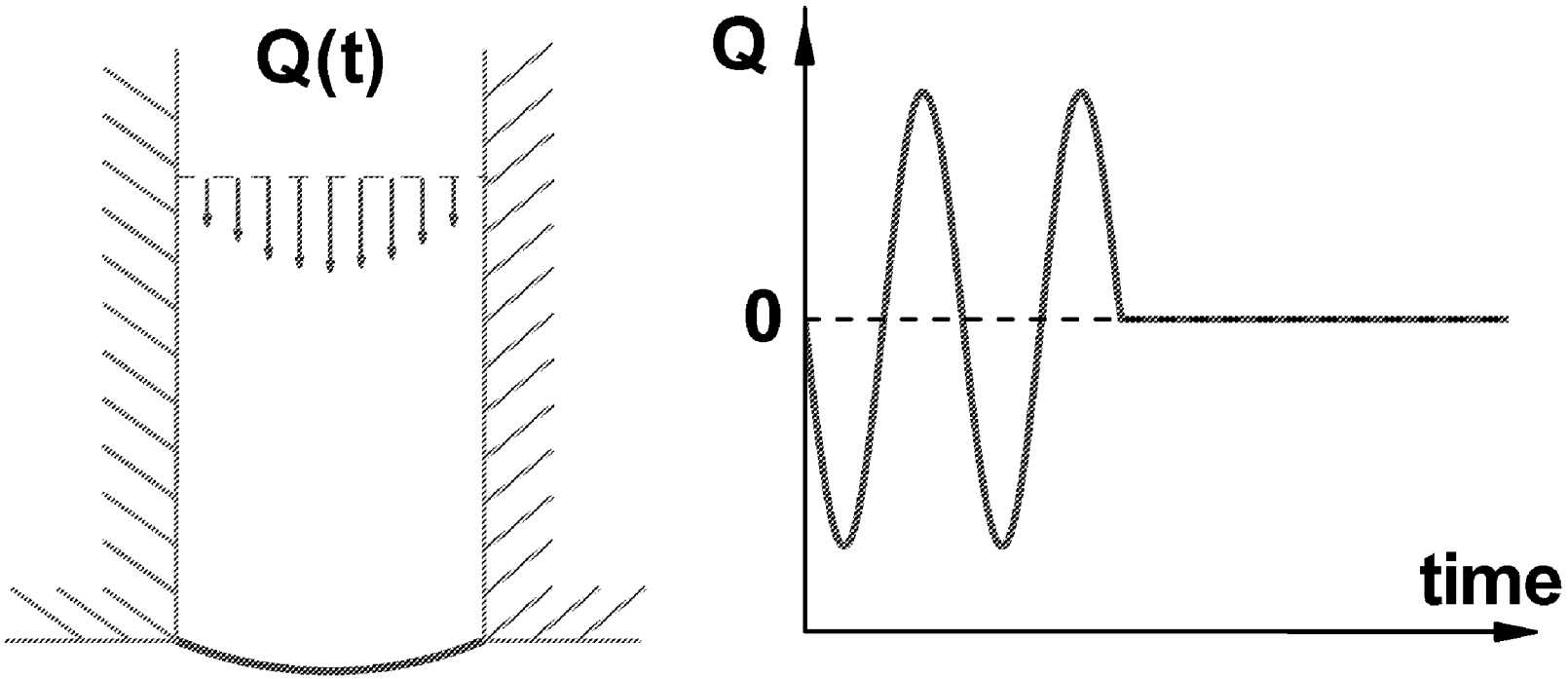
Figure 1F:
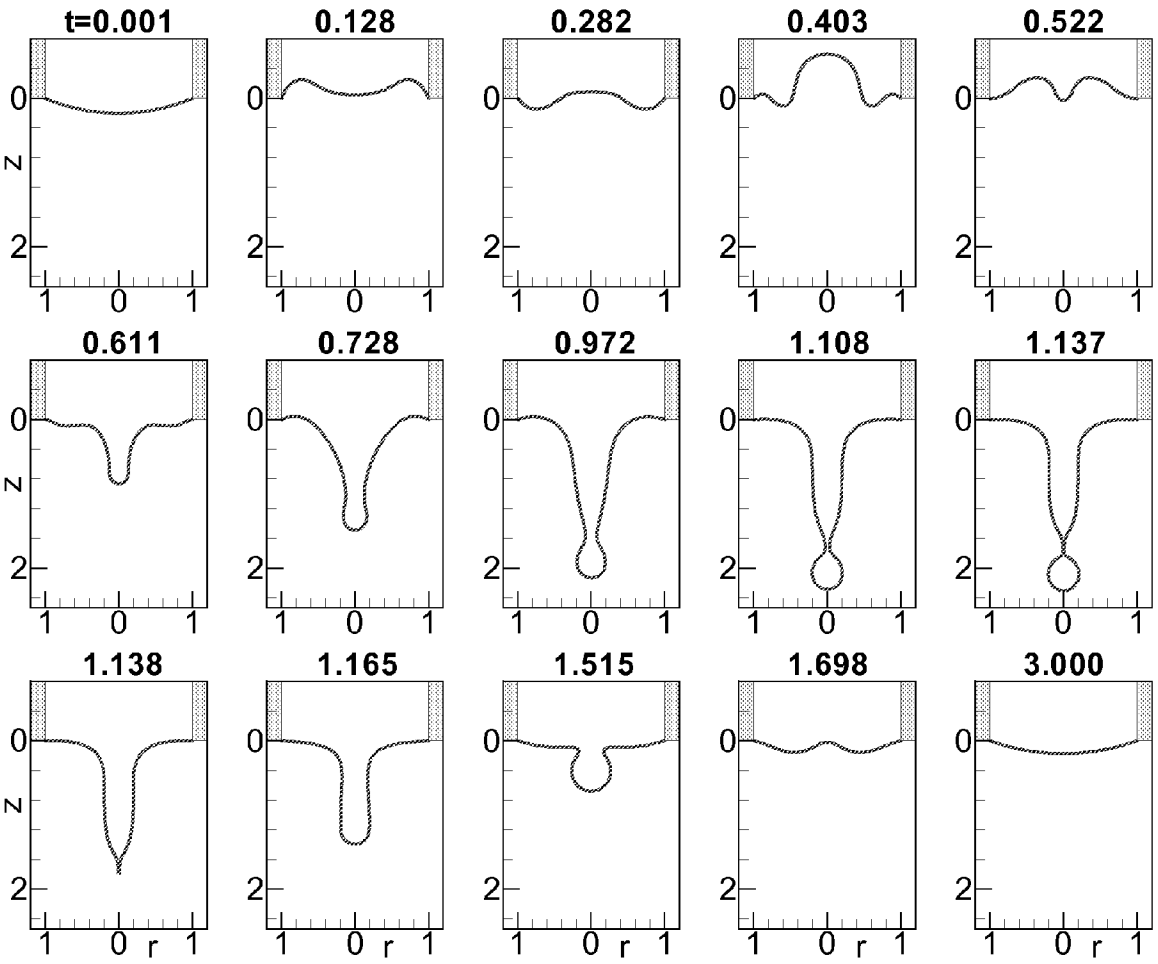
Figure 1G:
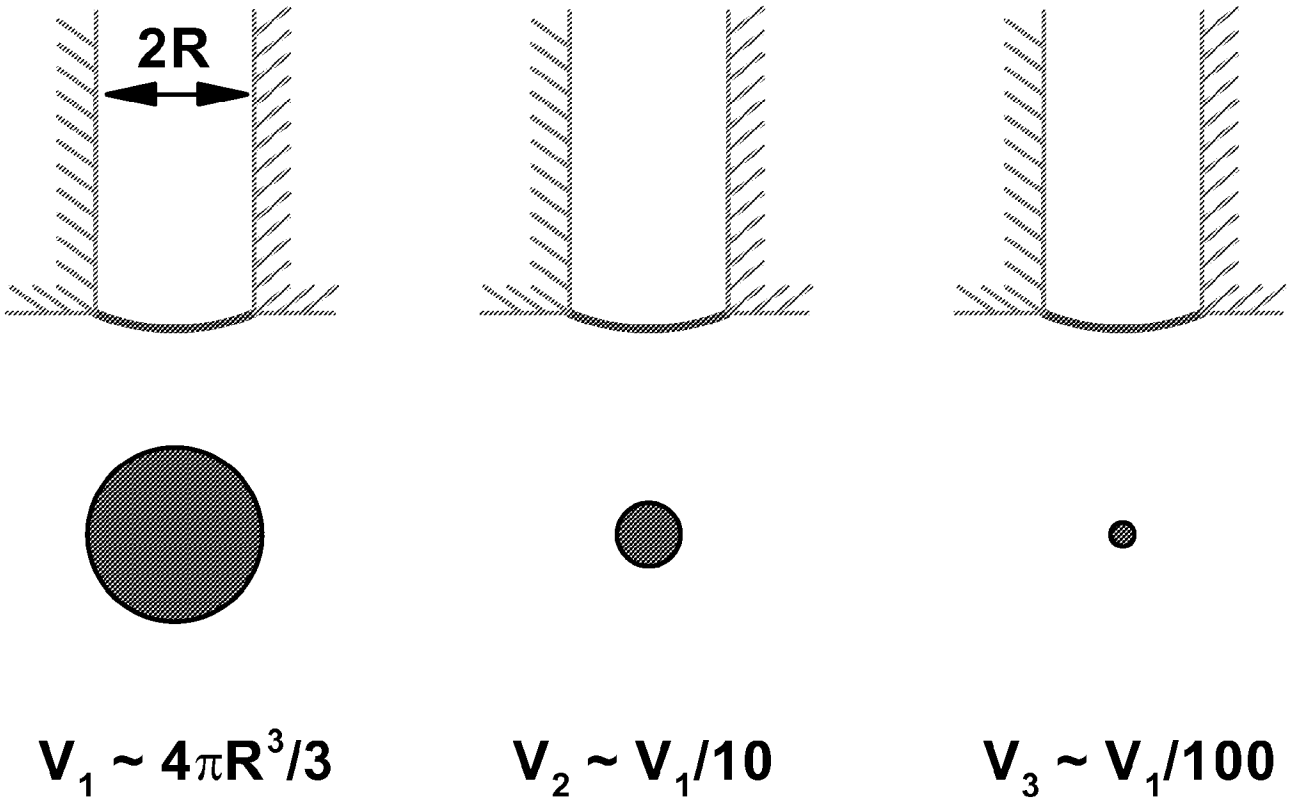
Figure 1H:
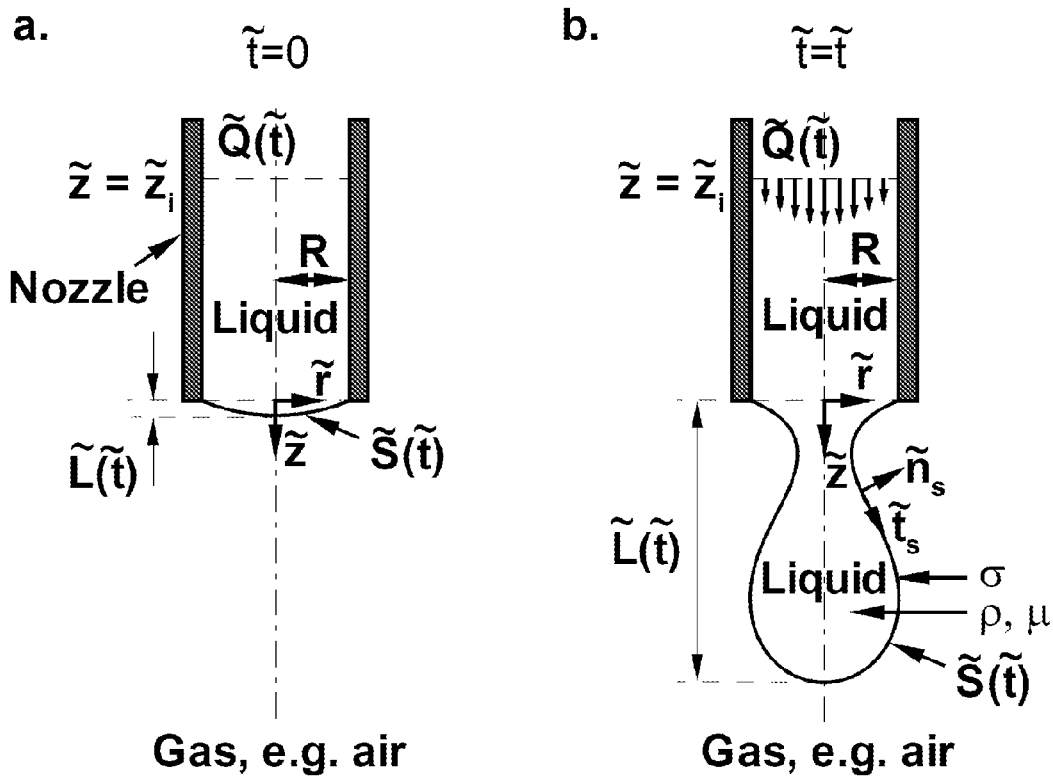
Figure 1I:
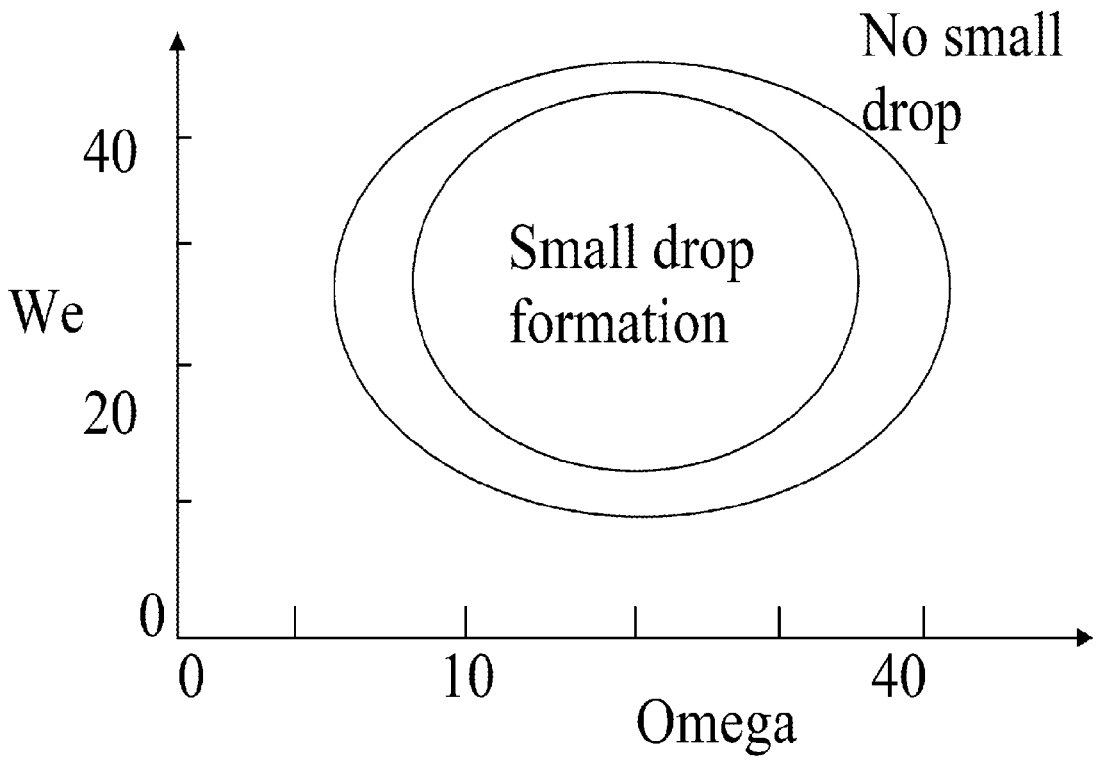
Figure 2:
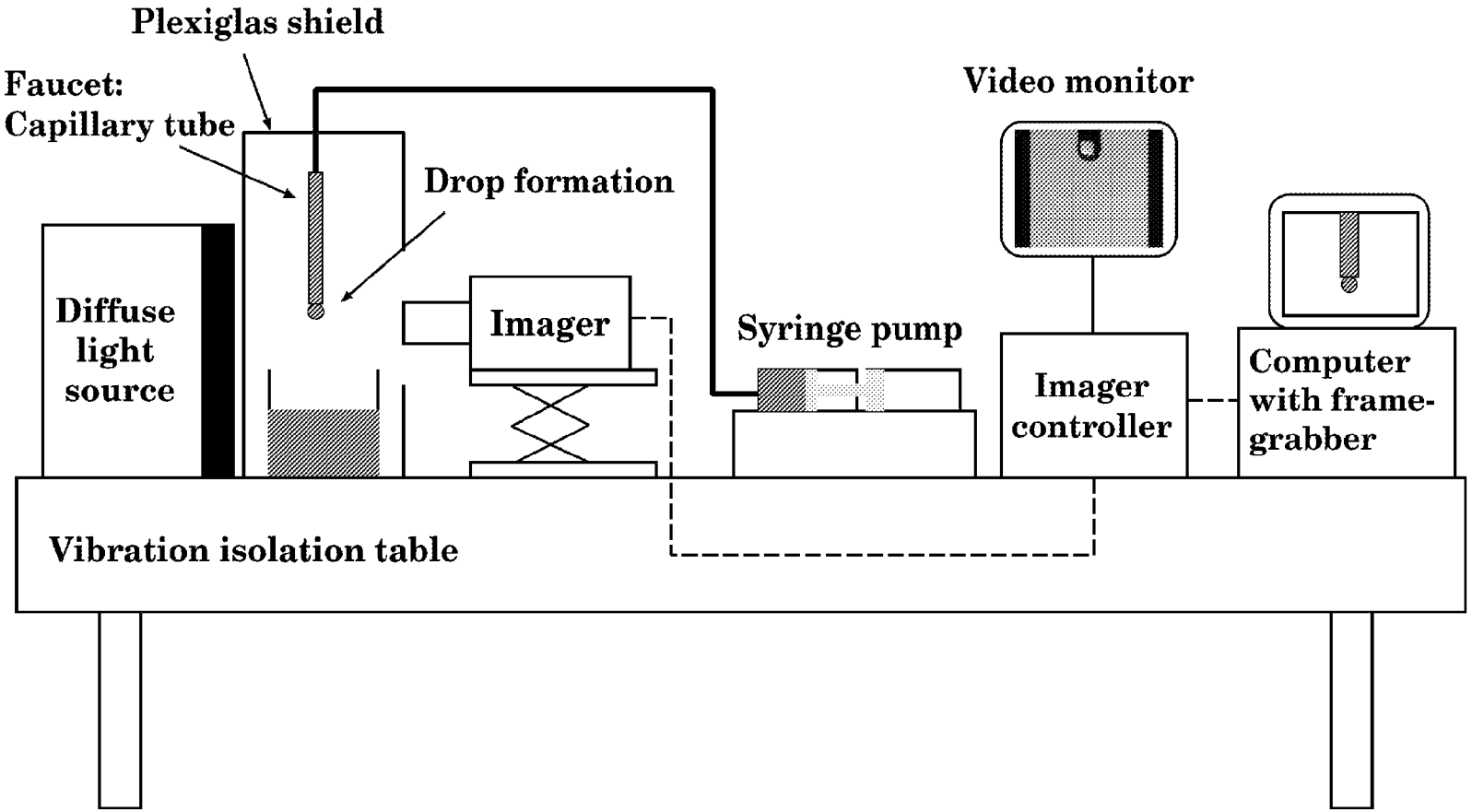
FIG. 2: A schematic of an experimental set up used to verify a computational model.

Here $e_z$ is unit vector in the z-direction and L(t) is the instantaneous length of the drop (cf. FIG. 1*b*). In addition, the radial component of the velocity and the shear stress must vanish along the axis of symmetry r=0:

$$n' \cdot v = 0, \tag{6}$$

$$n' \cdot T \cdot t' = 0. \tag{7}$$

Here n' and t' stand for the unit normal and tangent vectors to the axis of symmetry.

A time-periodic Hagen-Poiseuille flow boundary condition is imposed at an axial location $z=z_i$ upstream of the capillary outlet:

$$\upsilon_r = 0, \upsilon_z = -(1-r^2)\sqrt{We}\sin \Omega t \text{ at } z = z_i \text{ for } 0 \leqq r \leqq 1. \tag{8}$$

Here $\upsilon_r$ and $\upsilon_z$ are the radial and the axial components of the velocity, $\Omega$ is the temporal frequency of the imposed flow rate, and $We \equiv \rho \tilde{Q}_m^2/(\pi^2 \sigma R^3)$, where $\tilde{Q}_m$ is the amplitude or the maximum value of the imposed flow rate. Thus, the instantaneous flow rate at the inflow boundary is given by $Q(t) = -(\pi\sqrt{We}/2)\sin \Omega t$. When the flow at the inflow boundary is toward (away) the capillary outlet, it is taken that $Q \geqq 0$ ($Q \leqq 0$) and the terminology of positive (negative) inflow is adopted to refer to such situation. The volume of fluid that has crossed the inflow boundary varies in time as $(1-\cos \Omega t)\pi\sqrt{We}/(2\Omega)$. The maximum volume of fluid added to the system is therefore given by $\Delta V \equiv \pi\sqrt{We}/\Omega$, which is henceforward referred to as the maximum injected volume.

The three-phase contact line is constrained to remain fixed to the sharp edge of the capillary exit:

$$r = 1 \text{ at } z = 0. \tag{9}$$

The fluid obeys conditions of no slip and no penetration along the capillary inner wall:

$$v = 0 \text{ at } r = 1 \text{ for } z_i \leqq z \leqq 0. \tag{10}$$

The mathematical statement of the problem is completed by specification of the initial conditions. For all of the computational results presented in this document, the fluid is quiescent and the pressure is uniform throughout the fluid at t=0:

$$v(x,0) = 0,\ p(x,0) = \text{constant}. \tag{11}$$

Here x denotes the position vector of points in the fluid.

The initial drop shape is taken to be a section of a sphere of dimensional radius D with its center at $\tilde{z} = \beta$ (cf. FIG. 1*a*). The initial drop volume V0 can thus be conveniently characterized by the drop volume parameter $\alpha \equiv \beta/D$ such that $$V_0 = \frac{\tilde{V}_0}{R^3} = \frac{\pi}{3}\frac{(1+\alpha)^2(2-\alpha)}{(1-\alpha^2)^{3/2}} \tag{12}$$

The volume of drops formed from drop-on-demand devices decreases with the initial drop volume, and the initial drop shapes in this study are preferably meticulously controlled in order to produce small drops. Without losing the generality, it is employed that $\alpha = -0.8$ so that $V_0 = 0.318$ unless otherwise specified.

Therefore, the dynamics are governed by four dimensionless groups: the Ohnesorge number Oh, the Weber number We, the frequency $\Omega$ and the drop size parameter $\alpha$.

Experiments are carried out to check the accuracy of computational algorithms. The experimental apparatus consists of a capillary tube through which pure diethylene glycol is made to flow at a constant flow rate by means of a syringe pump and from the tip of which a liquid drop is formed, as shown in FIG. 2. It also includes a high-speed video camera for imaging the dynamics drop shapes, the associated hardware and software for recording, storing, and analyzing the drop shape data, and a light source used in conjunction with the camera to produce silhouette images of the drop.

The liquid is delivered to the capillary using an Orion Sage Model M361 syringe pump. The stainless steel capillary tube is 10.16 cm in length and is produced from Vici Valco Instruments Co., Inc. The outer diameter of the tube is virtually constant over its entire length and the thickness of its wall is less than five percents of its diameter. The imaging system is a Kodak Motion Corder Analyzer SR Ultra that is capable of recording up to 12000 frames per second. The images are stored in digital form in the image processor with a memory capacity of 2200 frames. A Sony Trinitron Color Video Monitor, model PVM-1351Q, is used to view the images of the drop formation process. A Dolan-Jenner light plate, model QV ABL, connected by a fiberoptic cable to a Dolan-Jenner Fiber Lite, model 3100, is used to backlight the drop. Backlight intensity, along with lens aperture setting, and the camera exposure rate are adjusted to produce sharp images of the drops as they grow and subsequently detach from the capillary. The recorded images on the digital processor are downloaded to a Dell Pentium personal computer (PC).

The experimental procedure is first to draw the liquid into the syringe, which is fixed on to the syringe pump. The pump is then started and run at a high flow rate to cleanse the capillary and the tubing connecting the syringe to the capillary. A desired flow rate is then set and images of the forming drops are recorded on to the image processor. The images are subsequently downloaded on to the PC for further analysis of the shapes.

Figure 3:
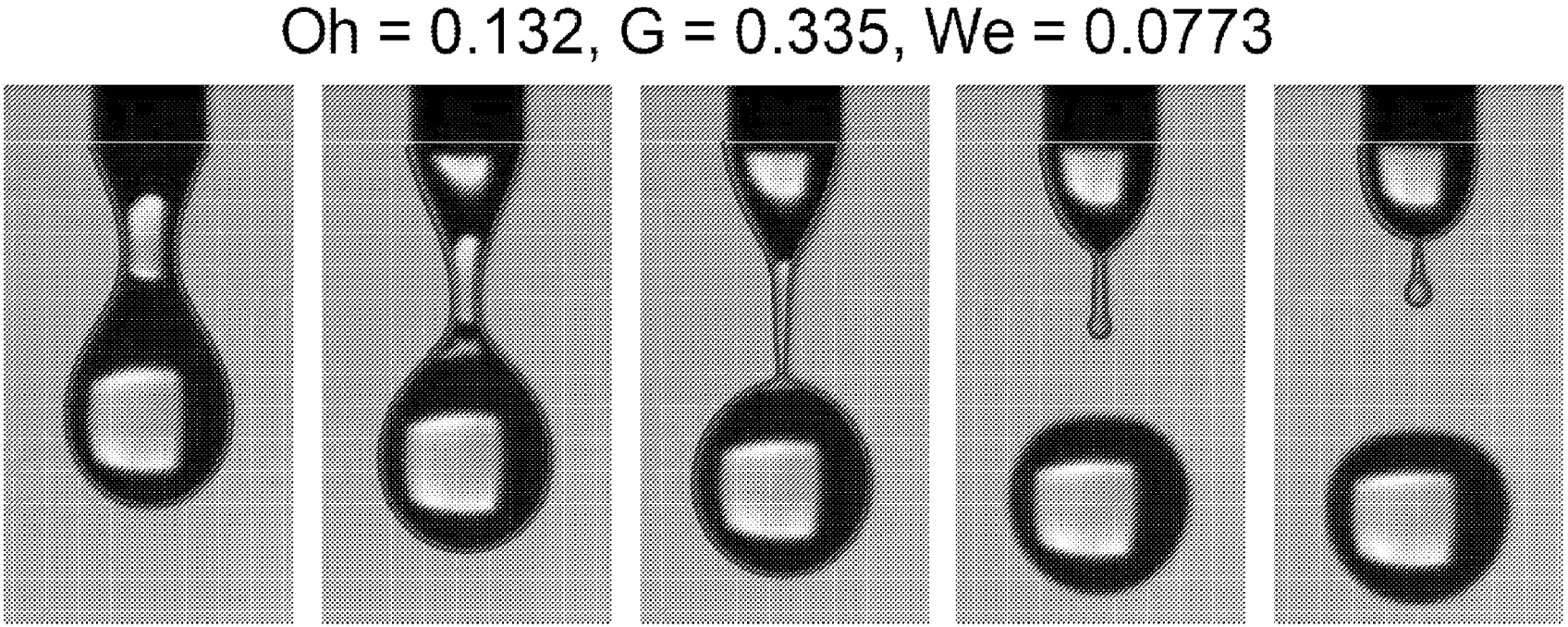
FIG. 3: Computed drop shapes, red solid curves, overlaid on experimentally recorded images of identical drops of pure diethylene glycol at the incipience of breakup. Here We=0.0773, G=0.335, Oh=0.132.

The transient system of equations (1) and (2) subject to boundary conditions (3)-(10) and initial conditions (11) and (12) is solved using the method of lines with the Galerkin/finite element method (G/FEM) for spatial discretization and an adaptive finite difference method for time integration. A key element in the G/FEM formulation is implementation of an elliptic mesh generation algorithm for adaptively discretizing the interior of the flow domain that undergoes large changes during the formation of an ink jet drop. The numerical algorithm used here is based on ones that have been well benchmarked against scaling theories and experiments. FIG. 3 shows such an example when the computed drop shapes are overlaid on experimentally recorded drop images that are obtained using the aforementioned experimental apparatus.

Figure 4:
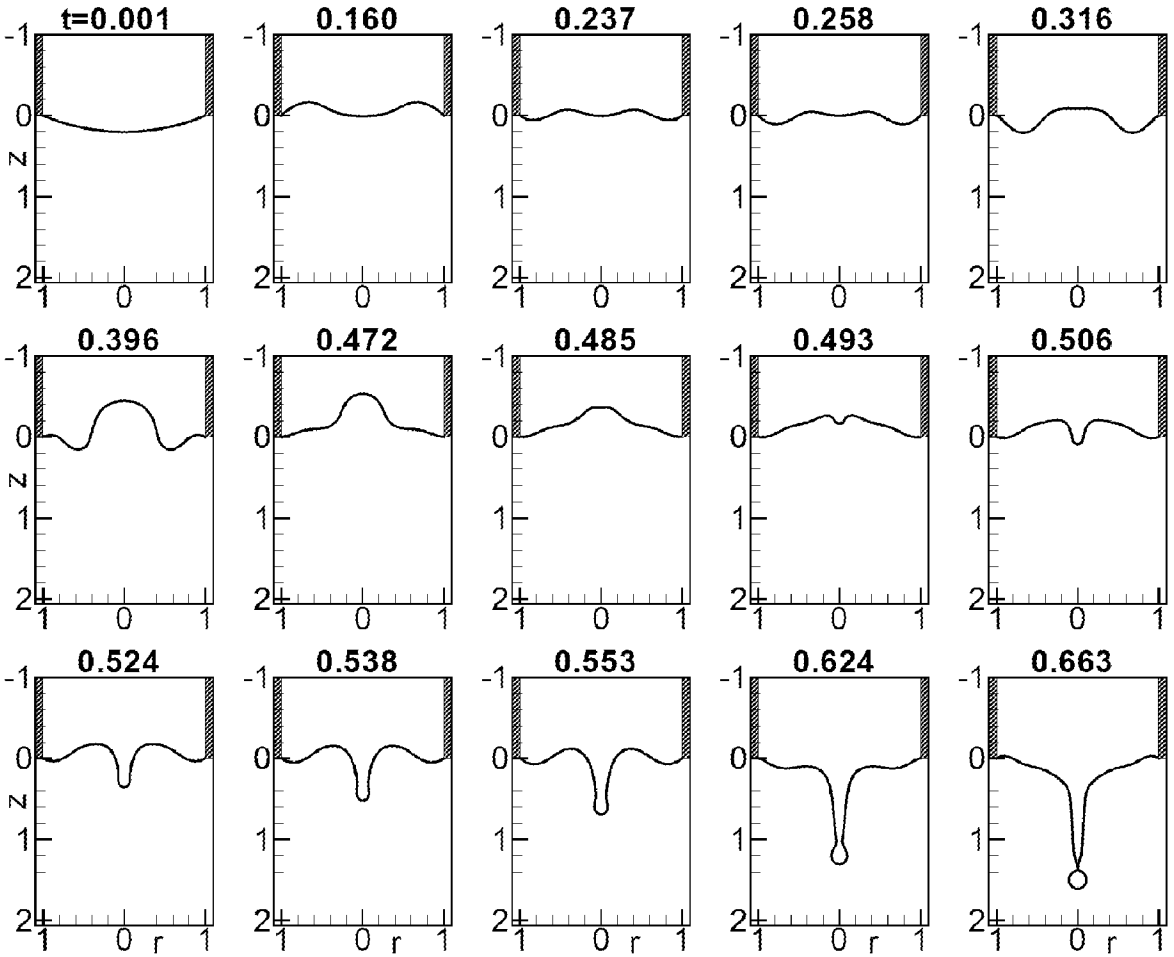
FIG. 4: Evolution in time of the shape profiles of a drop when Ω=20, We=16.43, and Oh=0.05.

FIG. 4 shows the evolution in time of the shape profiles of a drop with $\Omega = 20$, We=16.43, and Oh=0.05 for a small drop formation. The five frames in the top row show the development of a surface capillary wave during the first oscillation period; the five frames in the middle row show the focusing of the surface capillary wave and initiation of a liquid jet at the center of capillary; the five frames in the bottom row show the growth of the liquid jet and the formation of a small drop at the tip of the liquid jet. The volume of the small drop is 0.0049, about one thousandth of the volume of a theoretical drop of the radius of the capillary.

Here the maximum injected volume $\Delta V \equiv \pi/\sqrt{We}/\Omega = 0.636$. The parameters are chosen so that the maximum injected volume is small to encourage small drop formation, which indeed occurs in this case. The first five frames in FIG. 4 make clear that in the early time of the process a circular surface wave is developed near the capillary wall from where it propagates radially toward the capillary center. The circular surface wave converges at the capillary center, which is followed by an initiation of liquid jet, as shown by the five frames in the middle row of FIG. 4. The liquid jet grows longer in time and eventually breaks up near the tip, where a small drop is formed. The volume of the small drop is only 0.0049, about one thousandth of the volume of a theoretical drop of the radius of the capillary. In addition, FIG. 4 shows that the valley of the circular surface wave is formed when the liquid is drawn into the capillary by the negative inflow and the peak of the circular surface wave is formed when the liquid is pushed out by the positive inflow. Therefore, the generation frequency of the circular surface wave is roughly the same as that of the inflow oscillation.

Figure 5:
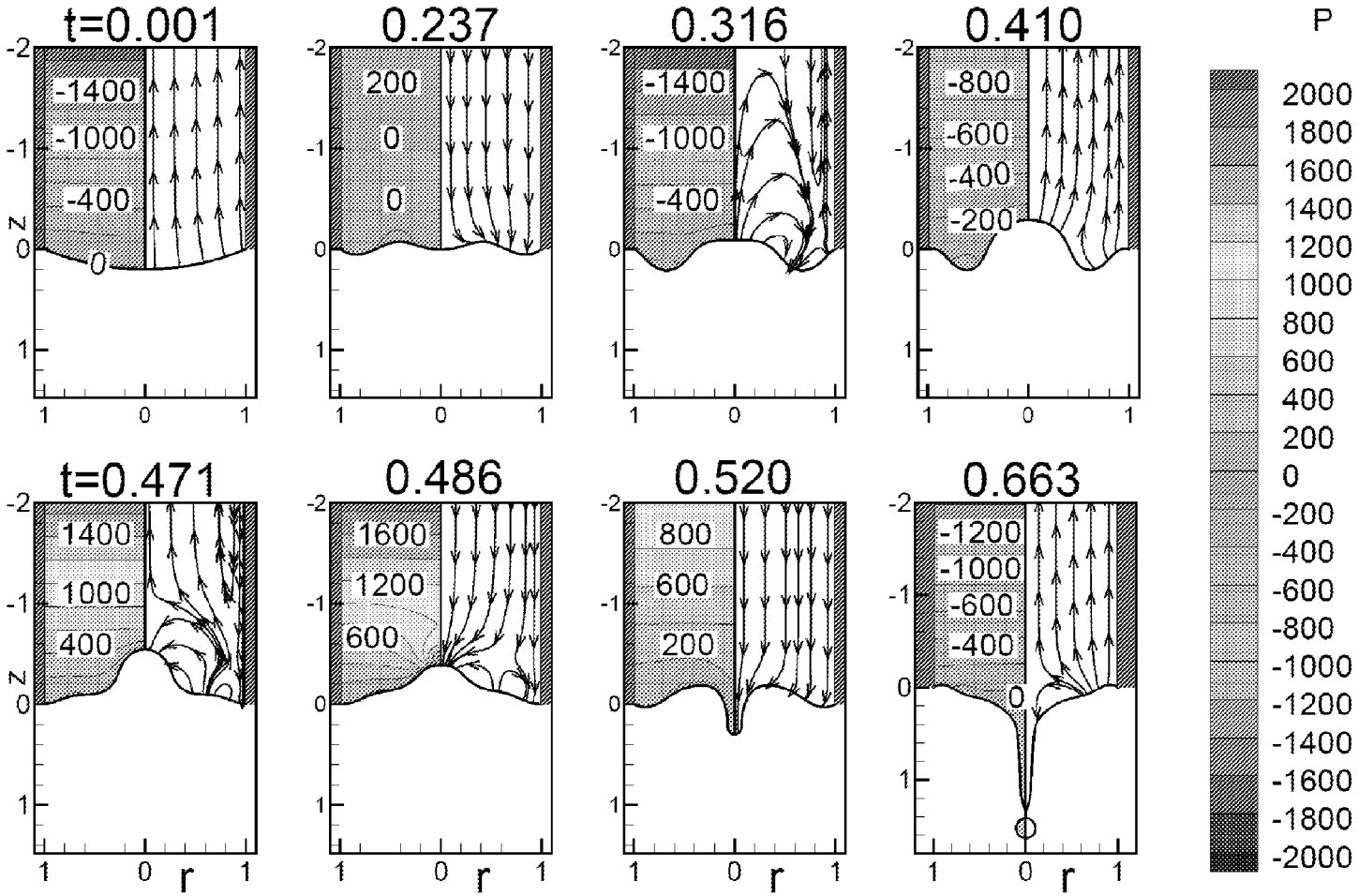
FIG. 5: Evolution in time of the pressure contours and streamlines of the small drop formation in FIG. 4 when Ω=20, We=16.43, and Oh=0.05.

However, the movement of circular surface wave is insufficient to explain the formation of liquid jet, which leads to the formation of a tiny drop. The transition from the focus of surface wave at the capillary center to the liquid jetting entails not only dramatic distortion of the free surface profile but also a sharp change of flow direction from horizontal to vertical. FIG. 5 shows the evolution in time of the pressure contours and streamlines of the small drop formation process. Pressure contours are plotted in the left half and streamlines are in the right half of the drop in each frame. The pressure contour legend on the right applies to all time instants.

Figure 6:
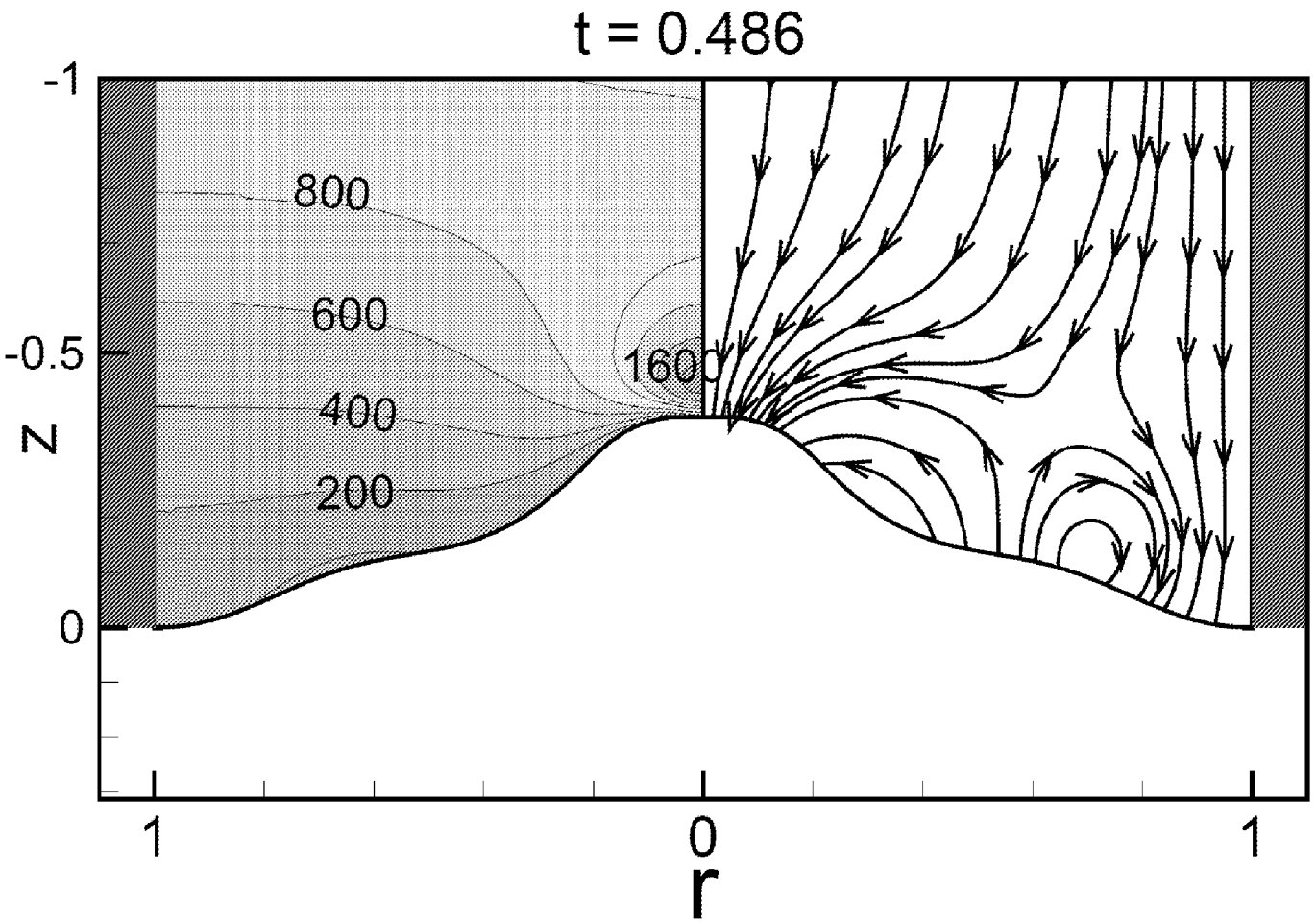
FIG. 6: A blowup of the drop shape emphasizing the high pressure region at the center of the drop meniscus at t=0.486.

It is shown that the inflow is negative when the valley of the circular surface wave focuses at the capillary center at t=0.410 in FIG. 5. The free surface hence moves into the capillary at this moment due to continuity. During the converging process of the surface wave at the center, the pressure difference between the capillary wave peak and the wave valley owing to different curvatures drives liquid flow from the crest area towards the capillary center and capillary wall, as shown at t=0.471 in FIG. 5. These capillary flow that serve to flatten the free surface persist even after the inflow changes its direction from negative to positive. The positive inflow and the capillary flow from the crest area of free surface toward the wave valley meet at the center just below the free surface, generating a 'hot' high pressure region, as shown in a detailed blowup at t=0.486 in FIG. 6. This 'hot' high pressure region right below the surface at the capillary center explosively expels the small quantity of liquid right between it and the free surface, initiating a high-speed liquid jet, as shown at t=0.520 in FIG. 5. Meanwhile the viscous drag force from liquid around the liquid jetting and surface tension force from the free surface counteract this jetting process. The high speed liquid jetting process overcomes the constraints and gives rise to a small drop at t=0.663 in FIG. 5.

Figure 7:
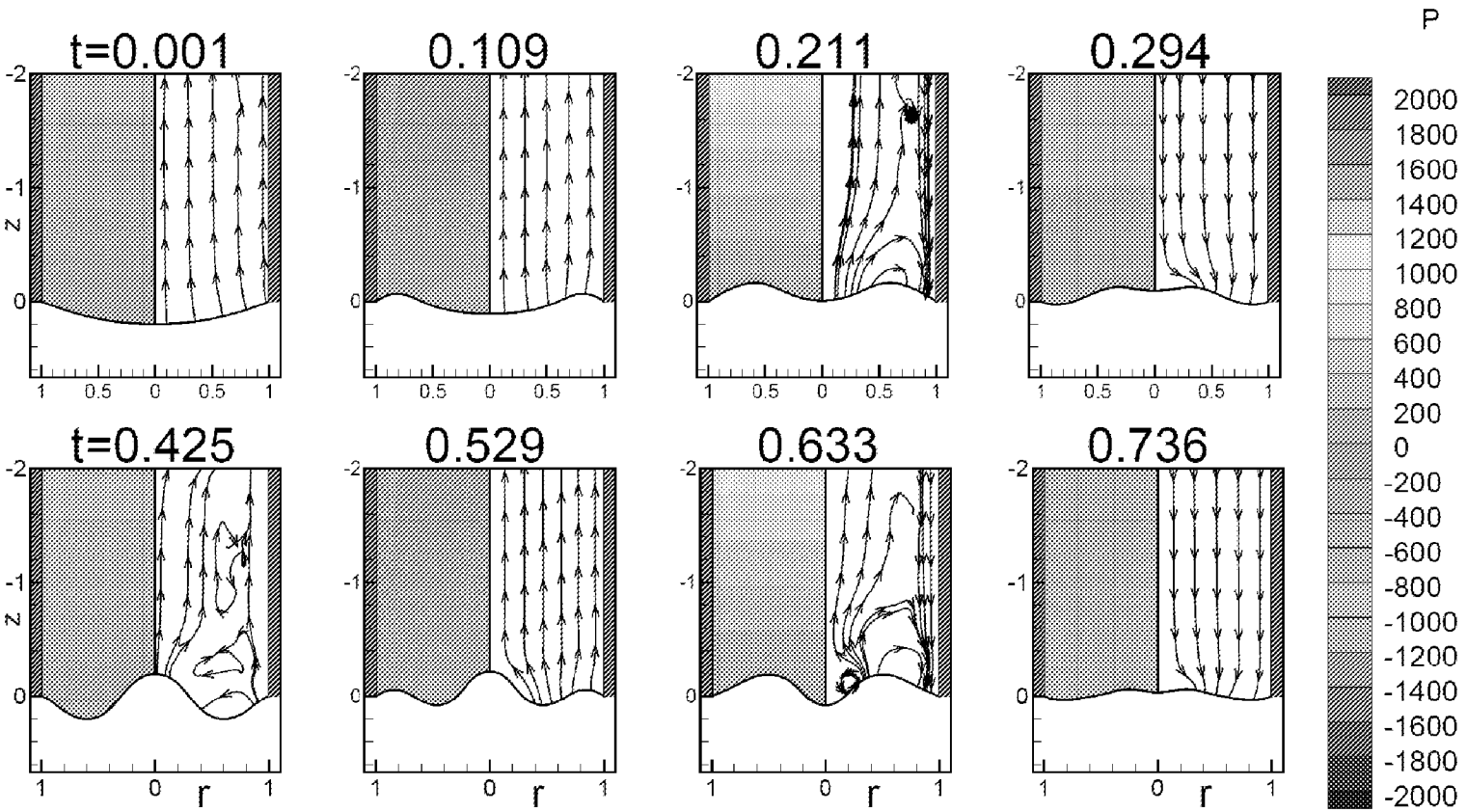
FIG. 7: Same as in FIG. 5 except that Ω=35 and We=50.315.

The above analysis makes clear the 'hot' high pressure zone to the liquid jetting and subsequent small drop formation. This high pressure region precedes and is the cause of the liquid jetting process. It originates from interplay between the circular surface wave and the oscillatory inflow, viz. whether the focusing of the surface wave at the center resonates the oscillatory inflow. It is hence expected that the liquid jetting phenomena may not occur when conditions are changed. For example, the small drop formation does not occur when the frequency of the oscillatory inflow in FIG. 5 is changed from 20 to 35, where the Weber is changed accordingly so that $\Delta V$ does not change. For the purpose of comparison, FIG. 7 shows the corresponding changes in the evolution in time of the pressure contours and streamlines when $\Omega=35$ and We=50.315. Under these parameters that no high pressure reign is formed when the valley of the circular surface wave focuses at the capillary center, as shown at t=0.425 and t=0.529 in FIG. 7.

FIG. 8 shows how the drop length, L(t), varies in time. The Weber number and Omega are varied at the same time so that the maximum injected volume for all cases equals to a constant, 0.636. The value of the Weber number is indicated besides each curve. It is understood that various embodiments of the present invention are not limited to a particular injected volume, nor to any particular values of $\Omega$, We, Oh, or $\alpha$.

When We=9.24, the drop length L(t) oscillates in time, implying no liquid jetting and small drop formation. When We=10.51 and 11.87, the drop length oscillates once before it grows monotonically until the small drop formation. This behavior reveals that double liquid jetting appears before small drop formation. It is observed that the inertial of the first liquid jet is unable to overcome viscous drag and surface tension constraints. Therefore, the liquid jet falls back to the bulk of the liquid, and the drop length L(t) virtually becomes negative in the interim between the two liquid jettings. Then the inertial of the second liquid jet is sufficient for the occurrence of pinch off and formation of the small drop. A close look at the hot pressure region in these two situations shows that the maximum pressure in the high pressure region is lower than that in the situation shown in FIG. 5 when a single liquid jetting preludes the small drop formation. When We=13.31, 14.83, and 16.43, the drop length shows no oscillation and indicates a single liquid jetting before the drop formation. This type of dynamics is similar to the one shown in FIG. 5.

Figure 9:
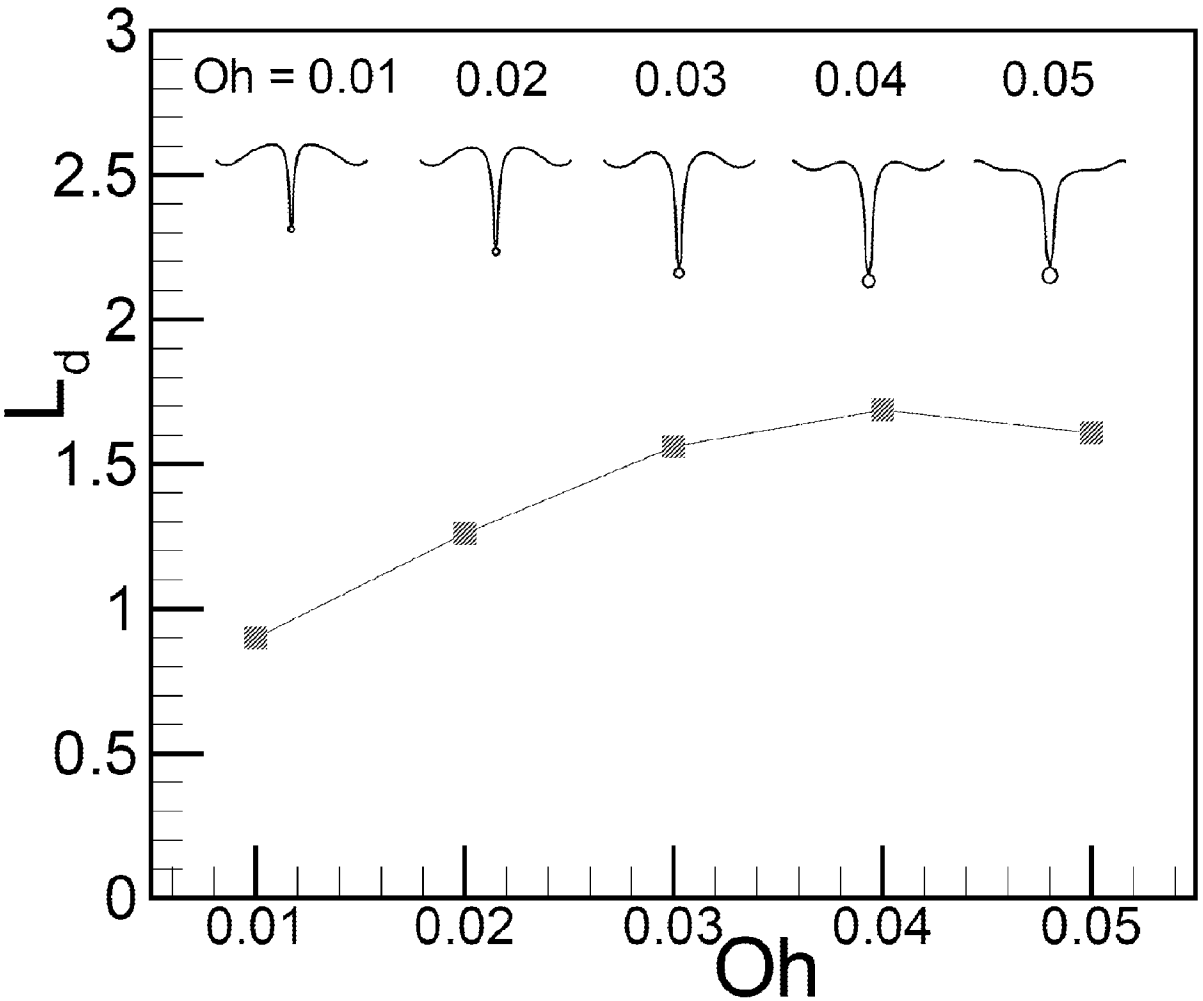
FIG. 9: variation with Oh of the length of the liquid jet at the incipience of small drop formation when Ω=20 and We=16.43.

FIG. 9 shows the variation with Oh of the length of the liquid drop at the incipience of small drop formation when $\Omega=20$ and We=16.43. Insets show the shape profiles of the free surface at the incipience of small drop formation. The value of Oh is indicated above each inset.

FIG. 9 makes clear that the length of the drop increases rapidly with Oh on account of the increase in length exhibited by the liquid jet when $0.01 \leqq Oh \leqq 0.04$, while the length of the liquid jet is shorter when Oh=0.05 than that of liquid jet when Oh=0.04. All five cases when $0.01 \leqq Oh \leqq 0.05$ fall in the single jetting small drop formation, indicating that the high pressure region ejects the liquid jet with sufficient kinetic energy to overcome the constraints of surface tension and viscous drag force. When Oh=0.06, the viscous drag force increases further and computation results show that double liquid jetting is needed for the formation of a small drop. When $Oh \geqq 0.07$, small drop formation is generally suppressed for this example, although other embodiments contemplate Oh generally less than 0.1.

At the incipience of the formation of a small drop, it is connected to the bulk liquid in the nozzle through the liquid jet. As the length of the liquid jet is usually long, it is natural to ask whether there will be a secondary pinch-off to form a secondary droplet. In real world applications, the secondary droplet is often undesirable and should be avoided. The focus then extends beyond the first breakup to explore the formation of a single small drop without the secondary pinch-off. In order to achieve this, the inflow boundary condition of simulations in this section has been changed by turning off the oscillatory inflow after two periods.

FIG. 10 shows the evolution in time of the shape profiles of a drop when $\Omega=22$, We=34, and Oh=0.1. A single small drop is formed without the formation of a secondary drop.

It is readily seen that a single small drop is formed without the formation of a secondary drop. FIG. 10 shows that after the formation of a small drop, the liquid jet recoils and merges with the bulk liquid. Because the inflow is turned off after two periods of oscillation, the oscillation of the free surface is quickly damped out due to viscous effects, as shown at t=3.000 in FIG. 10. The drop volume is 0.0428, about one hundredth of the volume of a hypothetical drop of the capillary radius. If more than one small drop is desired, the inflow can be turned on again to generate another small drop after t=3.000. By doing so, additional monodisperse drops can be made without formation of second drops.

Figure 11:
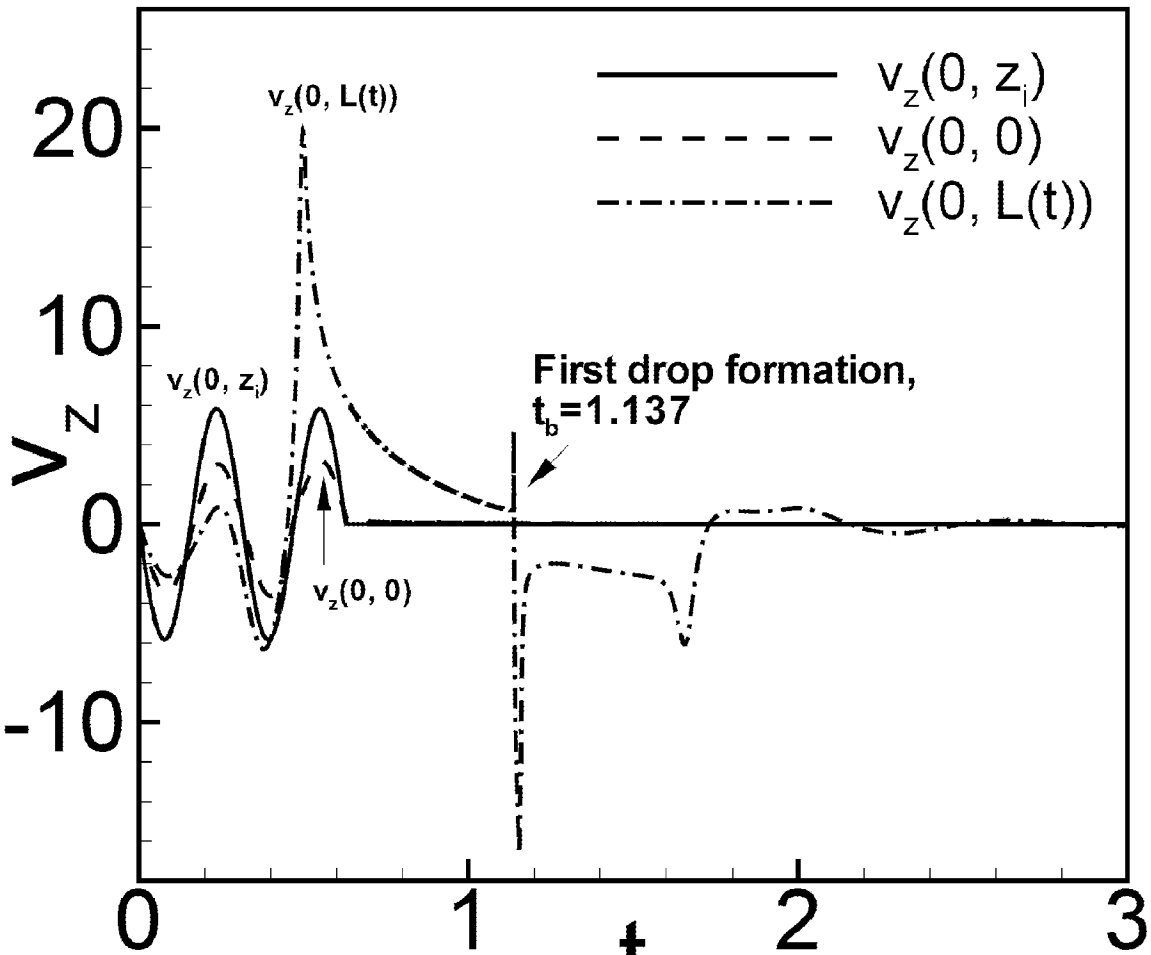
FIG. 11: Variation with time of the z-component velocities at (0, zi), solid line, (0, 0), dashed line, and (0, L(t)), dash-dotted line, for the small drop formation in FIG. 10.

FIG. 11 shows the variation with time of the z-component velocities at $(0, z_i)$, solid line, (0,0), dashed line, and (0, L(t)), dash-dotted line, for the small drop formation in FIG. 10. FIG. 11 shows that the z-component velocity at (0, L(t)), viz. the tip velocity of the liquid jet, raises sharply after the first period of oscillation, indicating the rapid ejection of a liquid jetting. The subsequent fast decrease is because the liquid jetting is slowed down by the constraints of viscous force and surface tension force. However, the kinetic energy of the liquid jetting is so large that it incurs the pinch-off of the liquid jet and forms a small drop at t=1.137. After the small drop is formed, the tip velocity of the liquid jet becomes negative, implying the recoiling of the liquid jet. It is clearly shown that the flow oscillation after first drop formation is damped out quickly.

Figure 12:
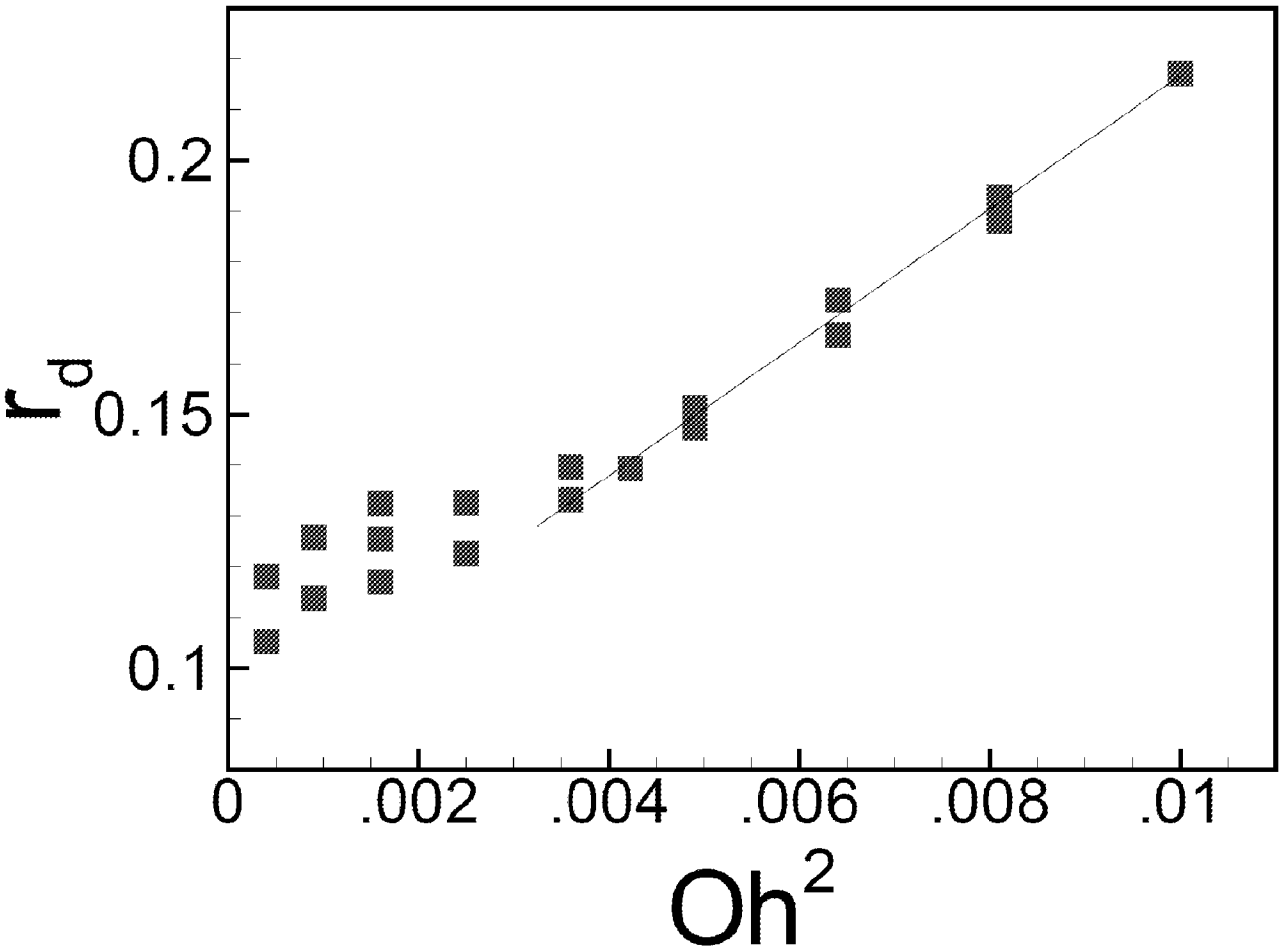
FIG. 12: Variation of drop size with Oh when Ω=20.

As one aspect of drop formation is to reduce the drop volume, it is constructive to study how the drop volume changes with liquids with different viscosity. FIG. 12 shows how the size of the drops formed from the tip of liquid jetting varies with Oh when other system parameters are held constant. Here, rd is the radius of a sphere of volume equal to that of the drop formed at pinch-off. A large number of simulations carried out in the regime where viscous force is important reveal that $r_d$ $Oh^2$, which is the dimensionless viscous length. This finding implies that the formation of small drops at the tip of the liquid jetting is a local phenomenon that does not depend on the imposed inflow boundary condition.

Figure 13:
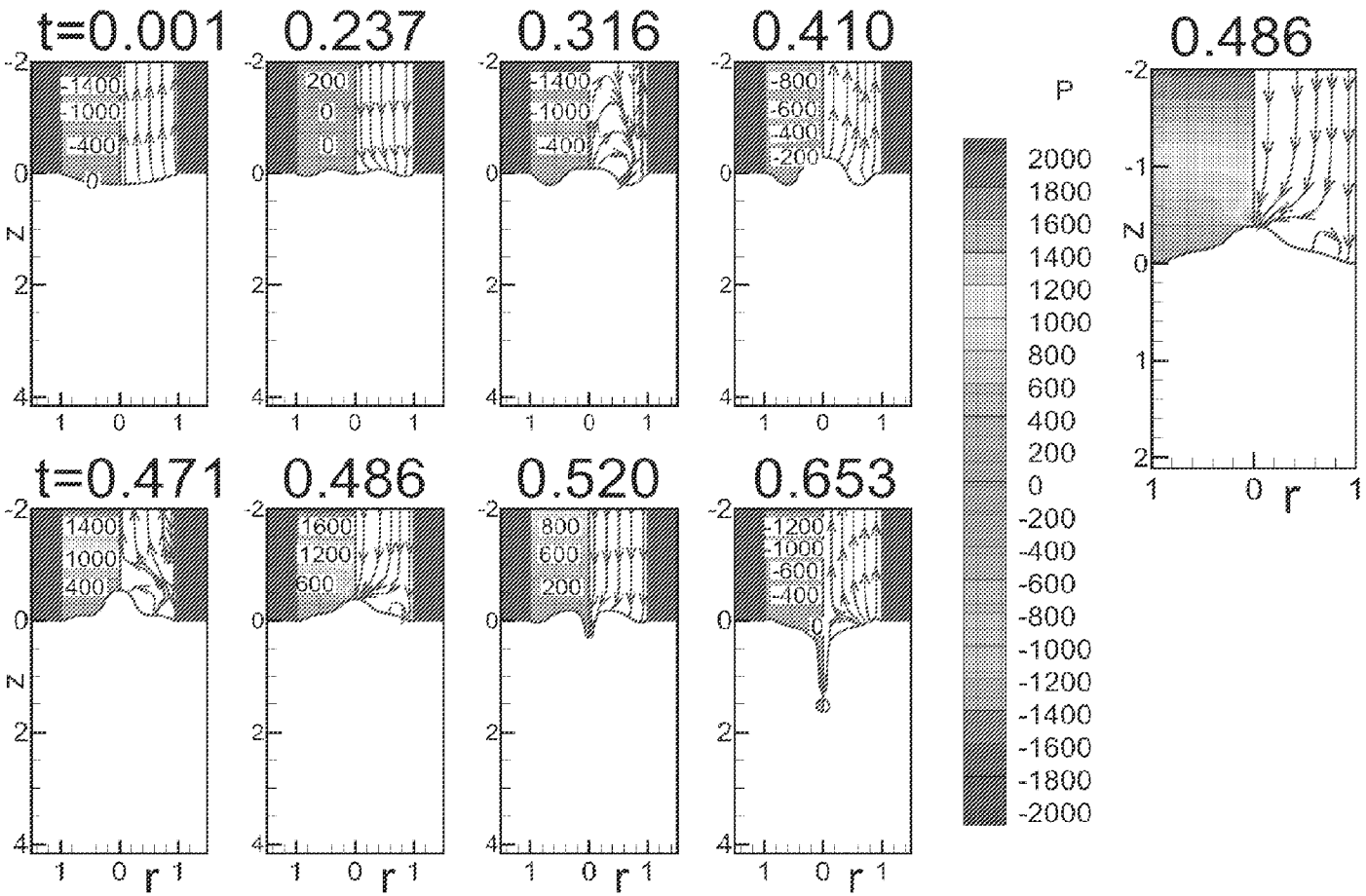
FIG. 13. Evolution in time of the pressure contours and streamlines of DOD drop formation when =20, We=16.43, Oh=0.05, and α=−0.8. Here for each time instant pressure contours are plotted in the left half and streamlines are in the right half of the drop. The pressure contour legend on the right applies to all time instants. A blowup of the drop shape emphasizing the high pressure region at the center of the drop meniscus at t=0.486 is shown to the right of the pressure contour legend.

FIGS. 13 to 21 refer to various embodiments of the present invention. FIG. 13 shows the evolution in time of the drop shapes with pressure contours and streamlines of DOD drop formation when $\Omega=20$, We=16.43, Oh=0.05, and $\alpha=-0.8$. The first three panels from t=0.001 to t=0.316 in FIG. 13 make plain that the drop meniscus at the nozzle exit oscillates with the oscillating flow rate in the first period of oscillation. A surface wave is developed in the first period along the free surface and travels toward the center of the meniscus. The fourth and fifth panels when t=0.410 and 0.471 in FIG. 13 further show that the meniscus is pulled back into the nozzle in the first half of the second oscillation period such that a valley is formed at the center of the meniscus. When the flow rate upstream of the nozzle changes from negative z-direction to positive z-direction, the flow upstream of the nozzle is trying to expel liquid out of the nozzle. The panel when t=0.486 in FIG. 13 makes clear that a high pressure region arises at this moment. A blowup of this panel when t=0.486 is shown to the right of the pressure contour legend to show more details of the pressure pattern and the flow field. The blowup when t=0.486 makes clear that in the region near the wall where viscous drag is important, the meniscus protrudes inward and its deformation is out of phase with the flow of positive z-direction upstream of the nozzle exit. Because of these two out-of-phase flows, a high pressure region arises in the vicinity of the tube centerline that is trying to expel liquid out of the nozzle. Consequently, the meniscus in the vicinity of the centerline protrudes out of the nozzle and its deformation is in phase with the flow of positive z-direction upstream of the nozzle. The two panels when t=0.520 and 0.645 make plain that a column of liquid is ejected from the center of the meniscus due to the high pressure region shown in the panel when t=0.486 and forms a small drop at t=0.645 whose radius is of order O(0.1) and volume is 0.00397 which is of the order O(0.001). Therefore, relative to a hypothetical drop having the same radius as the nozzle, use of high frequency oscillating flow rate has enabled a reduction in radius of an order of magnitude and a reduction in volume of three orders of magnitude.

When gravity presents, gravitational force has to overcome surface tension force to form drops from a faucet of constant flow rate. In this study, gravitational force is negligible and hence fluid inertia, which is imparted to the liquid by the time dependent oscillating flow rate upstream of the nozzle, must overcome surface tension force to form drops. The key to understanding the physics of the ejection of liquid column and small drop formation is to compare the process time scale $t_p$ over which the fluid's momentum is changed to the other time scales. First, the flow rate must be changed over sufficiently short time scales such that $t_p \ll t_c$. It is noteworthy that the period of oscillation is $t_{osc}=2\pi/\tilde{\Omega}$ and $t_p=t_{osc}/2=\pi/\tilde{\Omega}$. Since the dimensionless frequency is $\Omega=\tilde{\Omega}\times t_c$, it is readily seen that $t_p/t_c=\pi/\Omega \ll 1$. Therefore, the ratio $t_p/t_c$ can be controlled by adjusting the dimensionless frequency $\Omega$. Similarly, it is helpful to judiciously choose the ratio $t_p/t_\mu$, where $t_\mu=R^2/(\mu/\pi)$ is the viscous time scale, so that this ratio is neither so large that the liquid behaves like a solid ($\mu \gg 1$) nor so small that the liquid behaves like an inviscid fluid ($\mu \ll 1$). Since $Oh=t_c/t\mu$, the ratio $t_p/t_\mu=\pi Oh/\Omega$ is proportional to the ratio $Oh/\Omega$.

Figure 14:
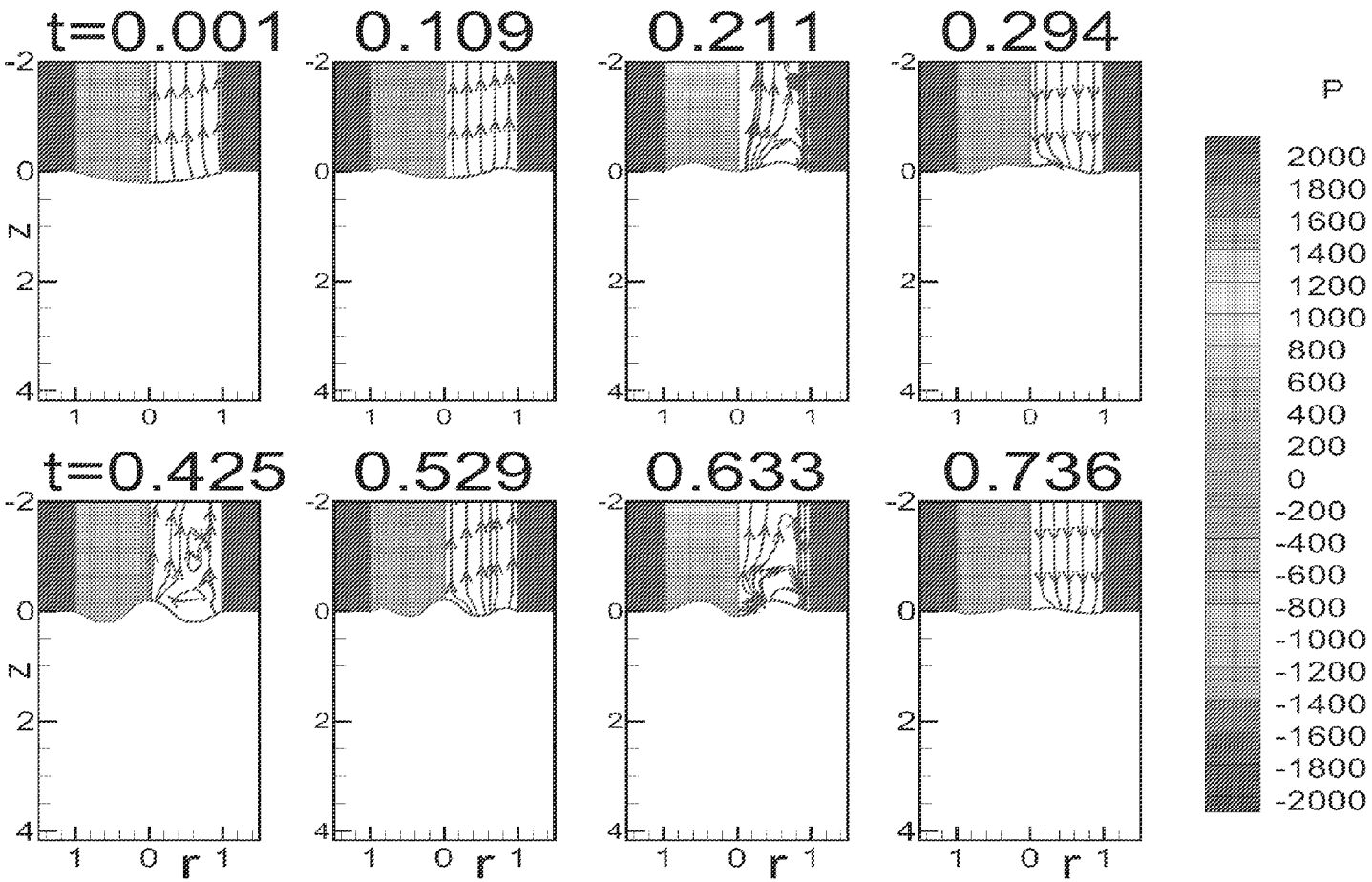
FIG. 14: Evolution in time of the pressure contours and streamlines in the drop when =15, We=9.24, Oh=0.05, and α=−0.8. Here for each time instant pressure contours are plotted in the left half and streamlines are in the right half of the drop. The pressure contour legend on the right applies to all time instants.
Figure 15:
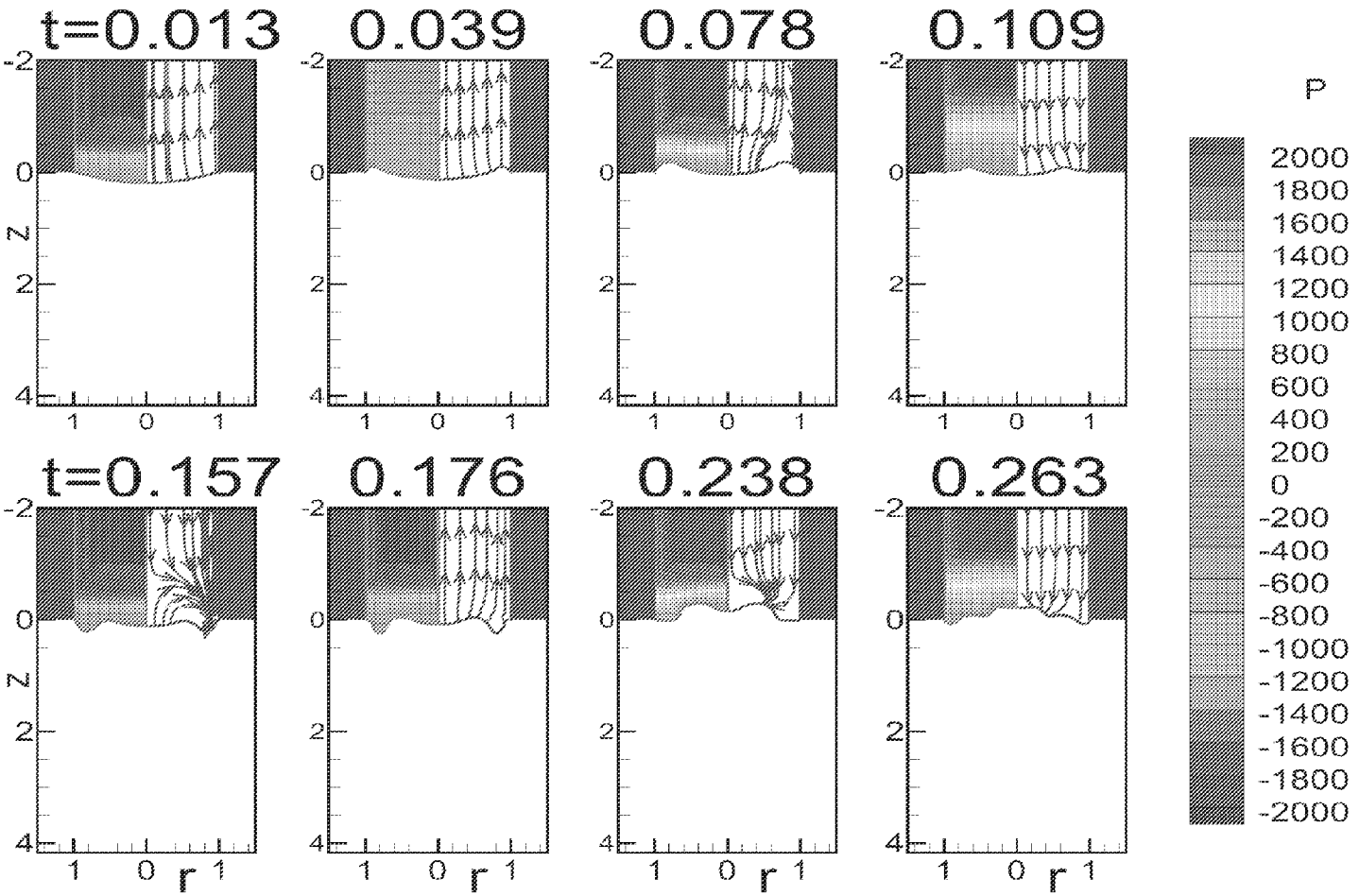
FIG. 15 Evolution in time of the pressure contours and streamlines in the drop when =40, We=65.718, Oh=0.05, and α=−0.8. Here for each time instant pressure contours are plotted in the left half and streamlines are in the right half of the drop. The pressure contour legend on the right applies to all time instants.

When the value of the frequency $\Omega$ in FIG. 13 is lowered to $\Omega=15$, the ratio of $t_p/t_\mu$ becomes larger and the liquid behaves more like a solid ($\mu \gg 1$). Such a situation is shown in FIG. 14, which shows the evolution in time of the pressure contours and streamlines in the drop when $\Omega=15$, We=9.24, Oh=0.05, and $\alpha=-0.8$. FIG. 14 makes plain that when the ratio $t_p/t_\mu$ is large, vorticity has ample time to diffuse through the liquid. Each time the flow at the inlet upstream of the nozzle changes its direction, the flow of the bulk liquid quickly changes direction as well, making the ejection of small drops impossible. Hence the liquid behaves more like a solid ($\mu \gg 1$). When the frequency is increased such that the ratio Oh/decreases, the ratio $t_p/t_\mu$ becomes smaller and the liquid behaves as if it were inviscid. Such a situation is shown in FIG. 15, which shows the evolution in time of the pressure contours and streamlines in the drop when $\Omega=40$, We=65.718, Oh=0.05, and $\alpha=-0.8$. FIG. 15 makes clear that when the ratio $t_p/t_\mu$ is small, vorticity has insufficient time to diffuse through the liquid in the nozzle. The resulting motion is nearly plug flow and large velocity gradients are absent except near the nozzle wall. Thus, there is no liquid column and drop formation in this case. Only when the ratio $t_p/t_\mu$ is of intermediate value, interesting thing happens that small drops are formed from the nozzle, which is shown in FIG. 13 and has been elaborated in proceeding discussion.

Figure 16:
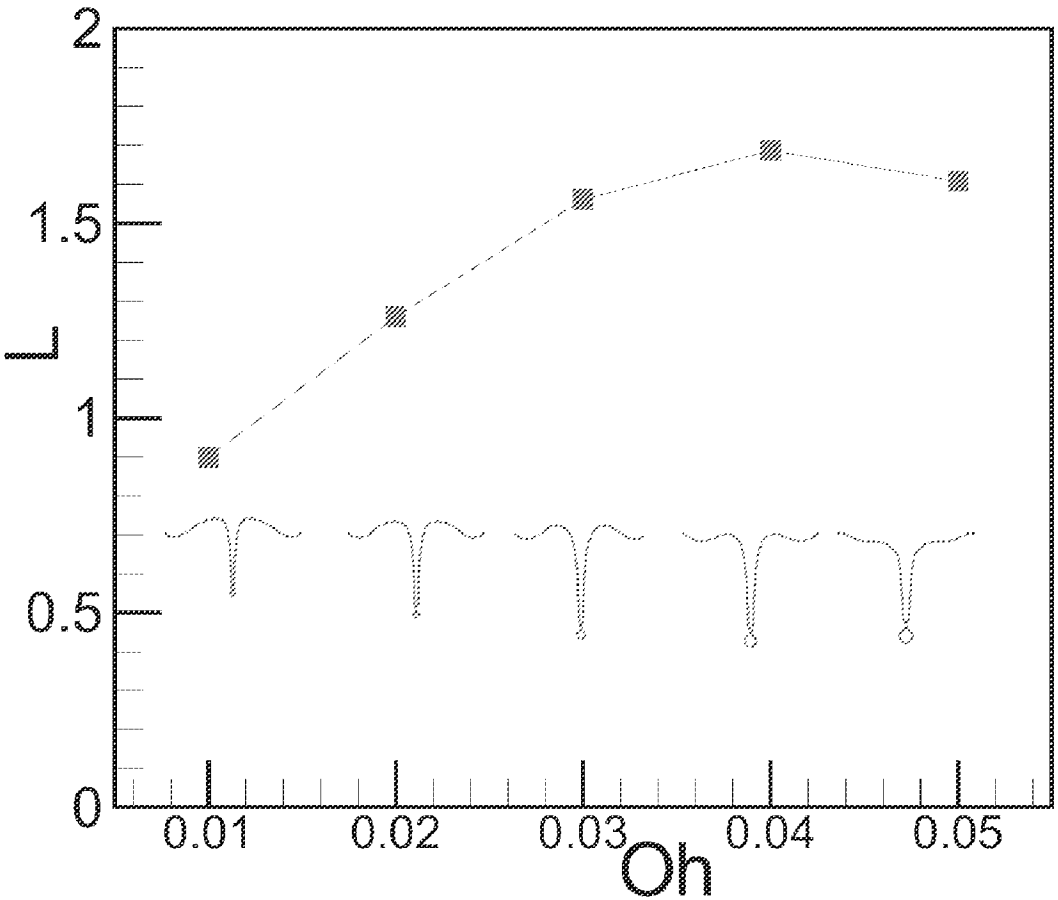
FIG. 16. Variation with Oh of the limiting length of DOD drop formation when=20, We=16.43 and α=−0.8. Insets show the final shape profiles of drops at the incipience of pinch-off.

FIG. 16 shows the variation with the Ohnesorge number of the length of drops when $\Omega=20$, We=16.43 and $\alpha=-0.8$. The insets show the final shape profiles of drops at the incipience of pinch-off. All the drops shown in FIG. 16 undergo breakup through dynamics similar to those shown in FIG. 13. FIG. 16 makes clear that the length increases as the Ohnesorge number increases from 0.01 to 0.04 and the length at Oh=0.04 is larger than that at Oh=0.05. This is because when a liquid column is expelled from the nozzle, the capillary force which is proportional to the reciprocal of Ohnesorge number decreases as Oh increases, allowing the liquid column extends longer. On the other hand, when Oh increases, more viscous drag is applied to the extruding liquid column by the liquid close to the wall of the nozzle, hence reducing the length of the liquid column before the drop breakup. Furthermore, FIG. 16 shows that both the breakup time required for the drop to break up and the primary drop volume increase monotonically from t=0.527 at Oh=0.01 to t=0.653 at Oh=0.05 as the Ohnesorge number increases (see, also, insets to FIG. 16). As the dynamics of the drop at Oh=0.01 is similar to that of the drop at Oh=0.05 as shown in FIG. 13, the capillary force which drives the breakup process decreases when Oh increases. Consequently, it takes longer time for the drop breakup to occur and more liquid is flown into the primary drop. For low Ohnesorge number when Oh~O(10–

3), the ratio $t_p/t_\mu$ is so small that the liquid behaves as if it were inviscid ($\mu<<1$). The drop formation is suppressed in this situation and the dynamics resemble those in FIG. 15. At the opposite extreme when the Ohnesorge number is very high, the ratio $t_p/t_\mu$ is very large so that the liquid behaves like a solid ($\mu>>1$). Computational results show that drop formation is also suppressed in this situation and the dynamics resemble those in FIG. 14. At both extremes, drop meniscus simply oscillates irregularly and chaotically with the oscillating flow rate upstream of the nozzle. In their experimental work, Chen & Basaran found that small drops cannot be formed if the viscosity (Oh) is too small or too large, which is similar to what is discovered here.

Figure 17:
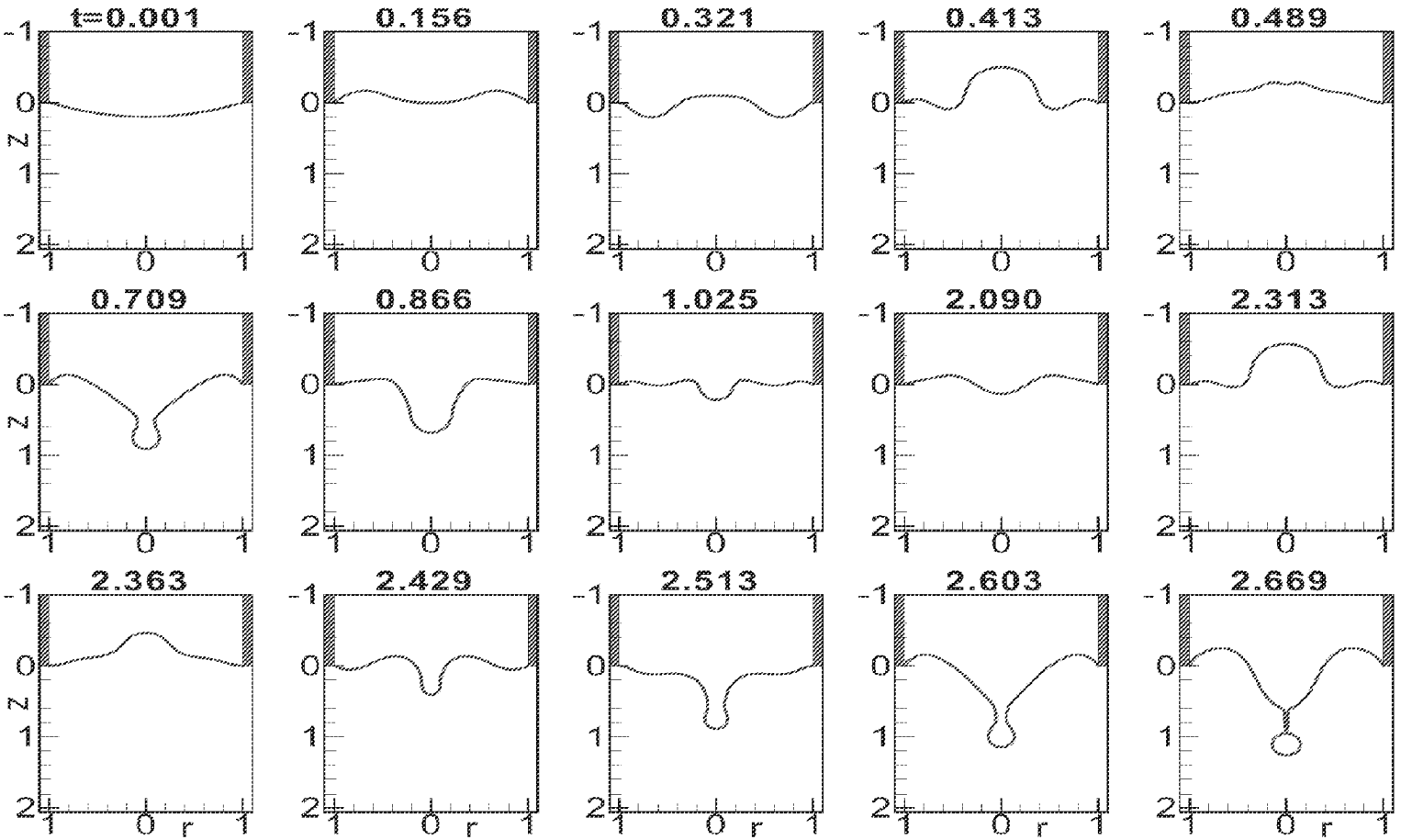
FIG. 17. Evolution in time of the shape profiles of a drop when =20, We=16.43, Oh=0.06, and α=−0.8. A small drop is formed after a liquid column is ejected more than once from the nozzle.
Figure 18:
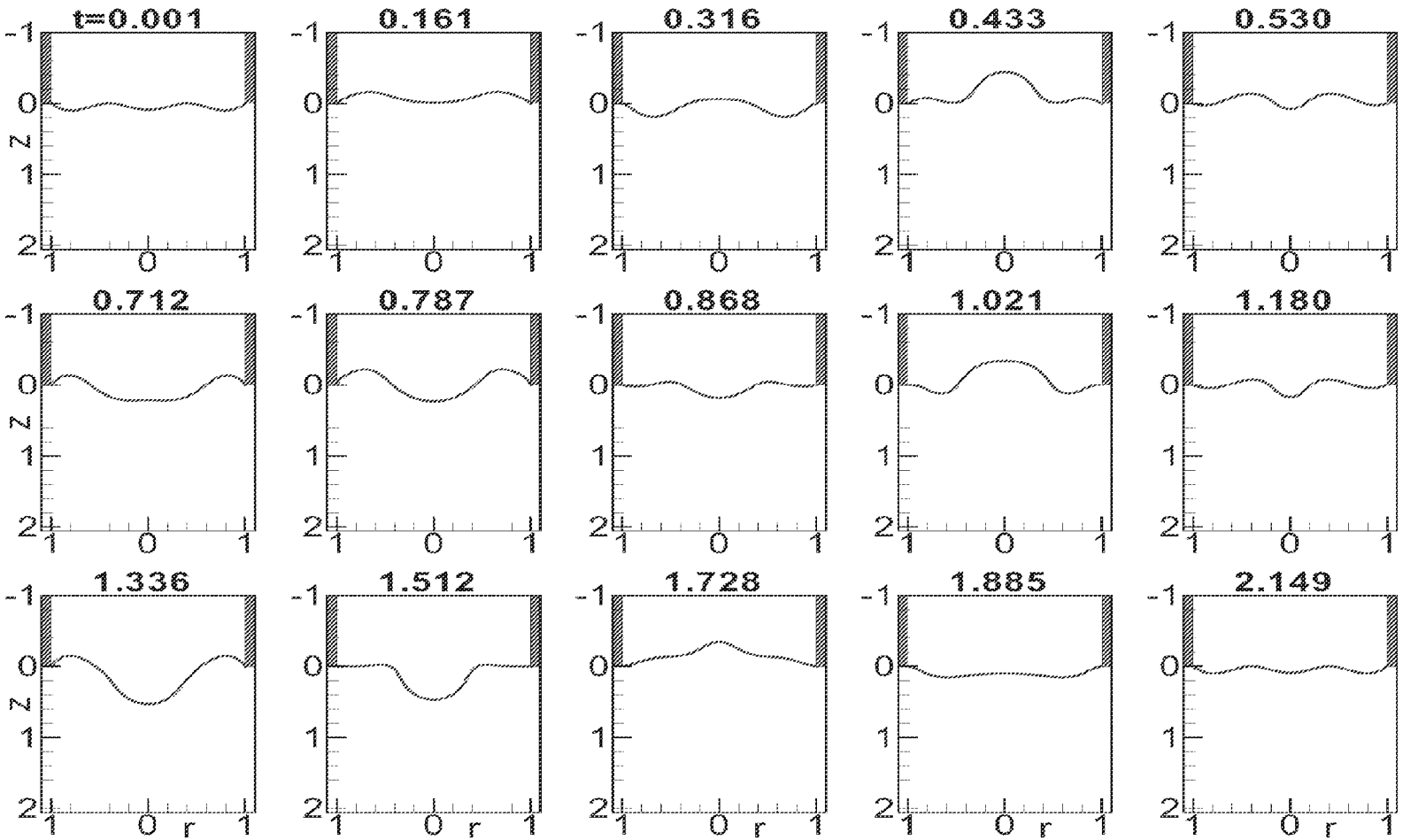
FIG. 18. Evolution in time of the shape profiles of a drop when=20, We=16.43, Oh=0.09, and α=−0.8. There is no drop formation during several periods of oscillation.

FIG. 13 has shown that the small drop is formed from a column of liquid that is ejected by a high pressure region at the center of the drop meniscus, which is due to the coupling of the movement of surface wave along the free surface and the oscillating flow rate. If the column of the liquid did not have enough momentum, then the drop formation could be suppressed by the surface tension force. There is also possibility that multiple ejections of liquid column are needed in order to form a small drop. An example is given in FIG. 17, which shows the evolution in time of the drop shapes of a DOD drop when $\Omega=20$, We=16.43, Oh=0.06, and $\alpha=-0.8$. FIG. 17 makes clear that when the first time a column of liquid is ejected from the nozzle when t=0.709, it does not emit a small drop. Instead, the column of liquid is restricted and drawn back into the nozzle by viscous drag applied to it from the liquid in the nozzle. After several extra periods of oscillation, a liquid column is ejected the second time and it generates a small drop. FIG. 18 shows the evolution in time of the shape profiles of a drop with the same properties as the drop shown in FIG. 17 but with a higher Ohnesorge number, Oh=0.09. FIG. 18 makes clear that the drop formation is suppressed. When the viscosity of the liquid increases, the momentum of the ejected liquid column is changed quickly under the influence of the flow upstream of the nozzle because of large viscous drag force. Moreover, the capillary pressure is lowered when the viscosity of liquid increases, which makes it more difficult for the column of liquid to undergo pinch-off and emit a small drop.

Figure 19:
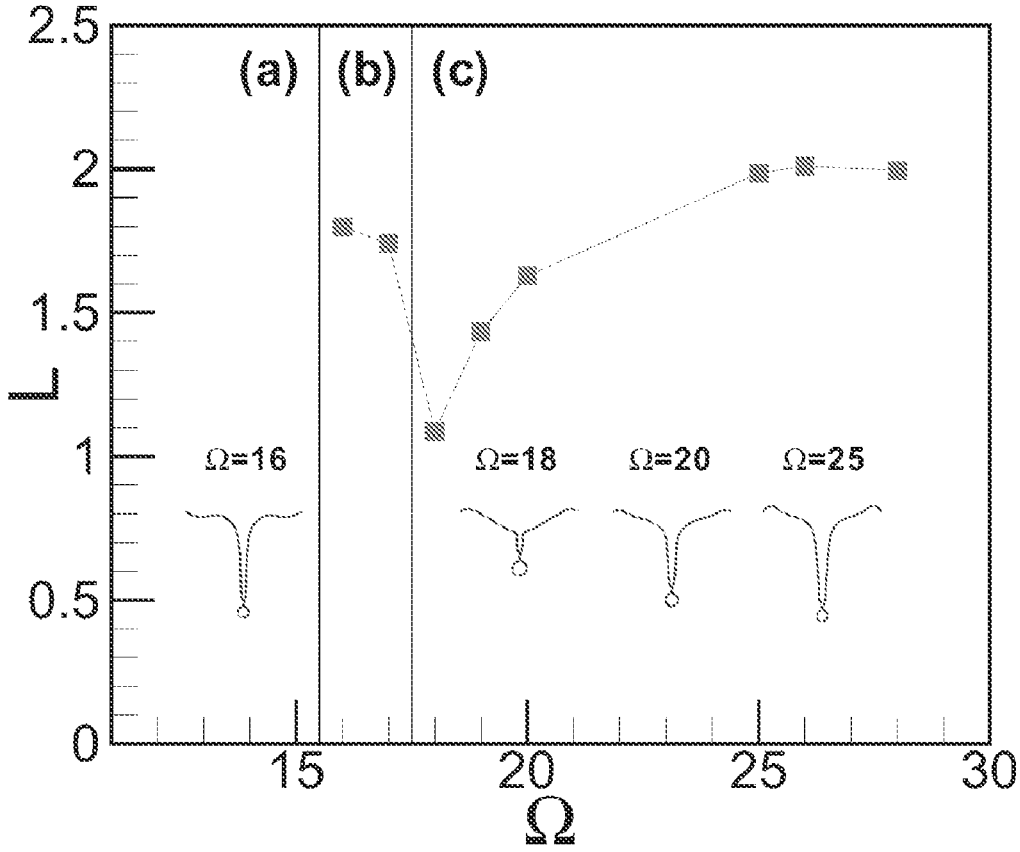
FIG. 19. Variation with the frequency of the limiting length of DOD drop formation when Oh=0.05 and α=−0.8. Insets show the final shape profiles of drops at the incipience of pinch-off for various frequency with the value indicated above. Three regimes are identified in the parameter space shown here: (a) no drop formation, (b) drop formation after multiple ejections of liquid column, and (c) drop formation on the first time of ejection of liquid column.

FIG. 19 shows the variation with the frequency $\Omega$ of the limiting length of DOD drop formation when Oh=0.05 and $\alpha=-0.8$. Insets show the final shape profiles of drops at the incipience of pinch-off for various frequency with the value indicated above. Three regimes are identified in the parameter space shown here: (a) no drop formation, (b) drop formation after multiple ejections of liquid column, and (c) drop formation on the first time of ejection of liquid column. FIG. 19 makes clear that in regime (c) where $18\leqq\Omega\leqq26$ the limiting length increases as $\Omega$ increases. Computational results show that when parameters are in this range, the dynamics of drop formation resemble closely to those shown in FIG. 13. Here the Weber number varies with frequency such that the ratio of $\sqrt{We}/\Omega$ is a constant. When frequency increases, the Weber number also increases. Therefore, more momentum is imparted on to the liquid column by the flow upstream of the nozzle and the length of the liquid jet increases. Since the frequency increases, the ratio of $Oh/\Omega$ decreases. Therefore, the liquid behaves as if it were less viscous and hence the breakup occurs faster and less liquid is flown into the primary drop.

Figure 20:
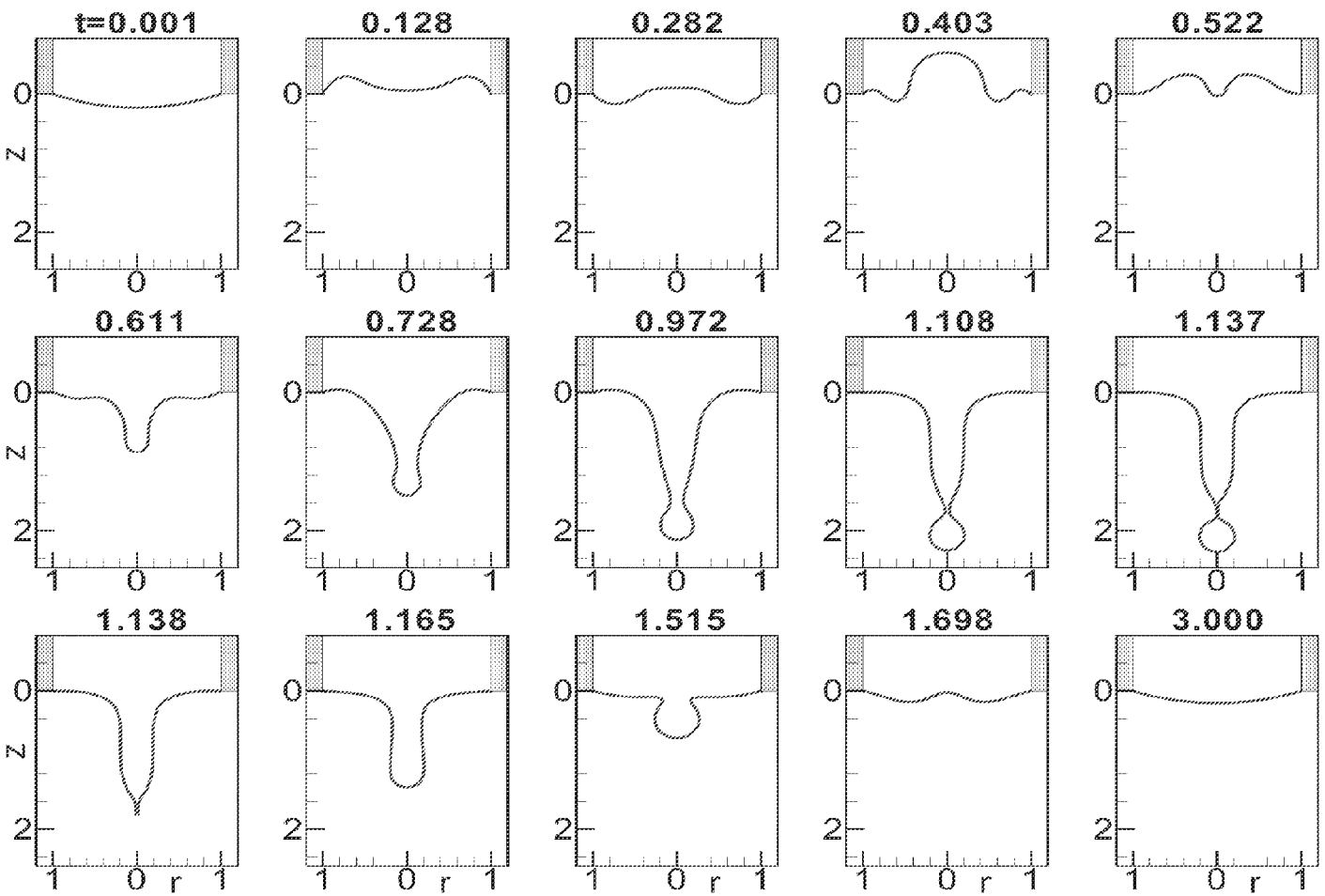
FIG. 20. Evolution in time of the shape profiles of a drop when=20, We=34, Oh=0.1, and α=−0.8. A single small drop is formed without the formation of a secondary drop.

For the purpose of verification, the 2D algorithm is extended to continue calculation beyond the formation of first drop. FIG. 20 shows the evolution in time of the drop shapes when $\Omega=20$, We=34, Oh=0.1, and $\alpha=-0.8$. FIG. 20 makes clear that a single small drop is formed without the formation of a secondary drop. Such a situation when a single small drop is formed is highly desirable in real world application because it eliminates the troublesome of removing the satellite drops.

Figure 21:
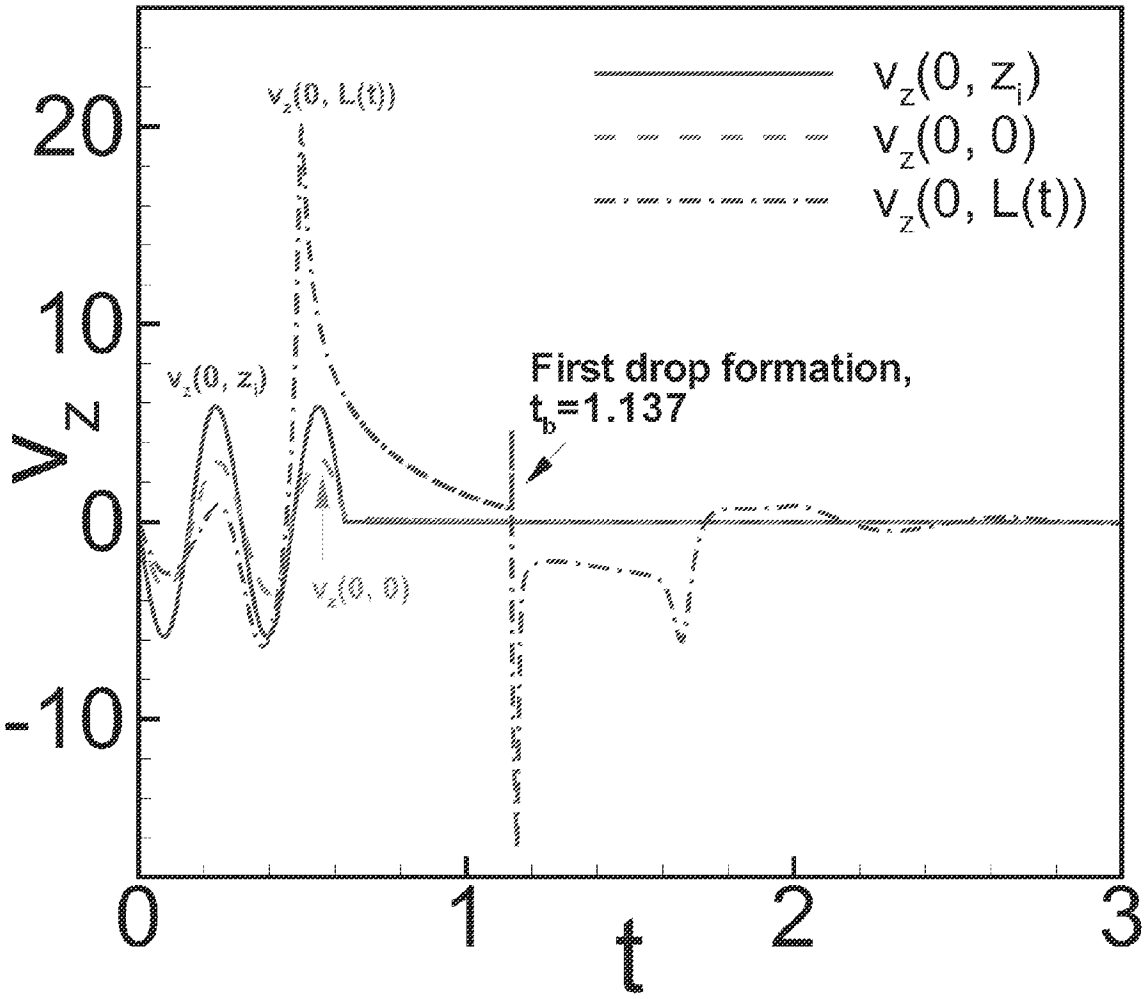
FIG. 21. Variation with time of the z-component velocities at (0, zi), solid line, (0, 0), dashed line, and (0, L(t)), dash-dotted line, for the drop in FIG. 20.

FIG. 21 shows the variation with time of the z-component velocities at $(0, z_t)$, (0, 0) and (0, L(t)), for the drop in FIG. 20. The oscillatory flow at the inlet is artificially turned off after two cycles of flow. The velocity of the drop tip at the incipience of breakup of first drop is positive, indicating that the formed small DOD drop has a positive z-velocity and moves away from the nozzle.

The discussion that follows pertains to FIGS. 22 to 39. Some of the combinations of $\Omega$, $\alpha$, We, and Oh shown therein do not produce a sufficiently small drop. However, this discussion provides some insight into the various embodiments of the invention.

Values of $\mu=2$ cp, $\sigma=50$ dyn/cm, $\rho=1$ g/cm$^3$, and R=10 μm are typical for inks and ink-jet nozzles. The time scale for this combination of physical properties and nozzle radius is $t_c\approx4$ μs. Thus, for this system, Oh≈0.1, and the gravitational Bond number $G\equiv\rho gR^2/\sigma$, where g is the acceleration due to gravity, which measures the importance of gravitational force relative to surface tension force $G\approx2\times10^{-5}$, which justifies the neglect of the body force due to gravity, viz., setting G=0, in analyzing drop formation in ink-jet printing. Based on the discussion in Sec. I, a reasonable value of the dimensional frequency would be $O(10^)$ Hz, which corresponds to a dimensionless frequency of $\Omega=O(1)$ given the time scale of 4 μs. In order to focus on the physics of DOD drop formation, the drop size parameter will be set to $\alpha=0$, i.e., an initial drop volume of $V_0=2\pi/3$, in the remainder of this section unless it is indicated otherwise. Thus, taking Oh=0.1 in most cases, a major goal of this section is to determine the combination of values of We and $\Omega$, while keeping $\Omega=O(1)$, except in a few situations, which result in DOD drop formation.

Computer modeling was performed to show the evolution in time of the shape of a drop forming from a DOD nozzle and of the axial velocity along the axis of symmetry at the inflow boundary $z=z_t$, the tube outlet z=0, and the drop tip z=L(t) when Oh=0.1, We=22.5, and $\Omega=1.5$. Here the value of the Weber number has been chosen large enough to ensure that drop breakup occurs and a DOD drop is formed. For these values of We and $\Omega$, the maximum injected volume $\Delta V=\sqrt{10}\doteq9.93$. If one were to estimate the size of the DOD drop formed by assuming that the volume $V_d$ of the DOD drop equals $V_0+\Delta V$, $V_d\doteq12.0$ and $R_d\doteq1.42$, where $R_d$ is the radius of a sphere having the same volume as the DOD drop. If, on the other hand, one were to estimate the size of the DOD drop formed by assuming that the volume $V_d=\Delta V$, $V_d\doteq9.93$ and $R_d\doteq1.33$. Although these estimates are in line with values of $V_d$ obtained from experiments, actual values of $V_d$ determined from the computations will be given below.

The computer model showed drop shapes during the first half of the flow oscillation period, i.e., $0<t<\pi/\Omega$, when the inflow is positive, and those during the second half of the flow oscillation period, i.e., $\pi/\Omega<t<2\pi/\Omega$, when the inflow is negative. During the first quarter of the flow oscillation period, fluid at the tip of the drop is accelerated and thereafter moves virtually at a constant velocity. The drop also begins to exhibit a neck towards the end of the first half of the flow oscillation period. Once the inflow is reversed, it takes a certain period of time, which depends on the Ohnesorge number (see below), for the axial velocity along the center line evaluated at the exit of the capillary to become negative. However, because of inertia, fluid near the drop tip continues to move away from the nozzle for all time and the velocity at the drop's tip is positive even at the instant of breakup ($t=t_d$). Thus, fluid inertia delicate roles in determining the breakup dynamics.

The interplay between these two parameters are first investigated in the next few paragraphs by varying both of them while keeping the value of the maximum injected volume fixed at $\pi\sqrt{10}$ or while maintaining $\sqrt{We}/\Omega=\sqrt{10}$.

Figure 22:
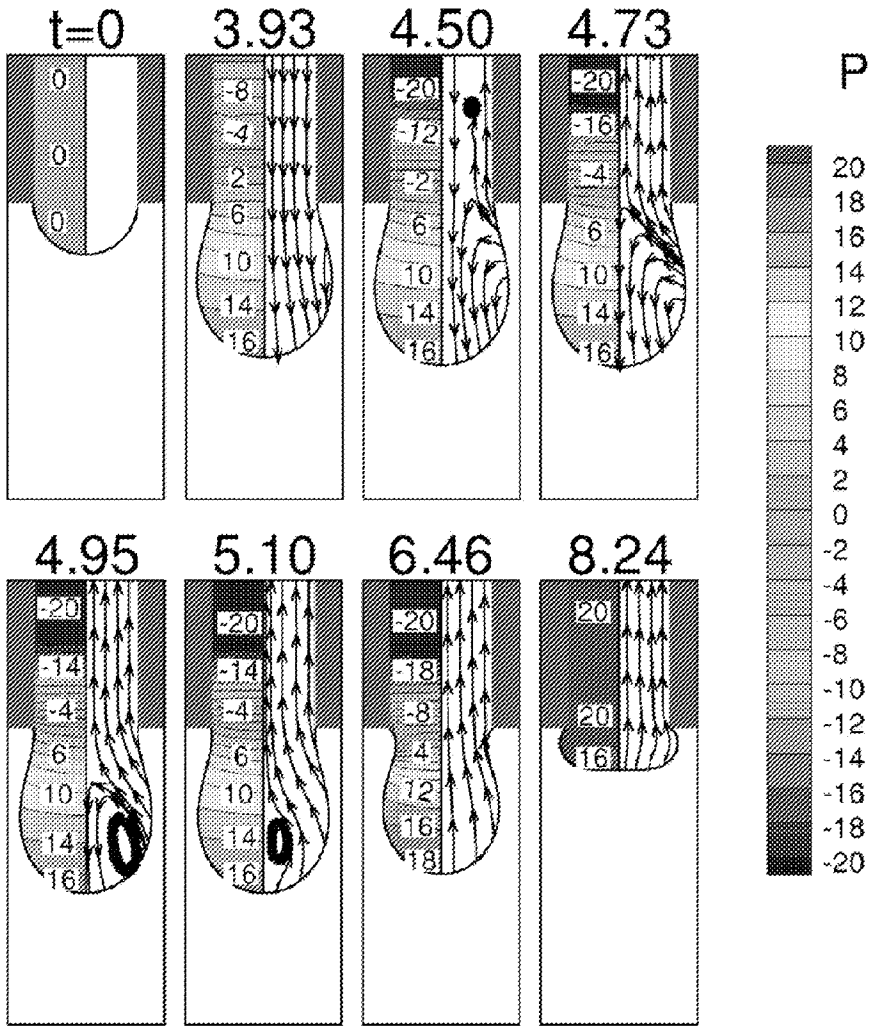
FIG. 22. Evolution in time of the streamlines and pressure fields within a pendant drop and a portion of the nozzle from which it is being formed when Oh=0.1, We=4.9, and Ω=0.7.
Figure 23:
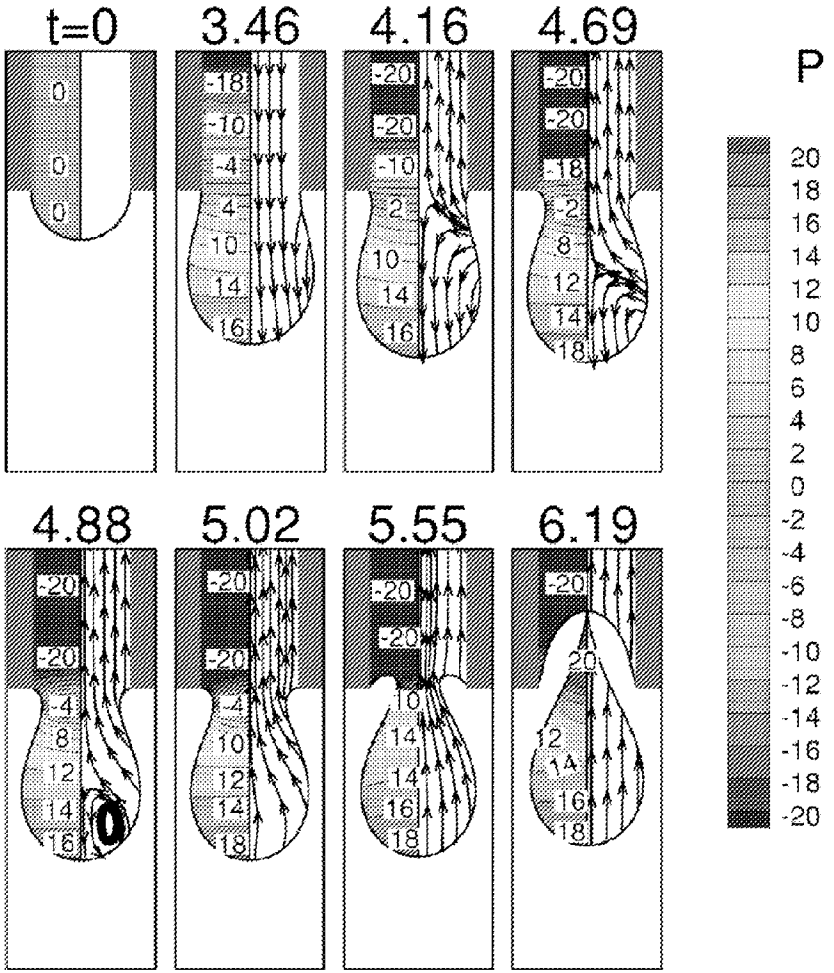
Figure 24:
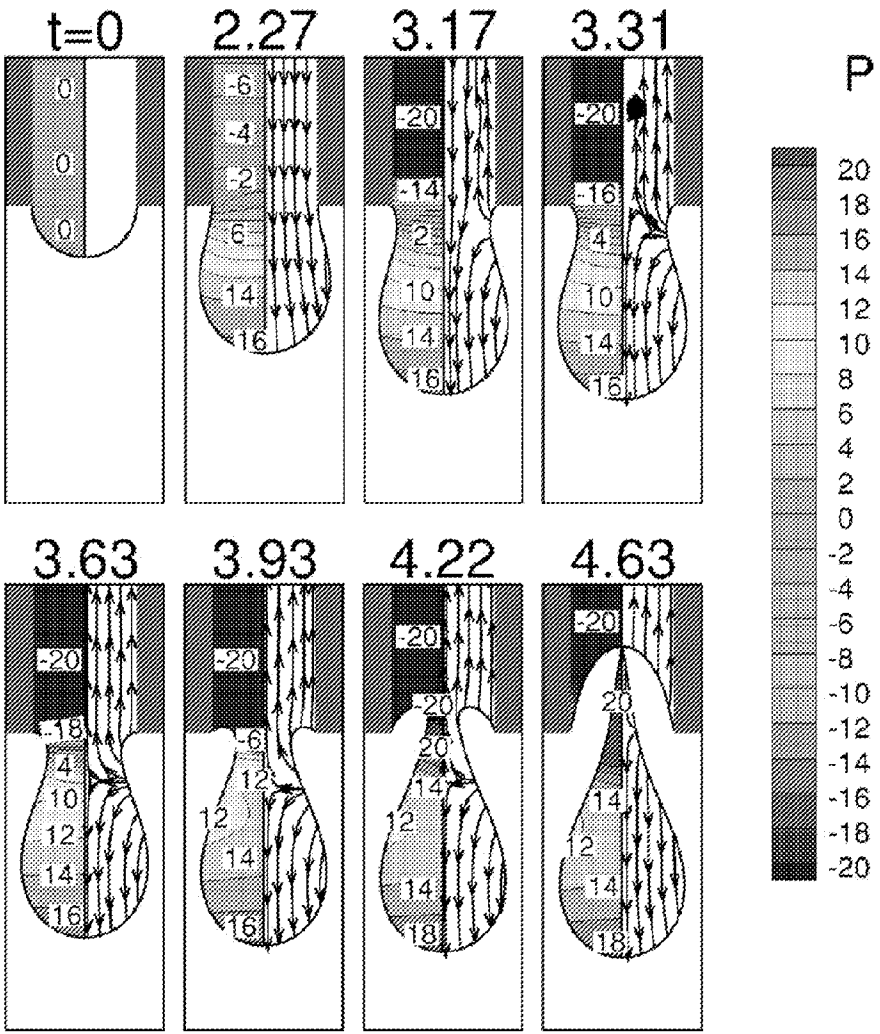
Figure 25:
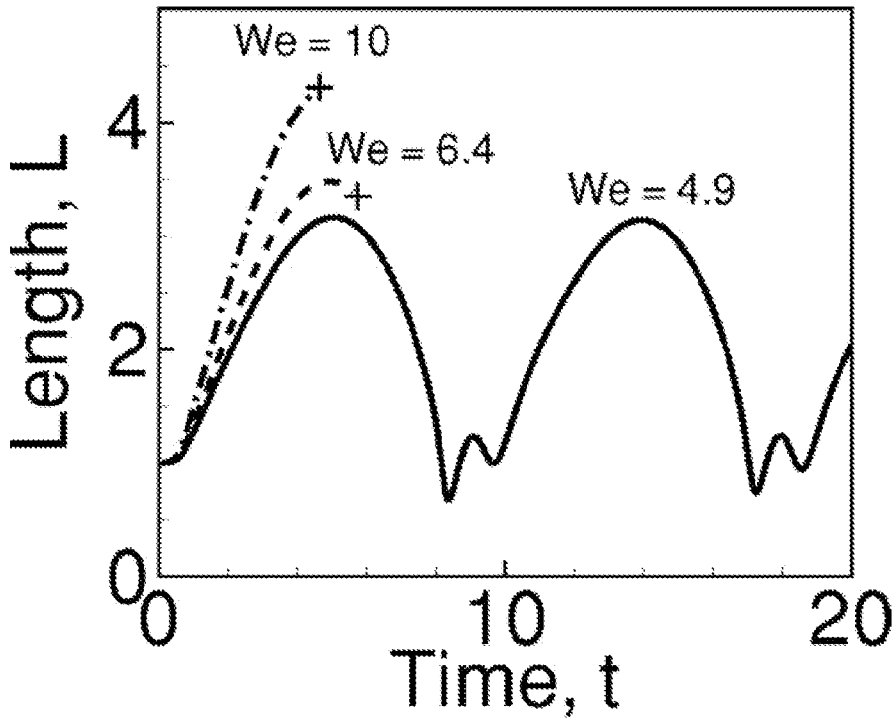
FIG. 25. Variation of drop length with time for several values of We when Oh=0.1 and $\sqrt{We}/\Omega=\sqrt{10}$. Here, We and Ω are varied together such that the maximum injected volume is kept constant at $\pi\sqrt{10}$. Along the two curves for the larger values of We, the symbol "+" indicates the time of breakup and the drop length at breakup.

FIGS. 22 to 24 show for three different Weber numbers, We=4.9, 6.4, and 2-10, the evolution in time of the pressure fields and streamlines within the pendant drops and the nozzles from which they are being grown when Oh=0.1 and $\sqrt{We}/\Omega=\sqrt{10}$, i.e., for $\Omega$=0.7, 0.8, and 1.0, respectively. FIG. 25 shows the variation of the drop length L(t) with time t in these three situations. FIGS. 22 to 25 show that drastically different outcomes are observed in these three situations. When We=4.9 or $\Omega$=0.7, FIG. 21 shows that drop breakup does not occur and the drop undergoes time periodic oscillations, as shown in FIG. 25. When We=6.4 or $\Omega$=0.8, FIG. 23 shows that breakup occurs and a DOD drop is formed, but the tip of the drop is moving toward the nozzle at pinchoff. When We=10 or $\Omega$=1, FIG. 24 shows that breakup occurs and a DOD drop is formed. Moreover, in the latter case, the tip of the drop is moving away from the nozzle at pinch-off.

Although the outcomes in FIGS. 22 to 24 are quite different, these three situations nevertheless exhibit a number of similarities that highlight the competing effects of inertial and surface tension, or capillary, forces that determine whether breakup will occur or not. In each case, upon the initiation of the flow, the pendant drops elongate along the axial direction, the rate of elongation of course being larger the larger are We and $\Omega$ (cf. FIG. 25). Thus, at early times in each case, the pressure is larger at the drop tip compared to that in the vicinity of the nozzle exit due to the fact that twice the local mean curvature, and hence the surface tension generated capillary pressure, is larger at the drop tip than near the nozzle exit. If the imposed flow were negligibly weak or if the flow everywhere could be turned off, the capillary pressure gradient would cause a flow from the drop tip toward the nozzle exit and thereby cause the elongated drop to tend back to a section of a sphere. However, because of finite inertia, the fluid within the drop continues to flow against the pressure gradient for times $t<\pi/\Omega$, as shown in FIGS. 22 to 24. When We=4.9 or $\Omega$=0.7, a stagnation plane forms within the drop shortly after the inflow is reversed, i.e., Q<0, at $t=\pi/\Omega \doteq 4.49$, as shown in FIG. 22 at t=4.73. Because the Weber number in this case is evidently too low, the stagnation plane quickly sweeps through the drop toward its tip. Indeed, as shown in FIG. 22, the axial velocity is everywhere negative by the time t=6.46 and the drop length has already started to decrease, as shown in FIG. 25.

When We=10 or $\Omega$=1, a stagnation plane still forms within the drop shortly after the inflow is reversed, i.e., Q<0, at $t=\pi/\Omega \doteq 3.14$, as shown in FIG. 24 at t=3.31. However, because the Weber number in this case is substantially higher than that in FIG. 22, a large fraction of the fluid within the drop continues moving with a large axial velocity in the positive z direction and without the stagnation plane sweeping through the drop toward its tip. The continued downward movement of the liquid near the drop tip and the upward flow of the liquid in the vicinity of the tube exit cause considerable necking of the drop for t>3.63. As the necking continues, the meniscus starts to invade the tube, as shown by the snapshot of the drop at t=3.93. The extent of tube invasion grows as time advances and breakup is approached, as shown by the snapshots at t=4.22 and 4.63.

When We=6.4 or $\Omega$=0.8, a stagnation plane forms within the drop shortly after the inflow is reversed, i.e., Q<0, at $t=\pi/\Omega \doteq 3.93$, as shown in FIG. 23 at t=4.16, similar to the other two cases. Although the stagnation plane sweeps through the drop in this case, it takes substantially longer to do so than when We=4.9 that breakup still occurs at $t=t_d=6.19$, as shown in FIG. 23. However, unlike the case of higher $\Omega$ or We shown in FIG. 24, the axial velocity at the tip as well as everywhere within the DOD drop of FIG. 23 at the incipience of breakup is negative. Such a situation would be undesirable in practical applications as upon formation the DOD drop would move toward the nozzle and may coalesce with the liquid within the nozzle.

Figure 26:
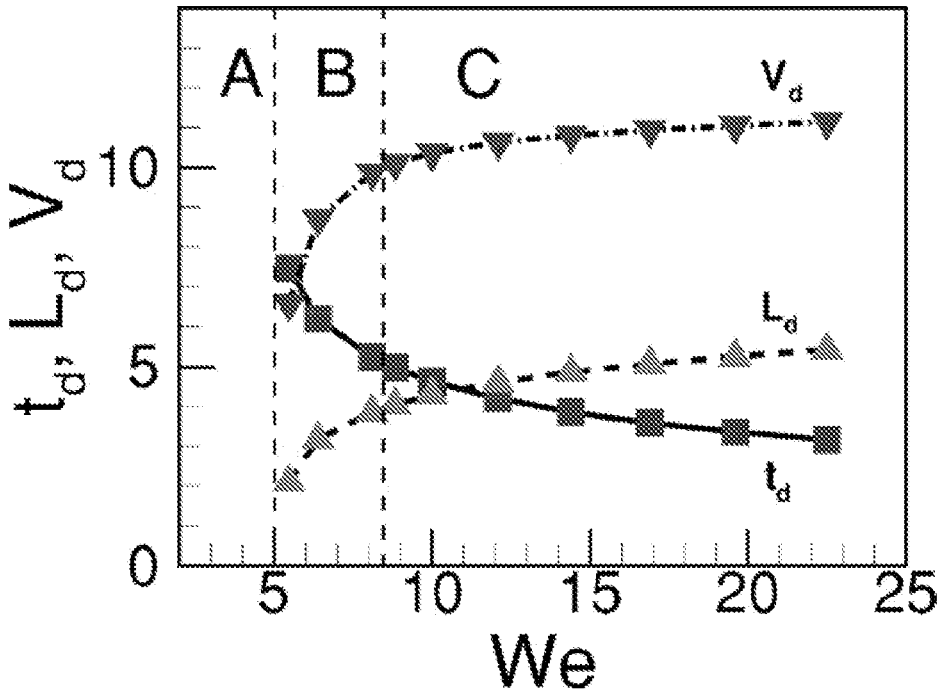
FIG. 26. Variation of breakup time $t_d$, limiting length Ld, and DOD drop volume $V_d$ with Weber number We when Oh=0.1 and $\sqrt{We}/\Omega=10$. Here, We and Ω are varied together such that the maximum injected volume is kept constant at $\pi\sqrt{10}$. Also identified in the figure are the three regimes where different types of drop responses are observed. In regime A (We<<4.9 or <<0.7), drop formation does not occur. In regime B (5.48<<We<<8.1 or 0.74<<Ω<<0.9), a DOD drop is formed but the velocity at the tip of the DOD drop at breakup is negative. In regime C (We>>8.84 or Ω>>0.94), a DOD drop is formed, and the velocity at the tip of the DOD drop at breakup is positive.
Figure 27:
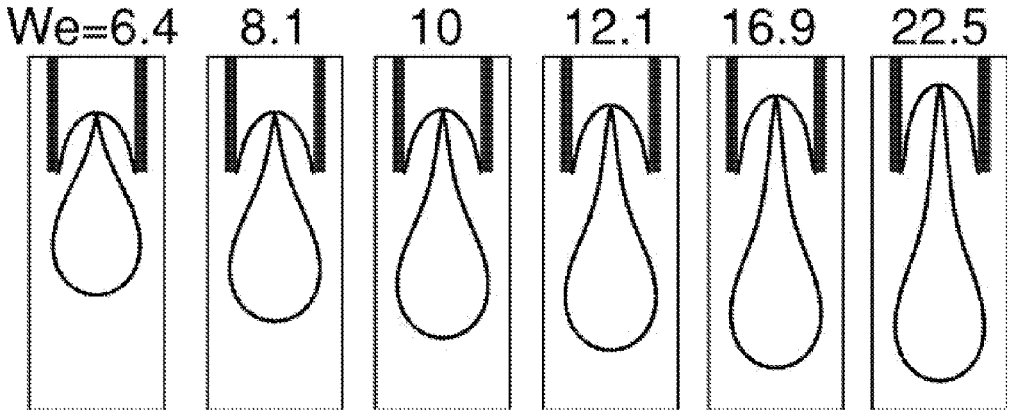
FIG. 27. Variation of drop shapes at breakup with We when Oh=0.1, $\sqrt{We}/\Omega=10$ and. Here, We and Ω are varied together such that the maximum injected volume is kept constant at $\pi\sqrt{10}$.

FIG. 26 shows the variation with Weber number We of the breakup time $t_d$, the drop length at breakup $L_d$, which is the length of the pendant drop measured from z=0 to its tip at the instant of breakup, and the volume of the DOD drop that forms upon breakup $V_d$ when Oh=0.1 and $\sqrt{We}/\Omega=\sqrt{10}$, i.e., for situations in which the maximum injected volume is kept constant at $\pi\sqrt{10}$. FIG. 26 shows that depending on the value of the Weber number, the drop response falls in one of three regimes. In regime A, where $We \leqq 4.9$, drop breakup does not occur and the drops undergo time periodic oscillations (cf. FIG. 22). In regime B, where $5.48 \leqq We \leqq 8.1$, a DOD drop is formed but the velocity at the tip of the DOD drop is negative at breakup (cf. FIG. 23), which is undesirable in practice. In regime C, where $We \geqq 8.84$, a DOD drop is formed and the velocity at the tip of the DOD drop is positive (cf. FIG. 24). The values of We for transition between the various regimes can be determined more precisely if needed but this point is not pursued here any further. FIG. 27 shows the variation with We of the breakup shapes of the drops of FIG. 26 for which pinch-off occurs. FIGS. 8 and 9 show that $L_d$ and $V_d$ increase as We increases. That $L_d$ increases as We increases accords with intuition and the earlier discussion of FIGS. 22 to 24. Because $V_d$ increases with We while the maximum injected volume is kept fixed, the extent of tube invasion increases as We increases, as shown in FIG. 27. Furthermore, since_is increasing with We in FIGS. 8 and 9, increasing $\Omega$ corresponds to decreasing the time at which the inflow is reversed. The latter results in more rapid thinning of the drop's neck and hence a smaller breakup time as $\Omega$ and We increase, as shown in FIG. 26.

Figure 28:
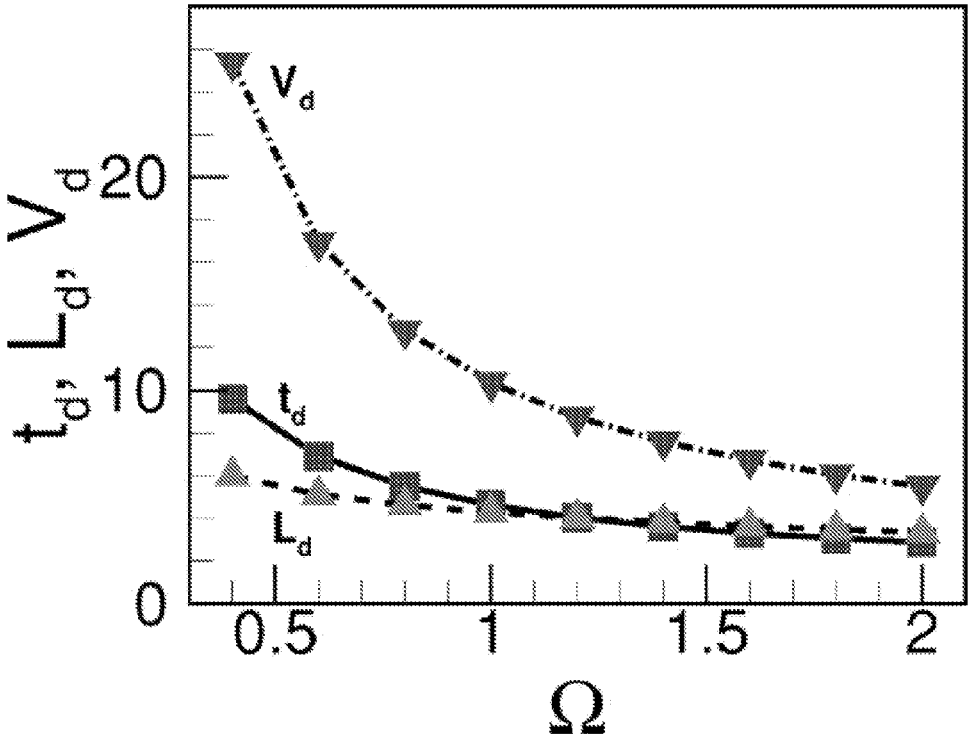
FIG. 28. Variation of breakup time $t_d$, limiting length $L_d$, and DOD drop volume $V_d$ with frequency Ω when Oh=0.1 and We=10.
Figure 29:
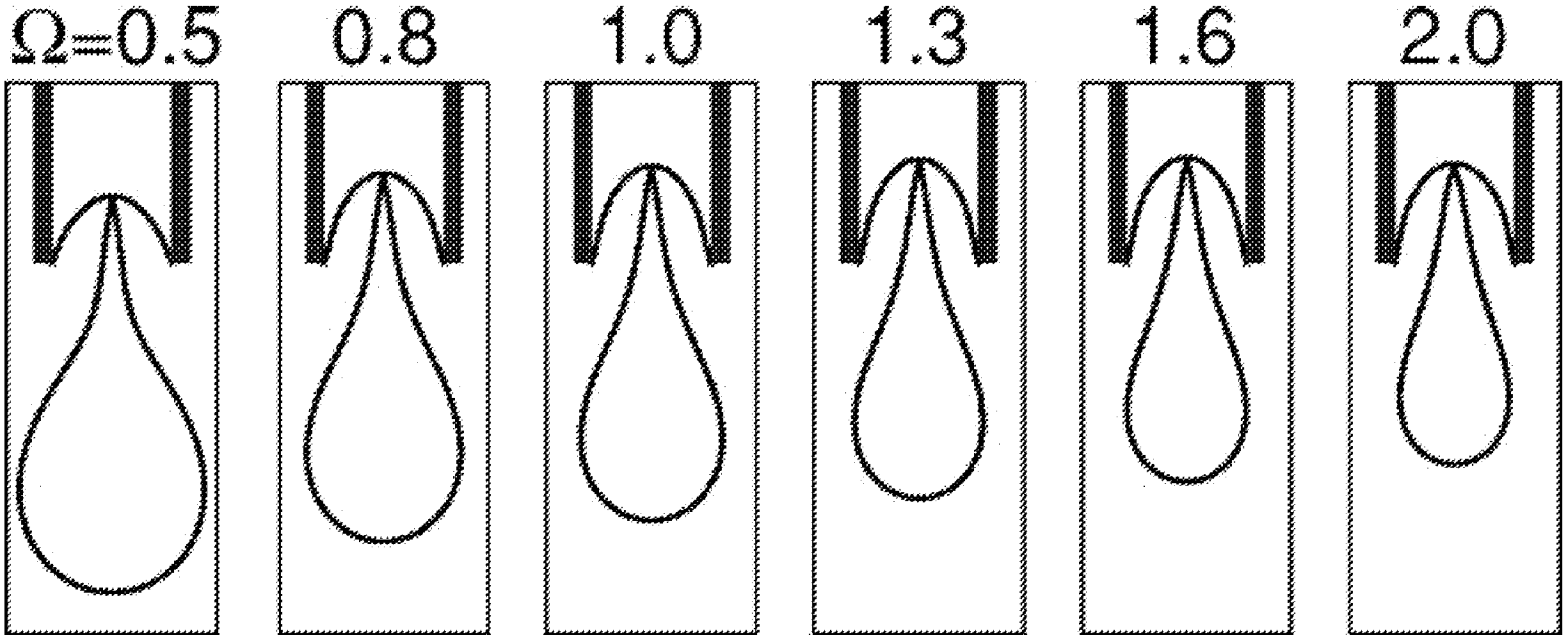
FIG. 29. Variation of drop shapes at breakup with Ω when Oh=0.1 and We=10.

FIG. 28 shows the variation with frequency $\Omega$ of $t_d$, $L_d$, and $V_d$, and FIG. 29 shows the variation with $\Omega$ of drop shapes at breakup when Oh=0.1 and We=10. As the Weber number is fixed in both Figures, the maximum injected volume decreases as the frequency increases. Hence, it accords with intuition that the breakup length and the DOD drop volume decrease as frequency increases, as shown in both Figures. Furthermore, since the time at which the inflow is reversed decreases as $\Omega$ increases, it accords with intuition that the breakup time decreases as $\Omega$ increases, as shown in FIG. 28. In addition, in sharp contrast to situations in FIGS. 8 and 9, a DOD drop forms for all values of the frequency shown in FIG. 28. Moreover, the velocity at the tips of all the drops shown in FIGS. 28 and 11 are positive at pinch-off. Thus, the mode of breakup is insensitive to variations in the frequency over the range of $\Omega$ values considered here provided that the Weber number is sufficiently large to ensure the formation of a DOD drop.

Figure 30:
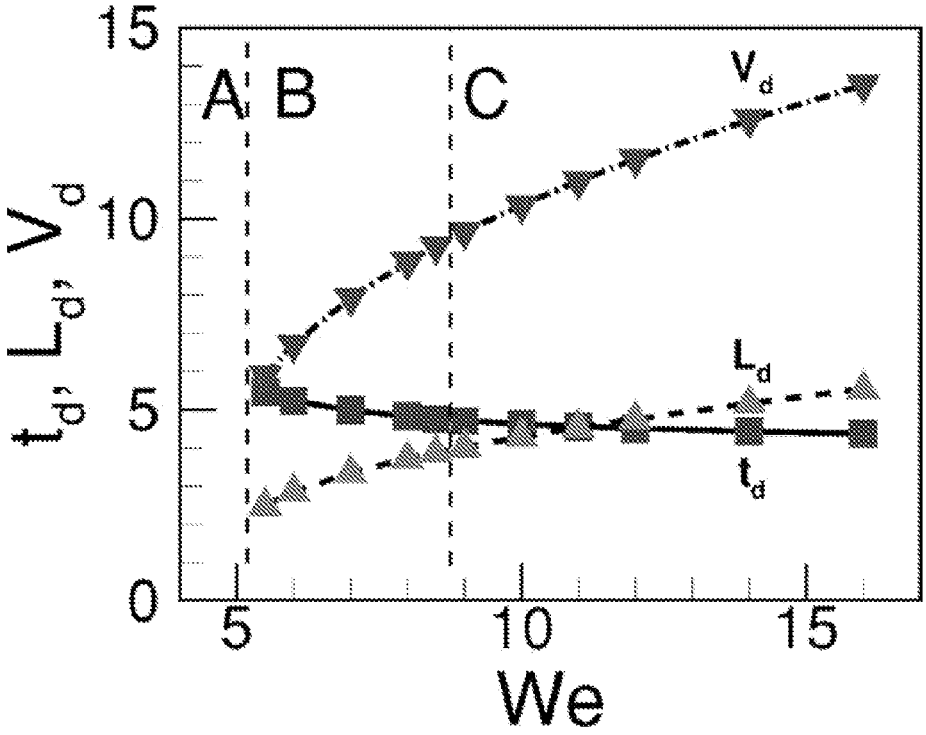
FIG. 30. Variation of breakup time $t_d$, limiting length $L_d$, and DOD drop volume $V_d$ with Weber number We when Oh=0.1 and Ω=1. Also identified in the figure are the three regimes where different types of drop responses are observed. In regime A (We<<5), drop formation does not occur. In regime B (5.5<<We<<8.5), a DOD drop is formed but the velocity at the tip of the DOD drop at breakup is negative. In regime C (We>>9), a DOD drop is formed and the velocity at the tip of the DOD drop at breakup is positive.
Figure 31:
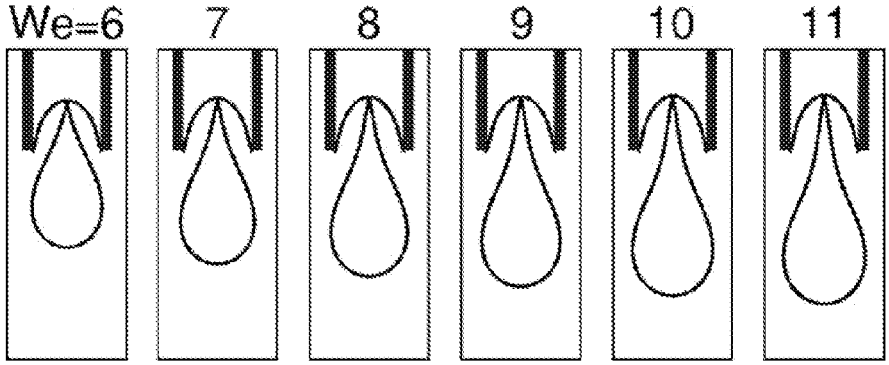
FIG. 31. Variation of drop shapes at breakup with We when Oh=0.1 and Ω=1.

FIG. 30 shows the variation with We of $t_d$, $L_d$, and $V_d$, and FIG. 31 shows the variation with We of drop shapes at breakup when Oh=0.1 and $\Omega$=1. As the frequency is fixed in both of these Figures, the maximum injected volume increases as Weber number increases. Thus, it accords with intuition that the computed values of the limiting length and the DOD drop volume increase as We increases. The breakup time, however, decreases slightly as Weber number increases. This finding too accords with intuition as increasing We results in faster elongation and faster necking of the growing drop, which leads to more rapid pinching once the inflow is reversed. Similar to the situation in FIG. 26, whether a DOD drop forms depends on We and the response falls into one of three regimes. In regime A, where We≦5, a DOD is not formed. In regime B, where 5.5≦We≦8.5, a DOD drop is formed but the velocity at the tip of the DOD drop is negative at pinch-off. In regime C, where We≧9, a DOD drop is formed and the velocity at the tip of the DOD drop is positive at pinch-off.

Figure 32:
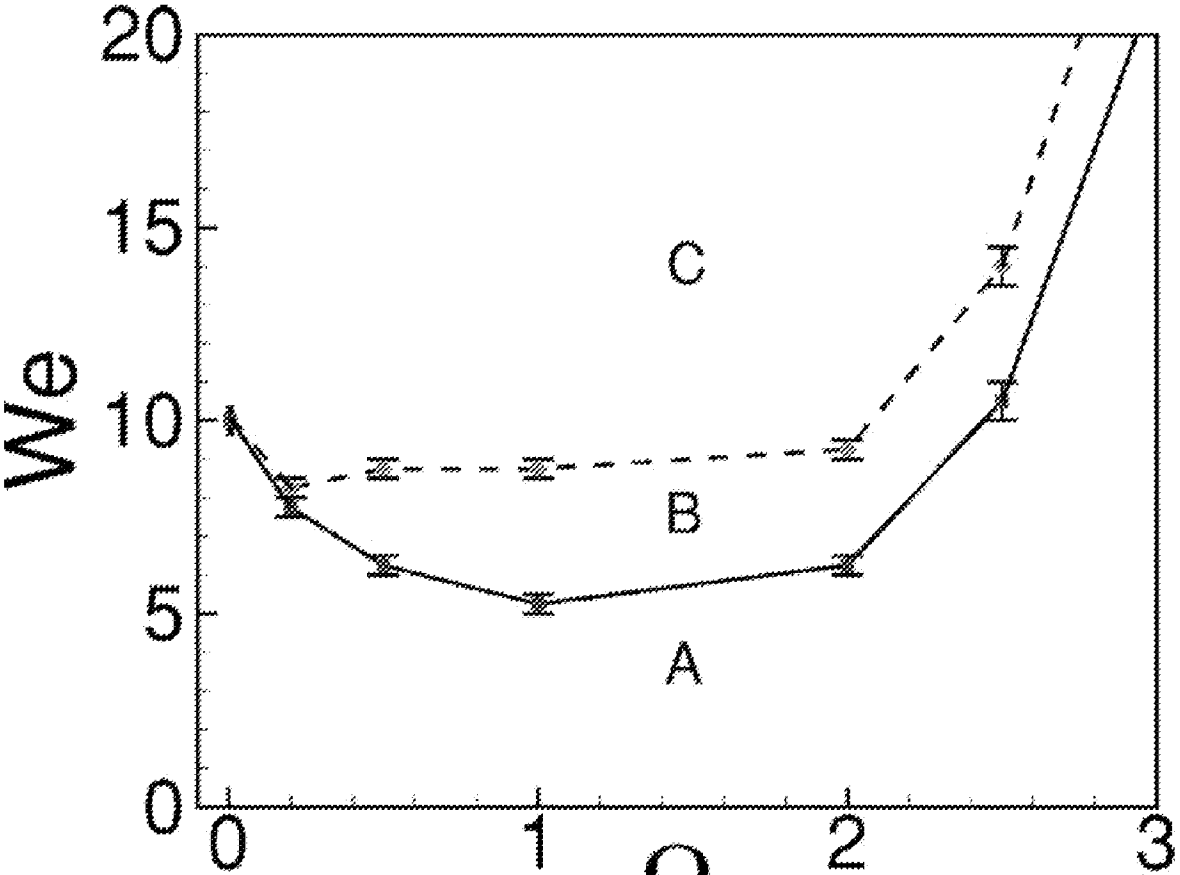
FIG. 32. Phase diagram in (We,Ω)-space when Oh=0.1 that identifies regions of the parameter space where a pendant drop breaks and gives rise to a DOD drop and those where DOD drop formation does not occur. In regime A, there is no DOD drop formation. In regime B, a DOD drop is formed but the velocity at the tip of the DOD drop at breakup is negative. In regime C, a DOD drop is formed and the velocity at the tip of the DOD drop at breakup is positive.

Motivated by the results reported in FIGS. 26, 28, and 30, it would be useful to construct a phase or operability diagram that delineates regions of the parameter space where DOD drops form from those where drop formation does not occur. FIG. 32 shows such a phase diagram in (We,Ω)-space when Oh=0.1. The phase diagram is divided into the three regions or regimes A, B, and C, as expected from the previous discussions. In regime A, there is no breakup and pendant drops undergo time periodic oscillations. In both regimes B and C, a growing pendant drop breaks and gives rise to a DOD drop, with the caveat that the tip of the drop has negative velocity in regime B and positive velocity in regime C. The locus of critical Weber numbers $We_{c1}$ as a function of frequency Ω below which a pendant drop does not break, i.e., the boundary between regimes A and B, is indicated by the solid line in FIG. 32. The locus of critical Weber numbers $We_{c2}$ as a function of Ω above which DOD drop formation occurs and where the drop's tip has positive velocity, i.e., the boundary between regimes C and B, is indicated by the dashed line in FIG. 32. At a given value of Ω, the critical Weber numbers are shown with error or uncertainty bars in FIG. 32 on account of the following method that is used to determine the boundaries between the three regimes. For example, for a given Ω, calculations are carried out to determine the value of We, say $We_-$, for which drop breakup still does not occur and a slightly larger value of We, say $We_+$, for which drop breakup just occurs. The critical value of the Weber number is then defined as $We_{c1}\equiv(We_+ + We_-)/2$, and the curve dividing regimes A and B is drawn through these values of $We_{c1}$ and where each error bar shown is of length $We_+ - We_-$. A similar procedure is followed for the curve dividing regimes C and B. Over the entire range of frequencies considered, $We_{c1}\leqq We_{c2}$.

FIG. 32 makes plain that DOD drop formation becomes difficult or the Weber number required for drop breakup becomes exceedingly large when Ω→0 and also when Ω>>1. When Ω→0, it takes an inordinately long time before the inflow is reversed. Since $\Delta V\chi 1/\Omega 1$ in this limit and the gravitational force that deforms drops during dripping is absent, the drop grows virtually as a section of a sphere when We is small or moderate. This limit is further discussed in the next paragraph. When Ω>>1, the injected volume $\Delta V\chi 1/\Omega\rightarrow 0$ or, in other words, the inflow is reversed before much fluid can be added to the drop. Thus, the pendant drop simply oscillates and breakup does not occur unless We>>1. These two opposing behaviors strike a balance when Ω≈1, where the critical Weber number $We_{c1}$ attains a minimum, as shown in FIG. 32. The curve of $We_{c2}$ versus Ω exhibits similar behavior, as also shown in FIG. 32.

Figure 33:
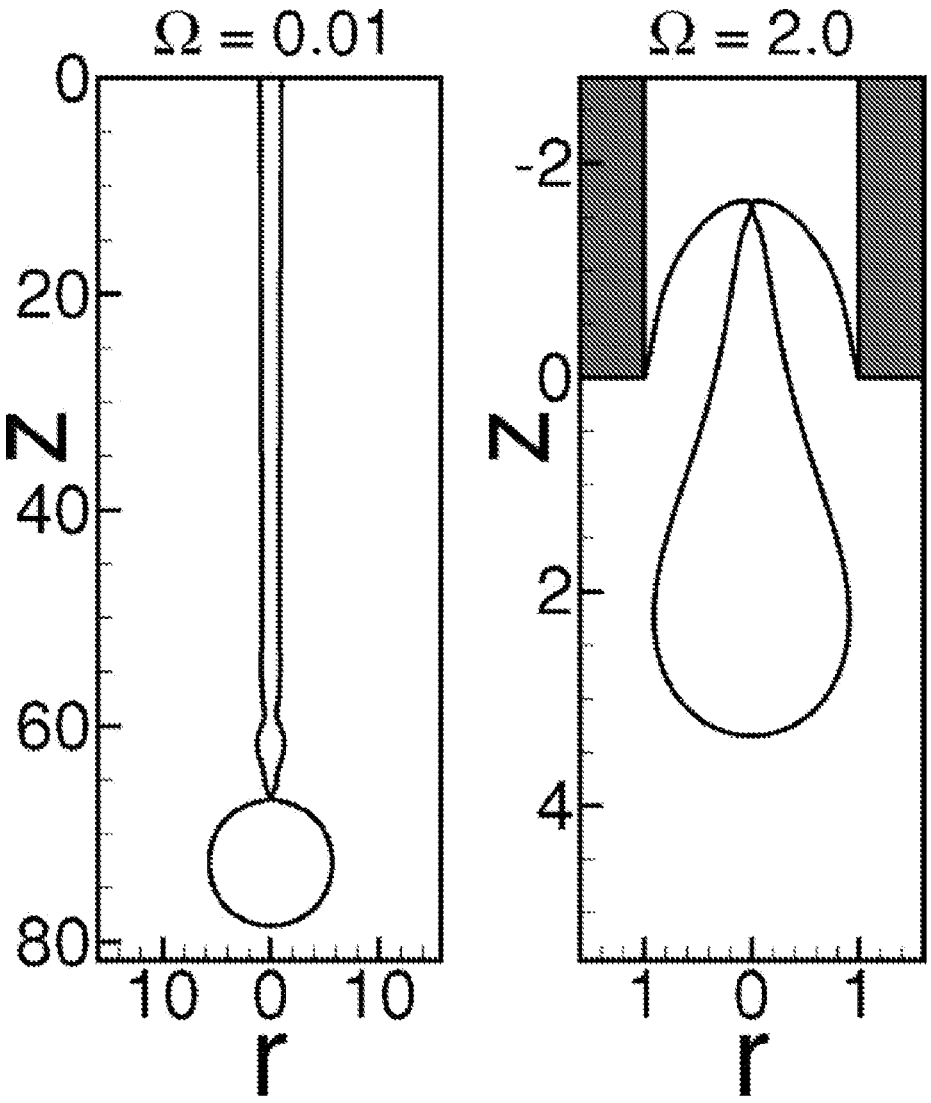
FIG. 33. The shapes of two DOD drops at the incipience of pinch-off when Oh=0.1 and We=10 for two different values of the frequency: Ω=0.01 and 2.0. The DOD drop volume is 792.9 when Ω=0.01 and 5.506 when Ω=2.0.

FIG. 33 shows that the mode of drop formation at low frequencies differs starkly from that when the frequency is of O(1) and compares the shapes of two drops at the incipience of pinch-off when Oh=0.1 and We=10 for two different values of the frequency: Ω=0.01 and 2.0. Although the maximum flow rates in both situations are the same, it takes 200 times longer to reverse the inflow in the situation where the frequency is low compared to that where the frequency is high. Thus, when Ω=0.01, the formation of a neck near the nozzle exit and its subsequent evacuation by the reversed inflow do not take place. Hence, a very long jet develops which then breaks up nearly a hundred radii downstream of the nozzle exit in a manner that is similar to the breakup of continuous jets seen in the dripping faucet problem at high flow rates. The volumes of the drops formed at breakup in FIG. 33 are also starkly different: $V_d$=792.9 when Ω=0.01, whereas $V_d$=5.506 when Ω=2. Since the goal in DOD inkjet printing is to produce drops that have volumes of the order of a sphere having the same radius as the nozzle radius, viz., 4π/3, the large drop volumes that would be produced at low frequencies run counter to the goal of producing small drops.

Although FIG. 32 shows that it is feasible to form drops for values of Ω much larger than 1, the calculations reveal that it becomes exceedingly more difficult to do so as Ω is increased beyond a certain value. For example, while it takes less than one period of oscillation to form drops at all values of Ω≦2 when $We=We_{c1}$ and $We_{c2}$ in FIG. 32, drop formation does not occur until the second period of oscillation at Ω=2.5 when $We=We_{c1}$ and $We_{c2}$.

Figure 34:
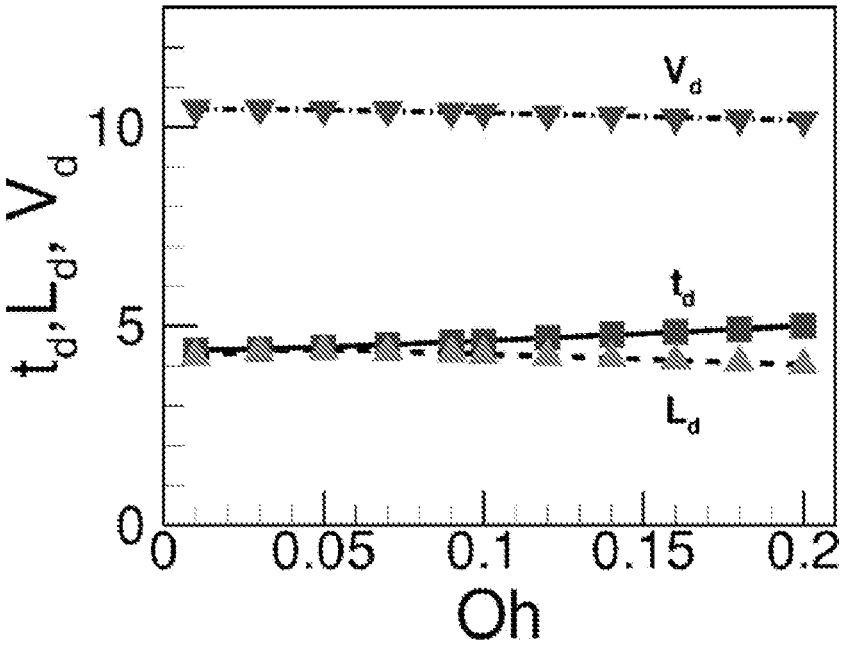
FIG. 34. Variation of breakup time $t_d$, limiting length $L_d$, and DOD drop volume $V_d$ with Ohnesorge number Oh when We=10 and Ω=1.
Figure 35:
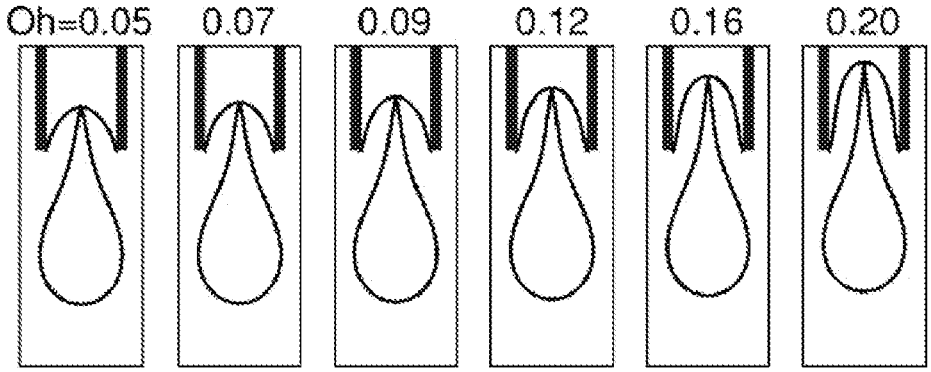
FIG. 35. Effect of Oh on drop shapes at breakup when We=10 and Ω=1.

FIG. 34 shows the variation with the Ohnesorge number Oh of $t_d$, $L_d$, and $V_d$, and FIG. 35 shows the variation with Oh of drop shapes at breakup when We=10 and Ω=1. FIGS. 34 and 35 show that the breakup time increases slightly, while both the limiting length and the DOD drop volume decrease slightly as Oh increases. Furthermore, FIG. 35 makes plain that the length of the fluid neck or thread that is formed prior to breakup and the extent of invasion of the tube by the retracting meniscus increase as Oh increases. That the breakup time increases as Oh increases as increasing viscous force relative to surface tension force slows the capillary pinching of the neck. As $t_d$ rises, the extent of tube invasion must increase on account of mass conservation. The size of DOD drops formed increases slightly as viscosity decreases, in accord with the computational results reported in FIG. 34. Furthermore, for all the cases shown in FIG. 35, We is sufficiently large that the velocity at the tips of the drops are positive at the instant of pinch-off.

Figure 36:
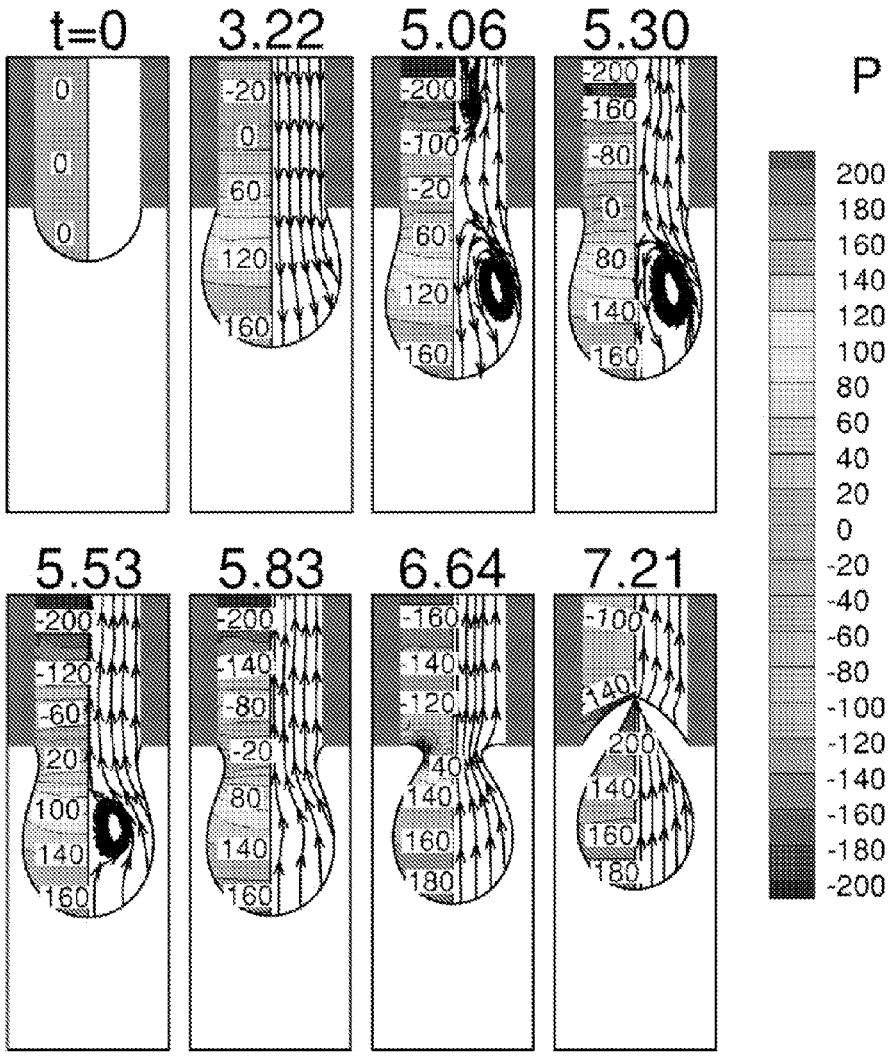
FIG. 36. Same as FIG. 22, but when Oh=0.01.
Figure 37:
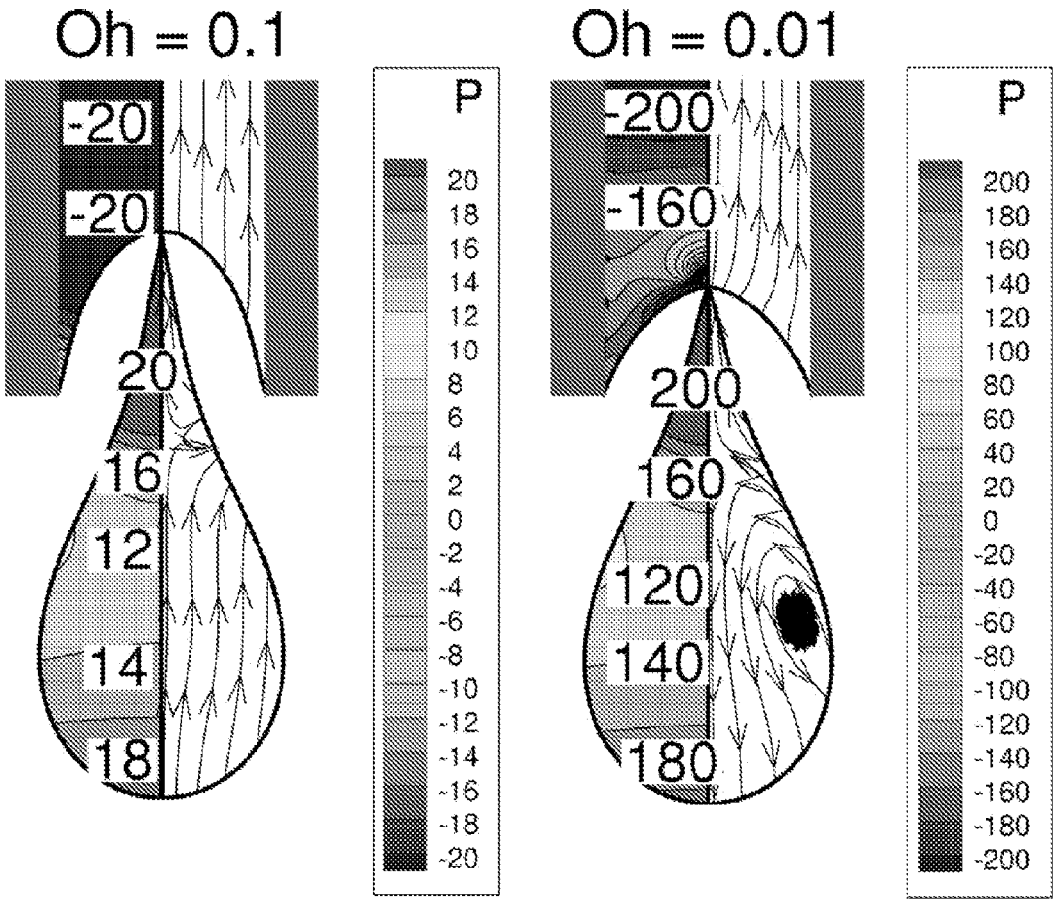
FIG. 37. Comparison of the instantaneous streamlines and pressure fields at the incipience of pinch-off for two drops of Oh=0.1 and Oh=0.01. Here, We=8.1 and Ω=0.9.

The acceleration of the thinning and pinching of fluid necks, and the concomitant facilitation of drop breakup, is not the only consequence of lowering of Oh. Another consequence of lowered Oh is highlighted in FIGS. 36 and 37. The rate of viscous momentum transfer is lower the lower is Oh. Therefore, the rate at which the effect of reversed inflow can be felt across the entire pendant drop and hence the rate at which the stagnation plane can sweep all the way to the tip of the drop decreases as Oh decreases, as shown in FIGS. 36 and 37. FIG. 36 shows a situation that is identical in every respect to that in FIG. 22, except for the value of Oh: Oh=0.01 in FIG. 36, whereas Oh=0.1 in FIG. 22. Comparison of these two Figures reveals that breakup occurs in the former case while it does not in the latter one. FIG. 37 shows the shapes at breakup of two drops when We=8.1 and $\sqrt{We}/\Omega=10$, i.e., Ω=0.9, but where Oh=0.1 for the drop on the left and Oh=0.01 for the drop on the right. Although both drops break, the velocity at the tip of the more viscous one, i.e., the one of higher Oh, is negative, whereas that of the less viscous one, i.e., the one of lower Oh, is positive, in accord with intuition.

Figure 38:
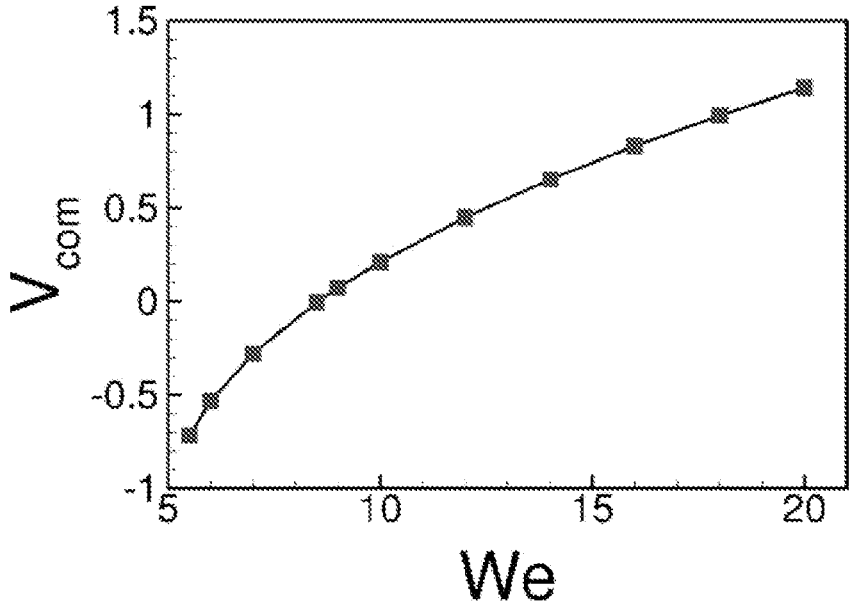
FIG. 38. Variation of the center-of-mass velocity of DOD drops at pinch-off ($V_{com}$) with Weber number We when Oh=0.1 and Ω=1.

In most applications of DOD ink-jet printing that involve printing on a substrate, e.g., in desk-top printing, the velocity of the drops formed must be about 2 m/s or larger. In certain uses of DOD ink-jet printing that do not involve printing on a substrate, e.g., in manufacturing polymer beads and capsules for controlled release applications, smaller velocities either can be tolerated or are more desirable. According to the foregoing results, even if a DOD drop is formed, its velocity may be negative unless the Weber number is sufficiently large. FIG. 38 shows the variation of the velocity of the center-of-mass of DOD drops ($V_{com}$) at the instant of pinchoff as a function of We. For the drops of ink being ejected from a DOD nozzle described at the beginning of this section, the characteristic velocity $v_c=R/t_c=\sqrt{\sigma/\rho R}$, is 2.24 m/s. Thus, the dimensionless values of $V_{com}$ reported in FIG. 38 should be multiplied by 2.24 m/s to convert them into dimensional velocities. FIG. 38 shows that $V_{com}$ increases monotonically with Weber number and equals 1.05, or 2.34 m/s, when We=20.

Figure 39:
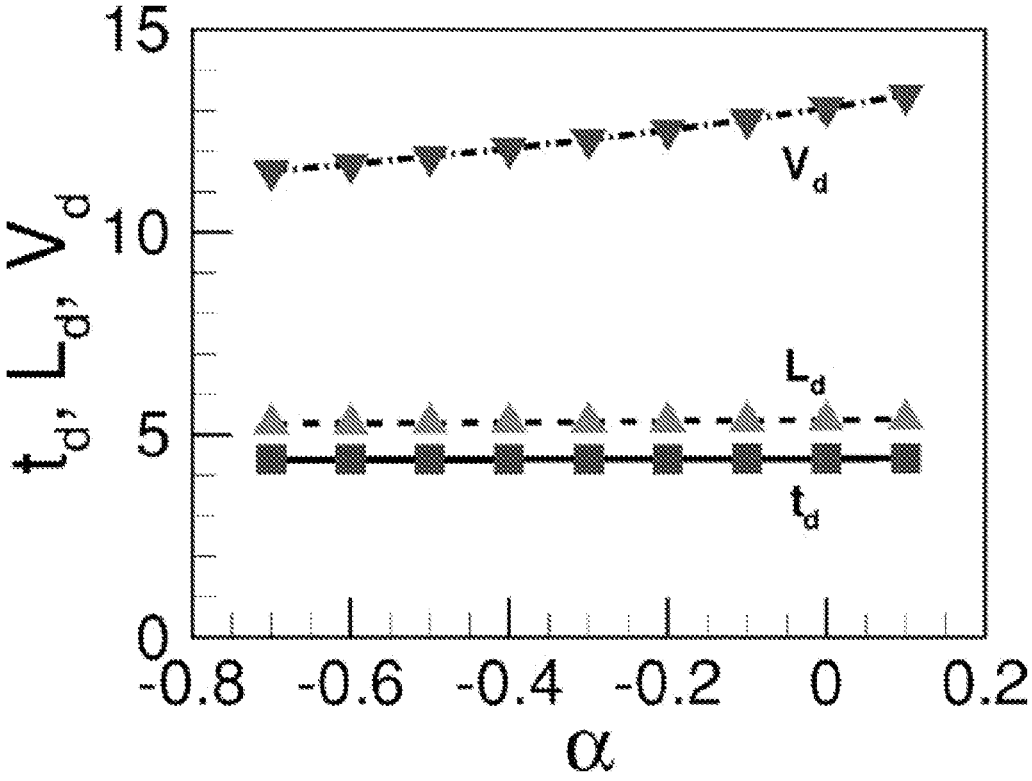
FIG. 39. Variation of breakup time $t_d$, limiting length $L_d$, and DOD drop volume $V_d$ with α when We=15, Ω=1 and Oh=0.1.

When the gravitational Bond number G<<1, the equilibrium shape of the meniscus that is pinned to the edge of the nozzle is a section of a sphere. Thus, the initial meniscus shape can be an inward or an outward section of a sphere, or flat. In practice, the inward (outward) sections of spheres can be obtained by applying a negative (positive) pressure at the nozzle. In some types of DOD ejectors, but not all, and in most DOD systems used in desk-top printing, initial meniscus shapes that are large outward sections of spheres are avoided because of concerns with the drop liquid wetting the face of the nozzle especially after long periods of nozzle inactivity. Problems with wetting can, of course, be eliminated by using surface-treated nozzles that guarantee that the contact line will remain pinned to the edge of the nozzle. In some DOD systems such as ones used in microarraying applications, both inward and outward sections of spheres can be used because in contrast to the ordinary and cheap household ink-jet printers, they either have built-in means for wiping the face of the nozzle or can be manually wiped clean if liquid should accumulate there either after some period of nozzle operation or following periods of prolonged nozzle inactivity. In all of the results presented up to this point, the initial drop shape has been taken to be a hemisphere. Therefore, it is of practical interest to know how the dynamics would be affected if the initial meniscus shape were to be varied. FIG. 39 shows the variation with the drop size parameter $\alpha$ of the DOD drop volume $V_d$, breakup time $t_d$, and drop length at breakup $L_d$. FIG. 39 makes plain that $t_d$ and $L_d$ are virtually invariant with $\alpha$ as the initial meniscus shape is varied from virtually a flat profile to an outward section of a sphere that encloses a volume slightly larger than a hemisphere. More reassuringly, $V_d$ also varies slightly with $\alpha$ and the derivative of $V_d$ with respect to $\alpha$ approaches zero for initial meniscus shapes approaching the planar profile.

The breakup times $t_d$, and the lengths Ld and volumes $V_d$ of drops at breakup are determined as functions of the dimensionless groups. These measures are shown to depend weakly on Oh when We is sufficiently large to ensure DOD drop formation. However, decreasing Oh is shown to facilitate the formation of DOD drops when We is moderate.

In most previous studies of DOD drop formation, researchers have imposed one of two types of boundary conditions at the inlet to the flow domain upstream of the nozzle exit. Some authors impose a pressure boundary condition at the inflow boundary, whereas others impose a velocity boundary condition there. These two approaches can be referred to, respectively, as a pressure-pulse-driven process and a flow-rate-driven process. In a piezo DOD nozzle, the flow is driven by the actual displacement of the piezo, whereas in a thermal or bubble jet DOD nozzle, the flow is driven by the growth of bubbles that nucleate on a heater. Thus, both the pressure-pulse-driven and the flowrate-driven processes are idealized descriptions of inflow boundary conditions in real nozzles. Both descriptions discuss the combination of push and suck pulses that arise in most DOD drop generation processes and cause flow toward and away from the nozzle outlet upstream of the outlet.

While the inventions have been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for expelling a drop of a fluid from an orifice, comprising:

providing a dispenser including a reservoir for a fluid, the reservoir having an internal volume that is electrically actuable between a smaller volume and a larger volume, the dispenser defining an orifice of a predetermined internal radius R, the orifice being provided the fluid from the reservoir;

providing a fluid to the dispenser, the fluid and orifice being characterized with an Ohnesorge number less than about 0.1, the fluid having a density $\rho$ and a surface tension $\sigma$;

providing an electronic controller to actuate the reservoir with a control signal at a predetermined frequency, the value of the frequency satisfying the following relationships:

$$20 \leqq [\text{value of frequency}] \times t_c \leqq 40, \text{ where}$$

$$t_c=\sqrt{\rho R^3/\sigma}$$

and $\leqq$ means approximately less than or equal to;

actuating the reservoir with the control signal; and expelling a drop of the fluid from the orifice by said actuating.

2. The method of claim 1 wherein said actuating is with a control signal having less than about 2 complete cycles.

3. The method of claim 1 wherein said actuating is with a control signal having less than 2 complete cycles.

4. The method of claim 1 wherein said actuating is with a control signal having about one complete cycle, and said actuating begins with drawing fluid from the orifice toward the reservoir.

5. The method of claim 1 wherein the drop is the only drop expelled by said actuating.

6. The method of claim 1 which further comprises stopping said actuating, and said expelling is after said stopping.

7. The method of claim 1 wherein the outer radius of the drop is less than about one fiftieth of the internal radius.

8. The method of claim 1 wherein said actuating includes establishing an initial drop shape of fluid at the orifice wherein:

$$1 \leqq \alpha \leqq -0.7$$

and $\alpha=\beta/D$ where the initial drop shape is taken as a section of a sphere of radius D and $\beta$ is the location of the center of the sphere relative to the center of the orifice within the plane of the orifice, with the convention that positive is outward of the orifice and away from the reservoir.

9. An apparatus for expelling a drop of fluid from an orifice, comprising:

a dispenser having a reservoir piezoelectrically actuatable between a smaller volume and a larger volume, said dispenser including an expulsion orifice having a radius and being in fluid communication with the reservoir;

an electronic controller operably connected to said dispenser and providing an electronic actuation signal to change the volume, the signal having a predetermined duration from a beginning to an end; and a supply of fluid to the reservoir, the Ohnesorge number of the fluid and the orifice being less than about 0.1;

wherein the beginning of the signal withdraws fluid toward the reservoir and the drop is expelled after the end of the signal;

wherein the actuation signal includes a signal of three hundred and sixty degrees, in which the first ninety degrees withdraws fluid from said orifice toward said reservoir, the next one hundred and eighty degrees propels fluid toward the orifice, and the final ninety degrees withdraws fluid toward the reservoir.

10. The apparatus of claim 9 wherein the signal is a sinusoidal signal.

11. The apparatus of claim 10 wherein the Ohnesorge number is greater than about 0.01.

12. The apparatus of claim 9 wherein the actuation signal includes frequency content that satisfies the following relationships:

$$20 \leqq [\text{value of frequency}] \times t_c \leqq < 40, \text{ where}$$

$$t_c = \sqrt{\rho R^3/\sigma}$$

and ≦means approximately less than or equal to;

the dispenser defining an orifice of a predetermined internal radius R, the fluid having a density ρ and a surface tension σ.

13. The apparatus of claim 9 wherein only one drop is expelled after the end of the actuation signal.

14. The apparatus of claim 9 wherein the drop is expelling during final ninety degrees that withdraws fluid toward the reservoir.

15. The apparatus of claim 9 wherein the outer radius of the drop is less than about one fiftieth of the radius of the expulsion orifice.

16. A method for expelling a drop of a fluid from an orifice, comprising:

providing a dispenser including a reservoir for a fluid, the reservoir having an internal volume that is electrically actuable to push fluid toward an orifice or to pull fluid away from the orifice, the orifice having a predetermined internal radius, and an actuation signal of three hundred sixty degrees, about the first ninety degrees of the actuation signal comprising a first electrical signal and about the next one hundred and eighty degrees of the actuation signal comprising a second electrical signal;

providing fluid to the reservoir, the Ohnesorge number of the fluid and the orifice being less than about 0.1;

creating a surface wave of the fluid at the orifice with the first electrical signal, the surface wave having a trough directed inward toward the reservoir;

pushing fluid from the reservoir toward the trough by the second electrical signal; and expelling a drop of the fluid from the orifice after said pushing.

17. The method of claim 16 wherein said creating includes pulling fluid away from the orifice by the first electrical signal.

18. The method of claim 16 wherein the Ohnesorge number is greater than about 0.01.

19. The method of claim 16 wherein said expelling is by a third electrical signal that withdraws fluid toward the reservoir.

20. The method of claim 16 which further comprises stopping said pushing, and said expelling is after said stopping.

21. The method of claim 16 wherein the drop is the only drop expelled by said expelling.

22. The method of claim 16 wherein the outer radius of the drop is less than about one fiftieth of the internal radius.

23. The method of claim 16 wherein the wherein the actuation signal includes frequency content that satisfies the following relationships:

$$20 \leqq [\text{value of frequency}] \times t_c \leqq 40, \text{ where}$$

$$t_c = \sqrt{\rho R^3/\sigma}$$

and <means approximately less than or equal to;

the dispenser defining an orifice of a predetermined internal radius R, the fluid having a density ρ and a surface tension σ.

24. The method of claim 16 which further comprises establishing an initial drop shape of fluid at the orifice wherein:

$$-1 \leqq \alpha \leqq -0.7$$

and $\alpha = \beta/D$ where the initial drop shape is taken as a section of a sphere of radius D and β is the location of the center of the sphere relative to the center of the orifice within the plane of the orifice, with the convention that positive is outward of the orifice and away from the reservoir.

25. A method for expelling a drop of a fluid from an orifice, comprising:

providing a dispenser including a reservoir for a fluid, the reservoir having an internal volume that is electrically actuable between a smaller volume and a larger volume, the dispenser defining an orifice of a predetermined internal radius, the orifice being provided the fluid from the reservoir;

providing an electronic controller to actuate the reservoir with a control signal at a predetermined frequency providing fluid to the reservoir, the Ohnesorge number of the fluid and the orifice being greater than about 0.01 and less than about 0.1;

establishing an initial drop shape of substantially quiescent fluid at the orifice wherein:

$$-1 \leqq \alpha \leqq -0.7$$

and $\alpha = \beta/D$ where the initial drop shape is taken as a section of a sphere of radius D and β is the location of the center of the sphere relative to the center of the orifice within the plane of the orifice, with the convention that positive is outward of the orifice and away from the reservoir;

actuating the reservoir with the control signal;

beginning said actuating by withdrawing the substantially quiescent fluid from the orifice toward the reservoir;

expelling a drop of the fluid from the orifice after said actuating.

26. The method of claim 25 wherein said expelling is by withdrawing fluid toward the reservoir.

27. The method of claim 25 which further comprises stopping said actuating, and said expelling is after said stopping.

28. The method of claim 25 wherein the drop is the only drop expelled by said actuating.

29. The method of claim 25 wherein the outer radius of the drop is less than about one fiftieth of the internal radius.

30. The method of claim 25 wherein the value of the predetermined frequency satisfies the following relationships:

$$20 \leqq [\text{value of frequency}] \times t_c \leqq 40, \text{ where}$$

$$t_c = \sqrt{\rho R^3/\sigma}$$

and ≦means approximately less than or equal to;

the dispenser defining an orifice of a predetermined internal radius R, the fluid having a density ρ and a surface tension σ.

* * * * *

UNITED STATES PATENT AND TRADEMARK OFFICE

CERTIFICATE OF CORRECTION

PATENT NO. : 8,186,790 B2
APPLICATION NO. : 12/405183
DATED : May 29, 2012
INVENTOR(S) : Osman Basaran and Qi Xu It is certified that error appears in the above-identified patent and that said Letters Patent is hereby corrected as shown below:

Col. 26, line 33, please delete “drawing” and insert in lieu thereof, -- withdrawing --.

Col. 26, line 43, please delete “1” and insert in lieu thereof -- -1 --.

Col. 27, line 12, please delete the “<” symbol immediately preceding numeral “40.”.

Col. 28, line 7, please delete the “<” symbol and insert in lieu thereof -- ≤ --.

Signed and Sealed this
Fourteenth Day of August, 2012

David J. Kappos

David J. Kappos
*Director of the United States Patent and Trademark Office*